US009821429B2

(12) United States Patent
Ishii et al.

(10) Patent No.: US 9,821,429 B2
(45) Date of Patent: Nov. 21, 2017

(54) POLISHING PAD AND CHEMICAL MECHANICAL POLISHING APPARATUS FOR POLISHING A WORKPIECE, AND METHOD OF POLISHING A WORKPIECE USING THE CHEMICAL MECHANICAL POLISHING APPARATUS

(71) Applicant: EBARA CORPORATION, Tokyo (JP)

(72) Inventors: Yu Ishii, Tokyo (JP); Kenya Ito, Tokyo (JP); Shozo Takahashi, Kanagawa (JP); Mika Suzuki, Kanagawa (JP)

(73) Assignee: EBARA CORPORATION, Tokyo (JP)

( * ) Notice: Subject to any disclaimer, the term of this patent is extended or adjusted under 35 U.S.C. 154(b) by 25 days.

(21) Appl. No.: 13/891,702

(22) Filed: May 10, 2013

(65) Prior Publication Data

US 2014/0004772 A1 Jan. 2, 2014

(30) Foreign Application Priority Data

May 14, 2012 (JP) ..... 2012-110941
Nov. 22, 2012 (JP) ..... 2012-256027
Dec. 21, 2012 (JP) ..... 2012-278901

(51) Int. Cl.

*B24B 37/005* (2012.01)
*B24B 37/10* (2012.01)
*B24B 37/30* (2012.01)
*B24B 37/04* (2012.01)
*B24B 37/24* (2012.01)

(52) U.S. Cl.

CPC ..... *B24B 37/005* (2013.01); *B24B 37/042* (2013.01); *B24B 37/10* (2013.01); *B24B 37/24* (2013.01); *B24B 37/30* (2013.01)

(58) Field of Classification Search

CPC ..... B24B 37/005; B24B 37/042; B24B 37/10; B24B 37/24; B24B 37/30
USPC ..... 451/5, 288
See application file for complete search history.

(56) References Cited

U.S. PATENT DOCUMENTS 5,257,478 A * 11/1993 Hyde et al. ..... 451/287
5,700,180 A * 12/1997 Sandhu et al. ..... 451/5
5,722,875 A * 3/1998 Iwashita et al. ..... 451/8
6,280,292 B1 * 8/2001 Sato et al. ..... 451/9
6,402,590 B1 * 6/2002 Neston et al. ..... 451/9
6,428,389 B2 * 8/2002 Sato et al. ..... 451/9
6,500,055 B1 * 12/2002 Adams et al. ..... 451/270
6,511,362 B1 * 1/2003 Akaike et al. ..... 451/5
6,641,471 B1 * 11/2003 Pinheiro et al. ..... 451/526
6,746,311 B1 * 6/2004 Kessel ..... 451/41
(Continued)

FOREIGN PATENT DOCUMENTS

CN 101143432 A 3/2008
JP 06-031628 A 2/1994
(Continued)

*Primary Examiner* — Marc Carlson
(74) *Attorney, Agent, or Firm* — Pearne & Gordon LLP

(57) ABSTRACT

A polishing pad for polishing a workpiece to a mirror finish is attached to a rotatable polishing table of a chemical mechanical polishing apparatus. The workpiece, such as a metal body, is held by a carrier and pressed against the polishing pad. This polishing pad includes: an elastic pad having a polishing surface; a deformable base layer that supports the elastic pad; and an adhesive layer that joins the elastic pad to the base layer.

36 Claims, 47 Drawing Sheets

(56) References Cited

U.S. PATENT DOCUMENTS

| | | | | |
|---|---|---|---|---|
| 7,654,885 | B2 * | 2/2010 | Tsai et al. | 451/288 |
| 7,976,952 | B2 * | 7/2011 | Yoshida et al. | 428/423.7 |
| 8,430,717 | B2 * | 4/2013 | Duescher | 451/8 |
| 8,696,405 | B2 * | 4/2014 | Duescher | 451/11 |
| 2001/0034186 | A1 | 10/2001 | Sato | |
| 2002/0016074 | A1 * | 2/2002 | Kimura et al. | 438/692 |
| 2004/0055223 | A1 * | 3/2004 | Ono et al. | 51/293 |
| 2004/0058630 | A1 * | 3/2004 | Park et al. | 451/288 |
| 2004/0137826 | A1 * | 7/2004 | Gagliardi | 451/41 |
| 2004/0137831 | A1 * | 7/2004 | Kollodge et al. | 451/41 |
| 2004/0146712 | A1 * | 7/2004 | Obeng | 428/411.1 |
| 2005/0142987 | A1 * | 6/2005 | Kramer et al. | 451/5 |
| 2005/0197050 | A1 * | 9/2005 | Prasad et al. | 451/41 |
| 2006/0063470 | A1 * | 3/2006 | Boyd et al. | 451/5 |
| 2006/0183412 | A1 * | 8/2006 | Allison et al. | 451/526 |
| 2006/0280930 | A1 * | 12/2006 | Shimomura et al. | 428/304.4 |
| 2008/0004743 | A1 * | 1/2008 | Goers et al. | 700/121 |
| 2009/0075568 | A1 * | 3/2009 | Kimura et al. | 451/59 |
| 2009/0093200 | A1 * | 4/2009 | Iwase et al. | 451/527 |
| 2009/0156098 | A1 * | 6/2009 | Swedek et al. | 451/5 |
| 2009/0170413 | A1 * | 7/2009 | Hsu et al. | 451/533 |
| 2009/0209185 | A1 * | 8/2009 | Motonari et al. | 451/527 |
| 2009/0253353 | A1 * | 10/2009 | Ogawa et al. | 451/41 |
| 2009/0305609 | A1 * | 12/2009 | Khau et al. | 451/5 |
| 2010/0120343 | A1 * | 5/2010 | Kato et al. | 451/533 |
| 2010/0178853 | A1 * | 7/2010 | Oliver | 451/59 |
| 2010/0255756 | A1 * | 10/2010 | Ishii et al. | 451/5 |
| 2010/0267318 | A1 * | 10/2010 | Duboust et al. | 451/533 |
| 2011/0045744 | A1 * | 2/2011 | Feng et al. | 451/41 |
| 2012/0270478 | A1 * | 10/2012 | Duescher | 451/59 |
| 2013/0236724 | A1 * | 9/2013 | Yamamoto et al. | 428/349 |

FOREIGN PATENT DOCUMENTS

| | | | |
|---|---|---|---|
| JP | 06-071552 | A | 3/1994 |
| JP | 07-328935 | A | 12/1995 |
| JP | 08-309658 | A | 11/1996 |
| JP | 09-109010 | A | 4/1997 |
| JP | 11-070450 | A | 3/1999 |
| JP | 11-090818 | A | 4/1999 |
| JP | 2001-136422 | A | 5/2001 |
| JP | 2002-075933 | A | 3/2002 |
| JP | 2002-144200 | A | 5/2002 |
| JP | 2002-280337 | A | 9/2002 |
| JP | 2005-056920 | A | 3/2005 |
| JP | 2011-056597 | A | 3/2011 |
| TW | 201107076 | A | 3/2011 |

* cited by examiner

POLISHING PAD AND CHEMICAL MECHANICAL POLISHING APPARATUS FOR POLISHING A WORKPIECE, AND METHOD OF POLISHING A WORKPIECE USING THE CHEMICAL MECHANICAL POLISHING APPARATUS

CROSS REFERENCE TO RELATED APPLICATIONS

This application claims priorities to Japanese Patent Application No. 2012-110941 filed May 14, 2012, Japanese Patent Application No. 2012-256027 filed Nov. 22, 2012, and Japanese Patent Application No. 2012-278901 filed Dec. 21, 2012, the entire contents of which are hereby incorporated by reference.

BACKGROUND OF THE INVENTION

Field of the Invention

The present invention relates to a polishing pad and a chemical mechanical polishing (CMP) apparatus for polishing a workpiece, such as a metal body, to a mirror finish. The present invention further relates to a method of polishing the workpiece using such a chemical mechanical polishing apparatus.

Description of the Related Art

From a viewpoint of design, there has been a demand for mirror-polishing a workpiece having a three-dimensional surface constituted by a combination of a planar surface and a curved surface. Examples of such a workpiece include a metal body made of aluminum, stainless steel, or the like, and a resin body. The body may be used in, for example, a cellular phone, a smart phone, a multifunction mobile terminal, a portable game device, a camera, a watch, a music media player, a personal computer, car parts, ornaments, medical equipment, or the like.

A conventional lapping technique and a conventional polishing technique can polish the planar surface to a mirror finish. However, it is very difficult for these techniques to polish the curved surface to a mirror finish. A hand-type buffing process can polish the curved surface and the planar surface, but cannot achieve a mirror-finished surface (particularly a mirror-finished planar surface) to the same level as the lapping technique and the polishing technique.

SUMMARY OF THE INVENTION

The present invention has been made in view of the above drawbacks. It is therefore an object of the present invention to provide a polishing pad capable of polishing a workpiece, which has a three-dimensional surface constituted by a combination of a planar surface and a curved surface, to a mirror finish. The present invention also relates to a chemical mechanical polishing apparatus capable of polishing such a workpiece to a mirror finish. The present invention further relates to a method of polishing a workpiece using such a chemical mechanical polishing apparatus.

A first aspect of the present invention for achieving the above object provides a polishing pad for polishing a workpiece. The polishing pad includes: an elastic pad having a polishing surface; a deformable base layer that supports the elastic pad; and an adhesive layer that joins the elastic pad to the base layer.

In a preferred aspect, the base layer is thicker than the elastic pad.

In a preferred aspect, the base layer has a thickness at least three times that of the elastic pad.

In a preferred aspect, the base layer is softer than the elastic pad.

In a preferred aspect, the adhesive layer has a higher elasticity than that of the elastic pad.

In a preferred aspect, the adhesive layer is made of adhesive material capable of staying in a soft state.

In a preferred aspect, the elastic pad is made of foamed polyester.

In a preferred aspect, the base layer is made of polyurethane sponge.

In a preferred aspect, the adhesive layer is made of acrylic adhesive material.

A second aspect of the present invention provides a chemical mechanical polishing apparatus for polishing a workpiece. The apparatus includes: the above-described polishing pad; a rotatable polishing table supporting the polishing pad; a carrier configured to hold the workpiece and press the workpiece against the polishing pad; a rotating device configured to rotate the carrier about its own axis; and a polishing liquid supply mechanism configured to supply a polishing liquid onto the polishing pad.

In a preferred aspect, the carrier includes a pivot mechanism configured to cause the workpiece to pivot about a predetermined pivot axis extending near a surface, to be polished, of the workpiece.

In a preferred aspect, the chemical mechanical polishing apparatus further includes a lifting device configured to exert an upward force on the carrier so as to regulate polishing pressure of the workpiece.

A third aspect of the present invention provides a chemical mechanical polishing method of polishing a workpiece. The method includes: rotating the above-described polishing pad; supplying a polishing liquid onto the polishing pad; and rotating a carrier, which is holding the workpiece, on the polishing pad about an axis of the carrier.

In a preferred aspect, the chemical mechanical polishing method further includes causing the workpiece to pivot about a predetermined pivot axis extending near a surface, to be polished, of the workpiece, while rotating the carrier about the axis thereof.

In a preferred aspect, the chemical mechanical polishing method further includes causing a part of the workpiece to sink into the polishing pad, while rotating the carrier about the axis thereof.

In a preferred aspect, the chemical mechanical polishing method further includes deforming the polishing pad into a shape of a contact portion of the workpiece where the workpiece is in contact with the polishing pad, while rotating the carrier about the axis thereof.

In a preferred aspect, the chemical mechanical polishing method further includes exerting an upward force on the carrier so as to regulate polishing pressure of the workpiece, while rotating the carrier about the axis thereof.

A fourth aspect of the present invention provides a chemical mechanical polishing apparatus, including: a rotatable polishing table for supporting a polishing pad; a carrier configured to press a workpiece against the polishing pad; a rotating device configured to rotate the carrier about its own axis; and a polishing liquid supply mechanism configured to supply a polishing liquid onto the polishing pad, wherein the carrier includes a pivot mechanism configured to cause the workpiece to pivot. The pivot mechanism includes a workpiece holder configured to hold the workpiece, and a rotary actuator configured to cause the workpiece holder to pivot about a predetermined pivot axis through a predetermined angle with the workpiece placed in contact with the polishing pad.

In a preferred aspect, the pivot mechanism further includes at least one rotary coupling configured to couple the workpiece holder to the rotary actuator, and the rotary coupling is configured to allow an angle of the workpiece holder to change relative to the rotary actuator.

In a preferred aspect, the rotary coupling is configured to support the workpiece holder such that the workpiece holder is rotatable about a rotation axis extending in parallel with the pivot axis.

In a preferred aspect, the at least one rotary coupling comprises a first rotary coupling and a second rotary coupling, the first rotary coupling is configured to couple the workpiece holder to the second rotary coupling and support the workpiece holder rotatably about a first rotation axis extending in parallel with the pivot axis, and the second rotary coupling is configured to couple the first rotary coupling to the rotary actuator and support the first rotary coupling rotatably about a second rotation axis extending in parallel with the pivot axis and the first rotation axis.

In a preferred aspect, the workpiece has surfaces, to be polished, including a first surface, a second surface, and a curved surface connecting the first surface to the second surface, and the predetermined angle is an angle between the first surface and the second surface.

In a preferred aspect, the carrier further includes a cover member that covers the workpiece along an edge of a surface, to be polished, of the workpiece.

In a preferred aspect, the carrier further includes a programmable controller configured to control operations of the pivot mechanism, and a communication device configured to communicate with an external central controller. The programmable controller is configured to transmit and receive information to and from the central controller through the communication device.

In a preferred aspect, the chemical mechanical polishing apparatus further includes a lifting device configured to exert an upward force on the carrier so as to control polishing pressure of the workpiece.

A fifth aspect of the present invention provides a chemical mechanical polishing apparatus, including: a rotatable polishing table for supporting a polishing pad; a carrier configured to press a workpiece against the polishing pad; a rotating device configured to rotate the carrier about its own axis; and a polishing liquid supply mechanism configured to supply a polishing liquid onto the polishing pad. The carrier includes a workpiece holder configured to hold the workpiece, a rotary actuator configured to rotate the workpiece, held by the workpiece holder, about a central axis of the workpiece at a preset speed, and a vertically moving mechanism configured to move the workpiece up and down in synchronization with the rotation of the workpiece.

In a preferred aspect, the rotary actuator comprises a servomotor.

In a preferred aspect, a rotation axis of the rotary actuator is inclined with respect to a direction perpendicular to the polishing pad.

In a preferred aspect, the carrier further includes a cover member that covers the workpiece along an edge of a surface, to be polished, of the workpiece.

In a preferred aspect, the carrier further includes a programmable controller configured to control operations of the rotary actuator and the vertically moving mechanism, and a communication device configured to communicate with an external central controller. The programmable controller is configured to transmit and receive information to and from the central controller through the communication device.

In a preferred aspect, the chemical mechanical polishing apparatus further includes a lifting device configured to exert an upward force on the carrier so as to regulate polishing pressure of the workpiece.

According to the first to third aspects of the present invention, when the workpiece is pressed against the polishing pad, the workpiece sinks into the polishing pad and the elastic pad is deformed along the curved surface of the workpiece. As a result, the polishing surface of the polishing pad uniformly contacts the curved surface of the workpiece in its entirety and can therefore polish the curved surface of the workpiece to a mirror finish.

According to the fourth aspect of the present invention, the workpiece pivots about the predetermined pivot axis when the workpiece is being polished. Therefore, the curved surface in its entirety near the pivot axis can be brought into contact with the polishing pad. In this state, the polishing pad can polish the curved surface to a mirror finish.

According to the fifth aspect of the present invention, the circumferential surface of the workpiece can be polished while the workpiece is rotated about its central axis continuously or intermittently. Therefore, it is possible to form a smooth mirror-finished surface with no polishing stripe left thereon.

DETAILED DESCRIPTION OF THE PREFERRED EMBODIMENTS

Embodiments of the present invention will be described below with reference to the drawings.

Figure 1:
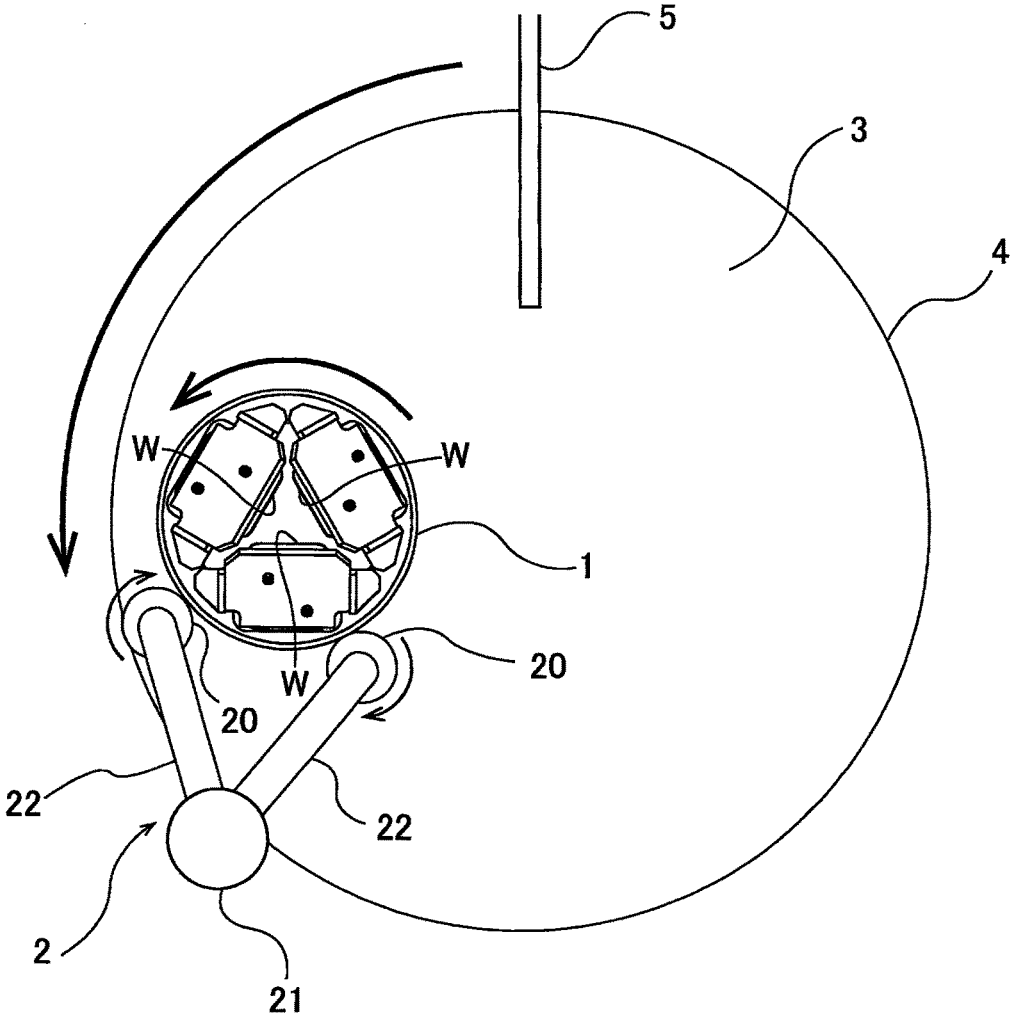
FIG. 1 is a plan view showing a CMP (chemical mechanical polishing) apparatus for polishing a workpiece to a mirror finish.

FIG. 1 is a plan view showing a CMP (chemical mechanical polishing) apparatus for polishing a workpiece to a mirror finish. As shown in FIG. 1, the CMP apparatus has a carrier 1 configured to hold a workpiece W to be polished, a rotating device 2 configured to rotate the carrier 1, a polishing pad 3 configured to polish the workpiece W, a rotatable polishing table 4 configured to support the polishing pad 3, and a polishing liquid supply mechanism 5 configured to supply a polishing liquid (slurry) onto the polishing pad 3.

The polishing pad 3 has a circular disk shape and is attached to a flat upper surface of the polishing surface 4 by an adhesive or a double-sided tape. A motor (not shown in FIG. 1) is disposed below the polishing table 4, so that the polishing table 4 and the polishing pad 3 are rotated together by the motor. The polishing pad 3 has an upper surface that serves as a polishing surface for polishing the workpiece W.

The rotating device 2 has two rollers 20 and 20 which are brought into rolling contact with a circumferential surface of the carrier 1, and a common motor 21 configured to rotate these rollers 20 and 20. The rollers 20 and 20 are coupled to the motor 21 by power transmission mechanisms 22 and 22, each of which is constituted by a belt and pulleys, or other elements. With these structures, the two rollers 20 and 20 are rotated by the motor 21 at the same speed in the same direction. The motor 21 and the rollers 20 and 20 are located above the polishing pad 3 (i.e., without contacting the polishing pad 3).

Figure 2:
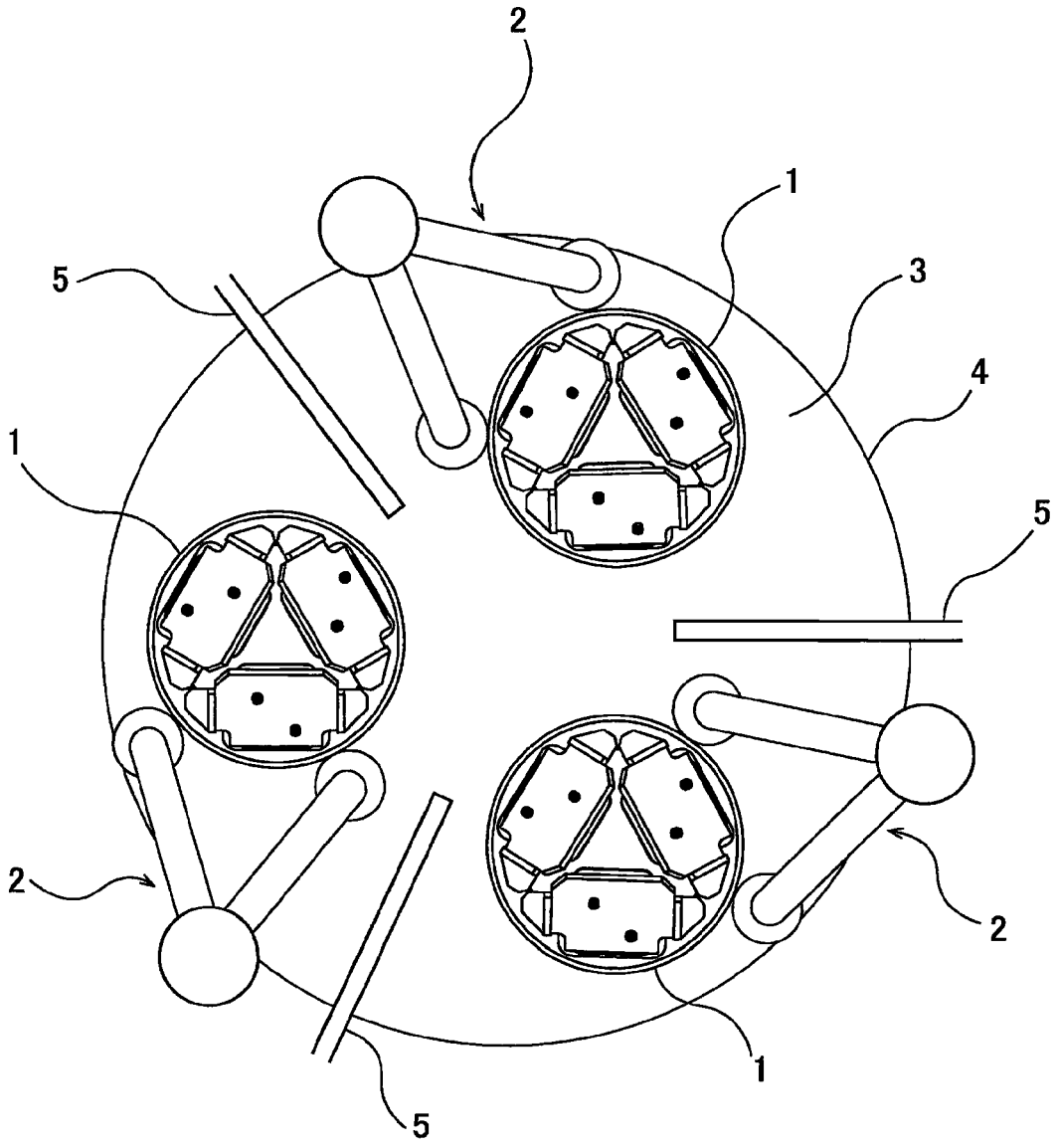
FIG. 2 is a plan view showing the CMP apparatus including plural pairs of carriers and rotating devices.

The carrier 1 is just placed on the polishing pad 3, and is supported by the rollers 20 and 20 arranged downstream of the carrier 1 with respect to a rotating direction of the polishing table 4. Specifically, during rotation of the polishing table 4, the carrier 1 is fixed in its position on the polishing pad 3 by the rollers 20 and 20, and is rotated about its own axis by the rotation of the rollers 20 and 20. As shown in FIG. 2, it is possible to install multiple sets of the carriers 1 and the rotating devices 2. Further, a larger number of carriers 1 can be placed on the polishing pad 3 by using a polishing table having a larger diameter.

Figure 3A:
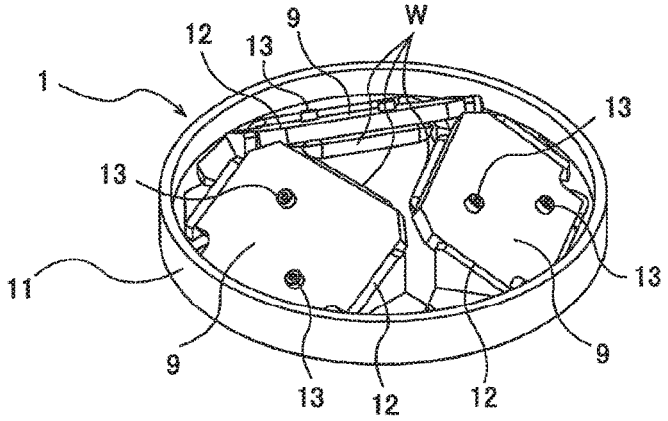
FIG. 3A is a perspective view of the carrier.
Figure 3B:
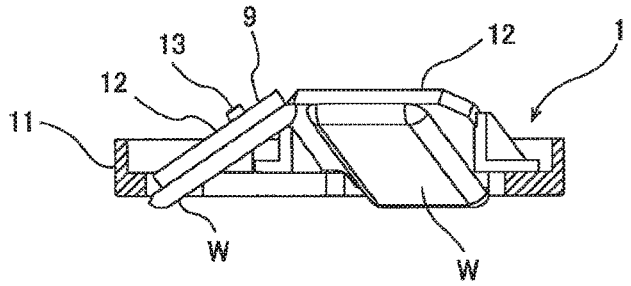
FIG. 3B is a vertical cross-sectional view of the carrier.
Figure 3C:
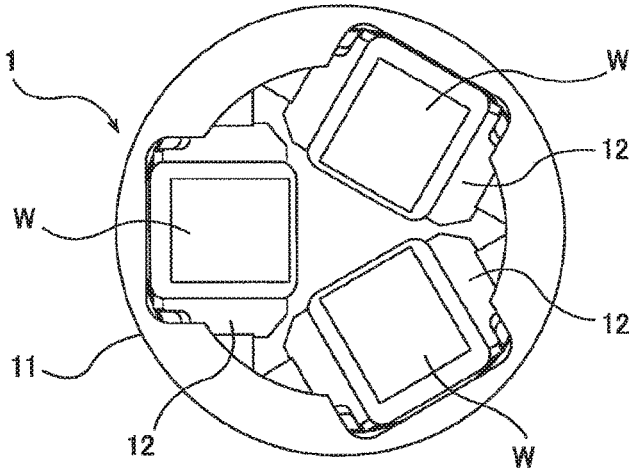
FIG. 3C is a bottom view of the carrier.

FIG. 3A is a perspective view of the carrier 1, FIG. 3B is a vertical cross-sectional view of the carrier 1, and FIG. 3C is a bottom view of the carrier 1. The carrier 1 includes a ring 11 surrounding a plurality of (e.g., three in the drawings) workpieces W, and workpiece holders 9 configured to hold the workpieces W, respectively. Each workpiece holder 9 has a mounting base 12 and mounting tools 13. The mounting base 12 is secured to an upper surface of the ring 11. Each workpiece W is removably attached to the mounting base 12 by the mounting tools 13. The rollers 20 and 20 (see FIG. 1) of the rotating device 2 are brought into contact with an outer circumferential surface of the ring 11.

As shown in FIG. 3B, the workpiece W is held by the workpiece holder 9 such that a portion, to be polished, of the workpiece W projects downward from a bottom surface of the carrier 1. The carrier 1 is configured to be able to hold the plurality of workpieces W. While FIG. 3A through FIG. 3C illustrate an example of the carrier 1 designed to hold three workpieces W, it is possible to use a carrier capable of holding two or less workpieces W or four or more workpieces W.

Figure 4:
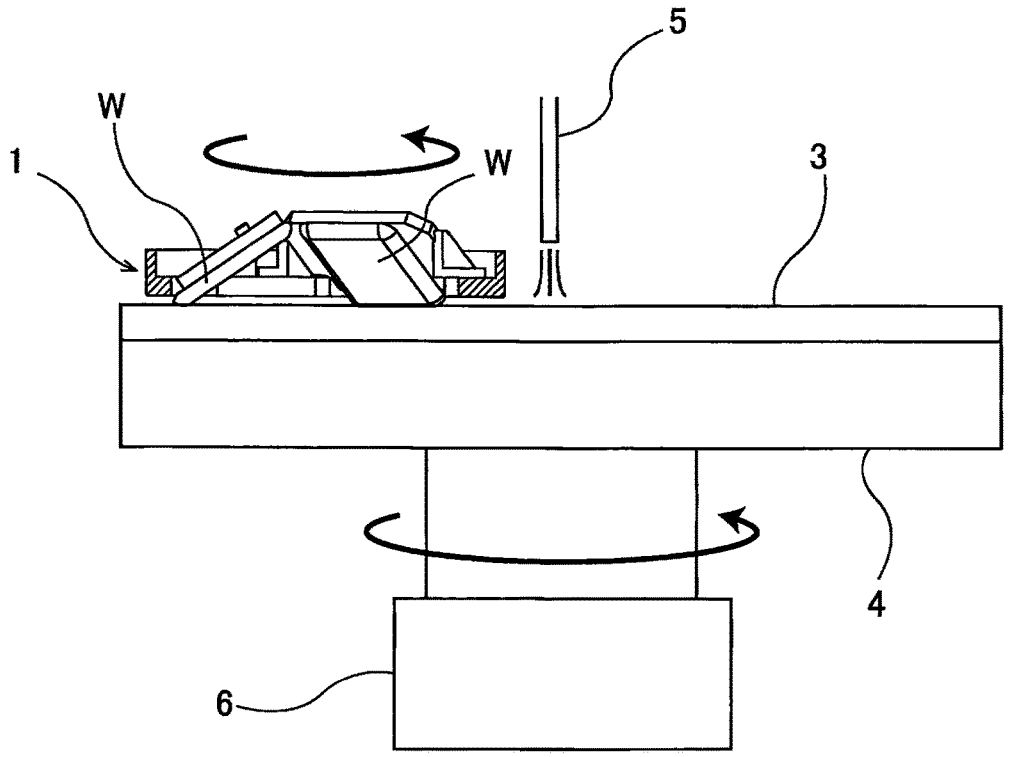
FIG. 4 is a side view of the CMP apparatus.

FIG. 4 is a side view of the CMP apparatus. In FIG. 4, the rotating device 2 is not depicted for the purpose of illustrating the structure of the carrier 1. As shown in FIG. 4, the polishing table 4 and the polishing pad 3 are rotated by a motor 6 coupled to the polishing table 4. The carrier 1 and the polishing table 4 are rotated in the same direction. The portion of the workpiece W projecting downward from the carrier 1 is pressed against the polishing surface of the polishing pad 3 under self-weight of the carrier 1 and the workpiece W.

During polishing of the workpiece W, the polishing table 4 and the carrier 1 are rotated individually, and the polishing liquid is supplied onto the polishing pad 3 from the polishing liquid supply mechanism 5. The workpiece W is polished by the polishing pad 3 in the presence of the polishing liquid. The polishing liquid contains abrasive grains for polishing the workpiece W and an oxidizing agent for oxidizing a surface of the workpiece W. The workpiece W is brought into sliding contact with the polishing pad 3 in the presence of the polishing liquid, so that the surface of the workpiece W is polished to a mirror finish due to a chemical action of the oxidizing agent and a mechanical action of the abrasive grains.

Figure 5A:
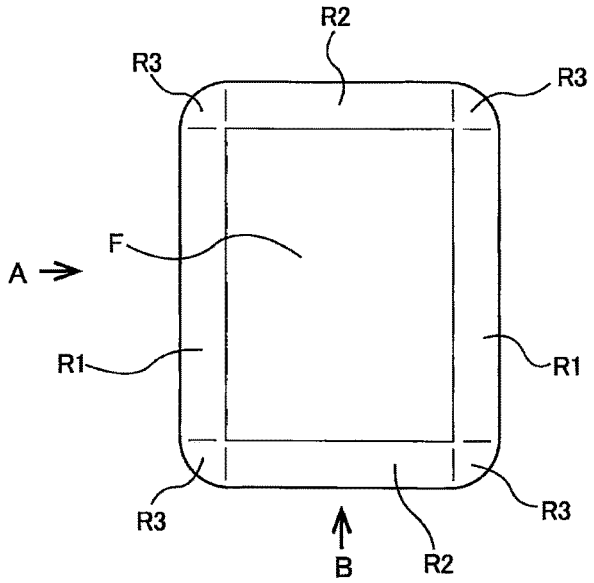
FIG. 5A is a view showing a workpiece.
Figure 5B:
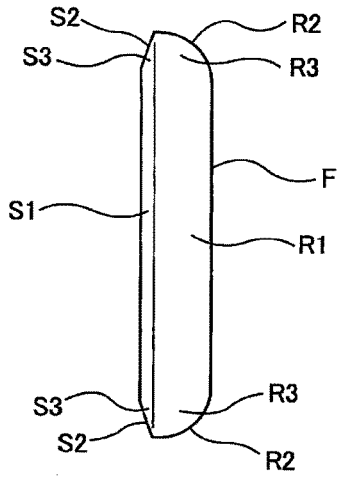
FIG. 5B is a view showing the workpiece as viewed from a direction indicated by arrow A in FIG. 5A.
Figure 5C:
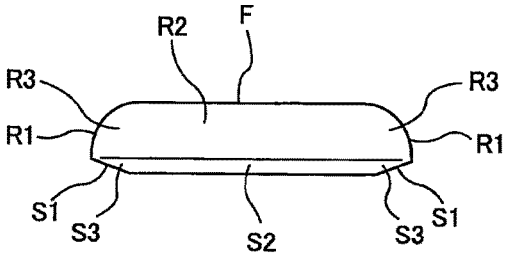
FIG. 5C is a view showing the workpiece as viewed from a direction indicated by arrow B in FIG. 5A.

FIG. 5A is a view showing the workpiece W, FIG. 5B is a view showing the workpiece W as viewed from a direction indicated by arrow A in FIG. 5A, and FIG. 5C is a view showing the workpiece W as viewed from a direction indicated by arrow B in FIG. 5A. As can be seen from FIG. 5A through FIG. 5C, the workpiece W, to be polished, has a three-dimensional surface configuration comprising planar surfaces and curved surfaces. Specifically, the surface of the workpiece W is constituted by a flat bottom surface F, a first curved surface R1 and a second curved surface R2 connected respectively to a long side and a short side of the bottom surface F, a corner curved surface R3 located between the first curved surface R1 and the second curved surface R2, a first slope S1 connected to the first curved surface R1, a second slope S2 connected to the second curved surface R2, and a corner slope S3 located between the first slope S1 and the second slope S2. Since the workpiece W has the three-dimensional surface configuration, the polishing pad 3 is configured to allow the workpiece W to sink down greatly into the polishing pad 3 in order to polish the three-dimensional workpiece W.

Figure 6:
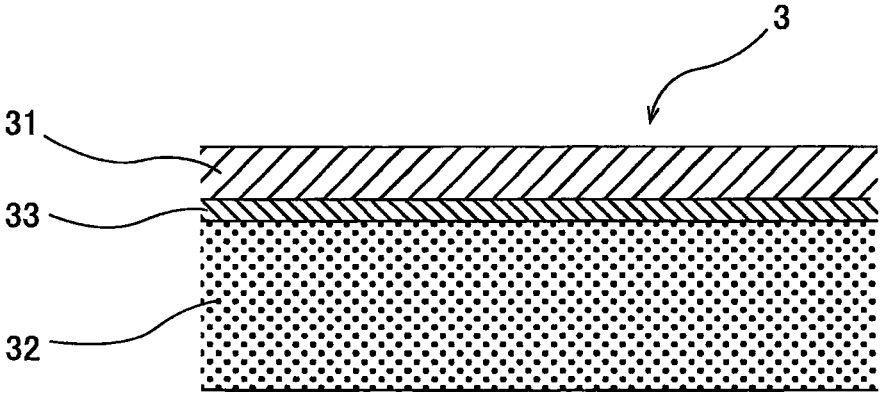
FIG. 6 is a cross-sectional view of a polishing pad.

FIG. 6 is a cross-sectional view of the polishing pad 3. The polishing pad 3 is a multilayer polishing pad including an elastic pad 31 having the polishing surface, a deformable base layer 32 that supports the elastic pad 31, and an adhesive layer 33 that joins the base layer 32 and the elastic pad 31 to each other. The adhesive layer 33 is thinner than the elastic pad 31, and the base layer 32 is thicker than the elastic pad 31. For example, the elastic pad 31 has a thickness in a range of 0.4 mm to 0.6 mm, the adhesive layer 33 has a thickness in a range of 0.1 mm to 0.2 mm, and the base layer 32 has a thickness of about 10 mm. The thickness of the base layer 32 is preferably at least three times the thickness of the elastic pad 31, and more preferably at least ten times the thickness of the elastic pad 31.

The elastic pad 31 is a pad for holding the polishing liquid thereon and is made of material that does not permit the polishing liquid to penetrate therethrough. Specifically, the elastic pad 31 is made of foamed polyester. The upper surface of the elastic pad 31 constitutes the planar polishing surface that is used for polishing the surface of the workpiece W. The elastic pad 31 has a high elasticity so that the workpiece W sinks into the polishing pad 3 sufficiently when the workpiece W is pressed against the polishing pad 3. More specifically, the elastic pad 31 is configured to expand at least 10% of its original size when the workpiece W is pressed against the polishing pad 3.

The base layer 32 is made of a soft material (e.g., polyurethane sponge) so that the elastic pad 31 can be deformed freely along the surface configuration of the workpiece W. The base layer 32 is softer than the elastic pad 31. The base layer 32 has an elasticity, but may not be required to have a higher elasticity than that of the elastic pad 31. The adhesive layer 33 has a characteristic that can maintain its soft state and has a high elasticity, in order not to prevent the deformation of the elastic pad 31 and the base layer 32. In particular, the adhesive layer 33 preferably has a higher elasticity than that of the elastic pad 31. For example, the adhesive layer 33 is formed by acrylic adhesive material.

The elastic pad 31, the adhesive layer 33, and the base layer 32 are made of materials that can be deformed elastically. Therefore, the polishing pad 3 in its entirety can also be deformed elastically and has a high resilience. Specifically, when the workpiece W is pressed against the polishing pad 3, the polishing surface (i.e., the upper surface) of the polishing pad 3 changes its shape along the surface configuration of the workpiece W. On the other hand, when the workpiece W is moved away from the polishing pad 3, the polishing surface of the polishing pad 3 is recovered to its original shape, i.e., the flat shape. Accordingly, when the workpiece W is polished while being pressed against the rotating polishing pad 3, the shape of the rotating polishing pad 3 is changed along the portion, to be polished, of the workpiece W. That is, the workpiece W can be polished while the pad contact portion of the workpiece W is moved and the polishing pad 3 changes its shape so as to follow the curved surface of the portion of the workpiece W. Further, it is also possible to prevent the polishing liquid from remaining on a pad portion that has been deformed by the contact with the workpiece W. As a result, a fresh polishing liquid can always be supplied onto the polishing pad 3 (i.e., the contact portion between the workpiece W and the polishing pad 3).

Several types of carriers 1 are prepared for surfaces to be polished. The carrier 1 shown in FIG. 3A through FIG. 3C is one for polishing mainly the second curved surface R2 of the workpiece W. More specifically, the mounting base 12 of the carrier 1 is disposed obliquely such that the second curved surface R2 of the workpiece W contacts the polishing pad 3. The workpiece W, which is secured to the oblique mounting base 12, is inclined obliquely with respect to the polishing surface, so that the second curved surface R2 contacts the polishing surface.

Figure 7:
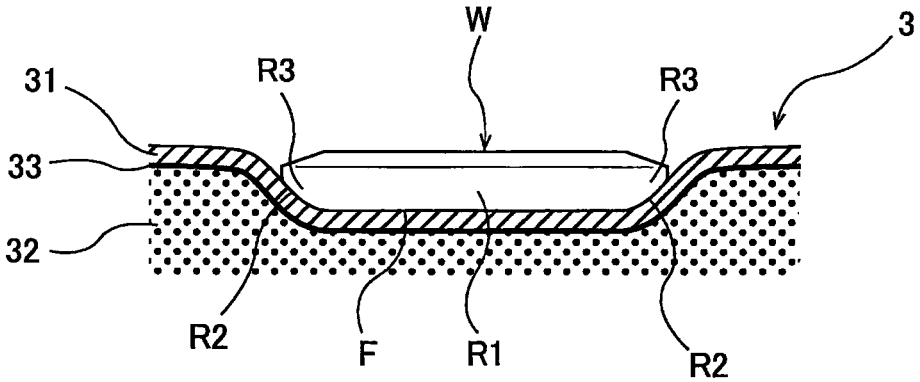
FIG. 7 is a view illustrating a state in which a bottom surface of the workpiece is polished.

FIG. 7 is a view illustrating a state in which the bottom surface F of the workpiece W is polished. As shown in FIG. 7, the bottom surface F of the workpiece W sinks into the polishing pad 3, and as a result the polishing surface of the polishing pad 3 changes its shape along the bottom surface F, the first and second curved surfaces R1 and R2, and the corner curved surface R3. Consequently, the polishing surface contacts the bottom surface F in its entirety and most part of the curved surfaces R1 and R2 and the corner curved surface R3 to polish these contact portions to a mirror finish.

Figure 8:
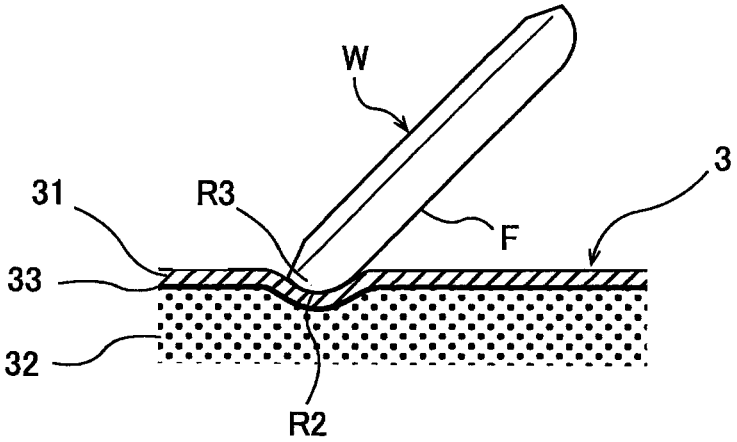
FIG. 8 is a view illustrating a state in which a second curved surface of the workpiece is polished.

FIG. 8 is a view illustrating a state in which the second curved surface R2 of the workpiece W is polished. As shown in FIG. 8, the second curved surface R2 of the workpiece W sinks into the polishing pad 3, and as a result the polishing surface of the polishing pad 3 is deformed along the second curved surface R2 and the corner curved surface R3. Consequently, the polishing surface contacts the second curved surface R2 in its entirety, most part of the corner curved surface R3, and a part of the bottom surface F to polish these contact portions to a mirror finish.

As shown in FIG. 8, the second curved surface R2 has a convex shape as viewed from its lateral direction. The entire second curved surface R2 having such a convex shape contacts the polishing surface of the polishing pad 3. A hardness of the polishing pad 3 is such that an entire curved surface, to be polished, contacts the polishing surface of the polishing pad 3 when the workpiece W is pressed against the polishing pad 3. Specifically, an amount of the workpiece W sinking into the polishing pad 3 when being polished is preferably at least three times a height of the curved surface having the convex shape. For example, when the curved surface with a height of 1.3 mm is pressed against the polishing pad 3 at a polishing pressure of 380 gf/cm$^2$, the workpiece W preferably sinks into the polishing pad 3 by 5 mm or more. The use of such soft and deformable polishing pad 3 can achieve the mirror-finished three-dimensional surface of the workpiece W.

Although not shown in the drawings, the first curved surface R1 of the workpiece W is polished in the same manner as shown in FIG. 8. As can be seen from FIG. 7 and FIG. 8, the soft polishing pad 3 contacts the corner curved surface R3 when polishing the bottom surface F, the first curved surface R1, and the second curved surface R2. Therefore, the corner curved surface R3 is polished simultaneously with the bottom surface F, the first curved surface R1, and the second curved surface R2. Accordingly, it is not necessary to press only the corner curved surface R3 against the polishing pad 3 for polishing it.

The workpiece W emits heat due to the sliding contact with the polishing pad 3. The polishing liquid, flowing on the polishing pad 3, removes the heat from the workpiece W to prevent a thermal expansion of the workpiece W. Therefore, the CMP apparatus can polish the bottom surface F of the workpiece W to a flat and mirror finish.

Figure 9:
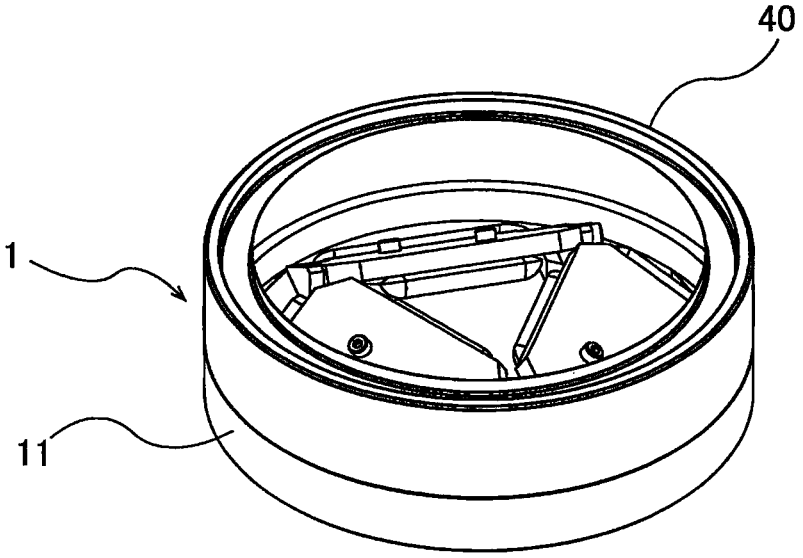
FIG. 9 is a view showing a weight placed on the carrier.

The polishing pressure acting on the polishing pad 3 is determined from the self-weight of the workpieces W and the carrier 1. In order to control the polishing pressure, a weight 40 may be provided on the ring 11 of the carrier 1 as shown in FIG. 9. Several weights having different sizes corresponding to different polishing pressures may be prepared.

Figure 10A:
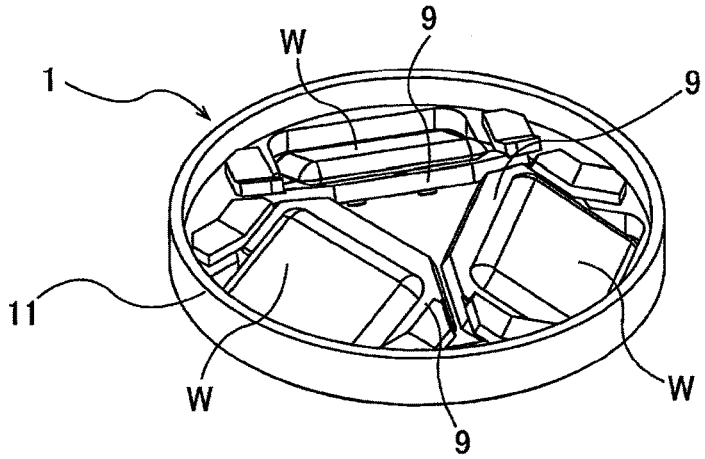
FIG. 10A is a perspective view of the carrier for polishing a first slope of the workpiece.
Figure 10B:
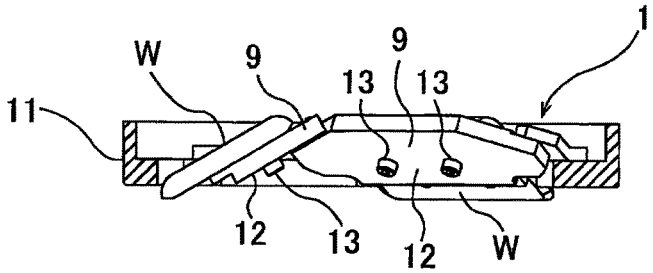
FIG. 10B is a vertical cross-sectional view of the carrier shown in FIG. 10A.
Figure 10C:
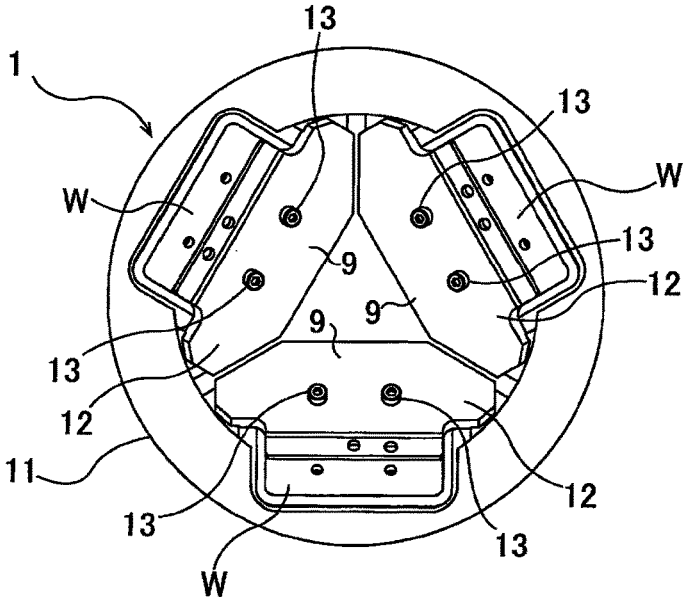
FIG. 10C is a bottom view of the carrier shown in FIG. 10A.

FIG. 10A through FIG. 10C are views of the carrier 1 for polishing the first slope S1 of the workpiece W. In this carrier 1, the mounting base 12 of the workpiece holder 9 is arranged such that the first slope S1 of the workpiece W projects from the bottom of the carrier 1. Other structures are the same as those of the carrier 1 shown in FIG. 3A and FIG. 3B.

Figure 11A:
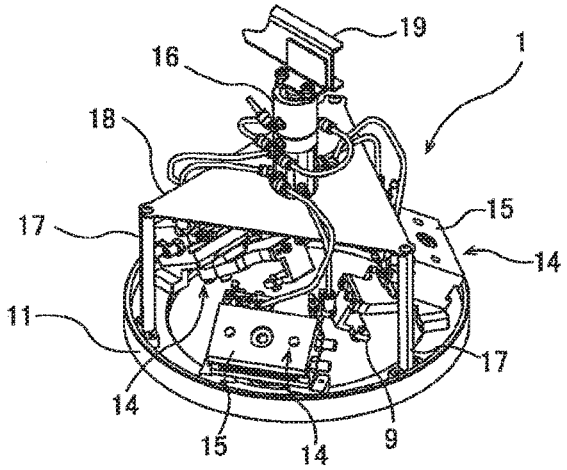
FIG. 11A is a perspective view of the carrier for polishing a corner slope of the workpiece.
Figure 11B:
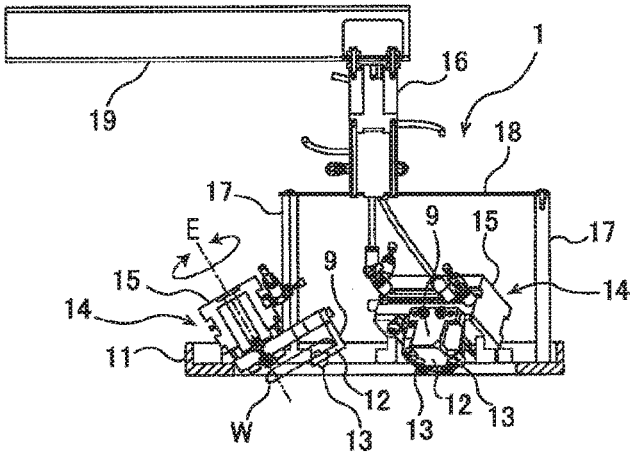
FIG. 11B is a vertical cross-sectional view of the carrier shown in FIG. 11A.
Figure 11C:
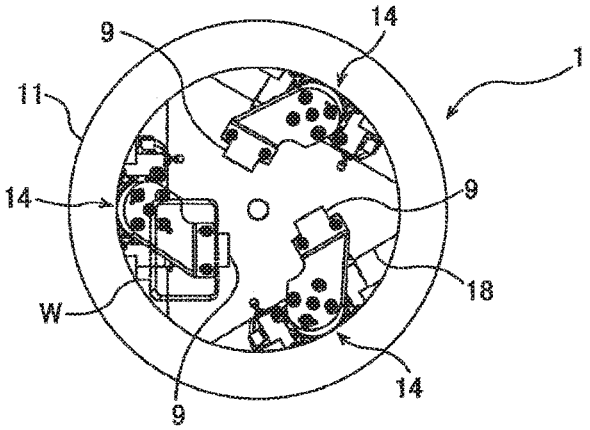
FIG. 11C is a bottom view of the carrier shown in FIG. 11A.

FIG. 11A through FIG. 11C are views of the carrier 1 for polishing the corner slope S3 of the workpiece W. This type of carrier 1 has pivot mechanisms 14 each configured to cause the workpiece W to pivot about the corner slope S3 that is a surface to be polished. Each pivot mechanism 14 includes workpiece holder 9 having mounting base 12 arranged obliquely, and a rotary actuator 15 configured to rotate the workpiece holder 9 in a clockwise direction and a counterclockwise direction alternately through a predetermined angle (i.e., so that the workpiece holder 9 pivots). In this embodiment shown in FIG. 11A through FIG. 11C, three pivot mechanisms 14 are provided and are secured to the upper surface of the ring 11. However, the number of pivot mechanisms 14 is not limited to this embodiment. For example, the carrier 1 may have one pivot mechanism 14 or more than three pivot mechanisms 14.

The workpiece W is removably attached to the mounting base 12 by mounting tools 13. As shown in FIG. 11B, a pivot axis (represented by a symbol E) of the rotary actuator 15 extends near the corner slope S3 to be polished. Therefore, the workpiece W revolves (or pivots) about the pivot axis E extending near the corner slope S3. The pivot axis E may extend through the corner slope S3. The rotary actuator 15 may be a pneumatic cylinder operated by a gas (e.g., air). The rotary actuator 15 is coupled to a gas supply unit (not shown) via a rotary joint 16. A rotating part of the rotary joint 16 is secured to an installation plate 18 supported by pillars 17, while a stationary part of the rotary joint 16 is secured to a static arm 19 located above the polishing pad 3.

During polishing of the corner slope S3, the workpiece W pivots about the pivot axis E extending near the corner slope S3, while the workpiece W is rotated together with the carrier 1 by the rollers 20 and 20 (see FIG. 1). The carrier 1 of this type shown in FIGS. 11A through 11C may be combined with a typical polishing pad for performing chemical mechanical polishing of a wafer, other than the polishing pad 3 shown in FIG. 6.

Other than the above-discussed types of carriers, several types of carriers are prepared for polishing the bottom surface F, the second slope S2, and the first curved surface R1 of the workpiece W in order to polish the workpiece W in its entirety. In this manner, various types of carriers are prepared and used in accordance with the configuration of the surface to be polished.

Polishing of the workpiece W may be divided into a rough polishing process and a finish polishing process. The rough polishing process and the finish polishing process use the same types of carriers 1, but use different polishing pads. Specifically, the rough polishing process uses a polishing pad having a hard elastic pad with a large surface roughness, while the finish polishing process uses a polishing pad having a soft elastic pad with a small surface roughness.

Figure 12:
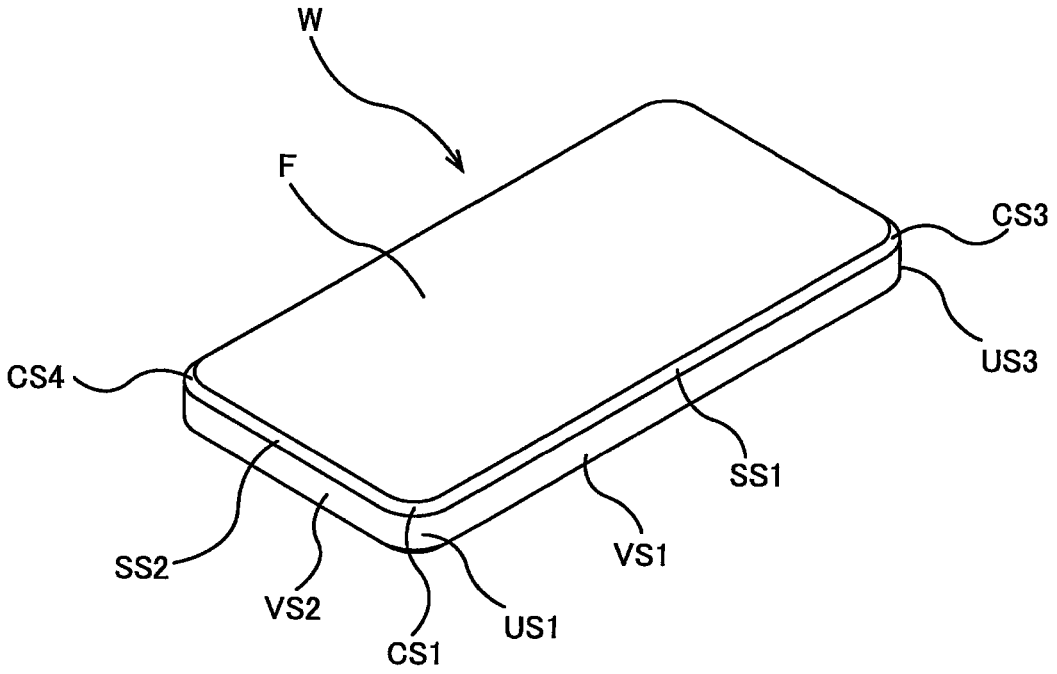
FIG. 12 is a perspective view showing another example of the workpiece.
Figure 13A:
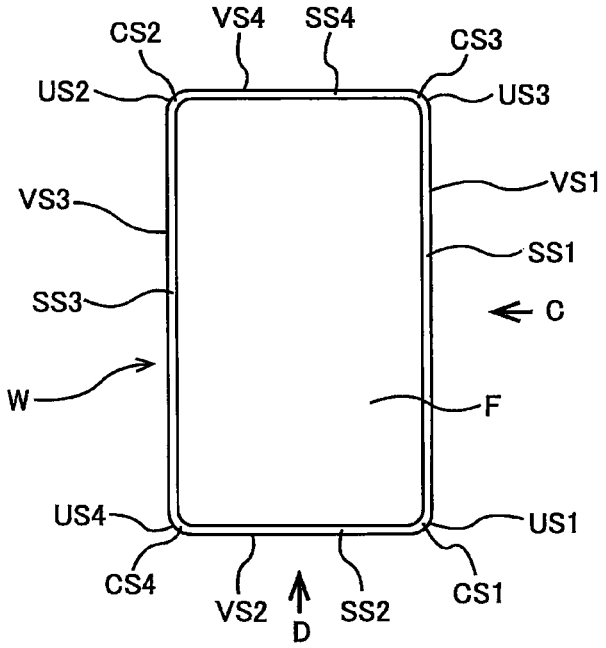
FIG. 13A is a bottom view of the workpiece depicted in FIG. 12.
Figure 13B:
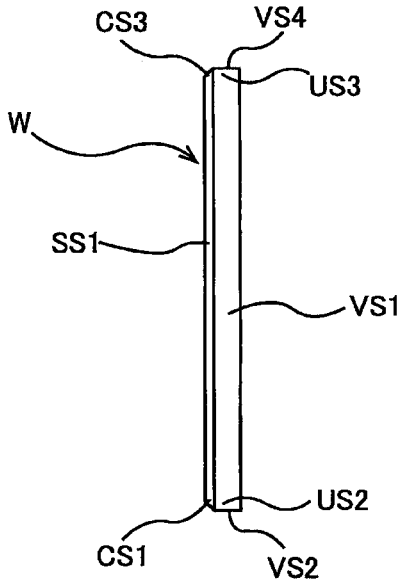
FIG. 13B is a view of the workpiece as viewed from a direction indicated by arrow C in FIG. 13A.
Figure 13C:
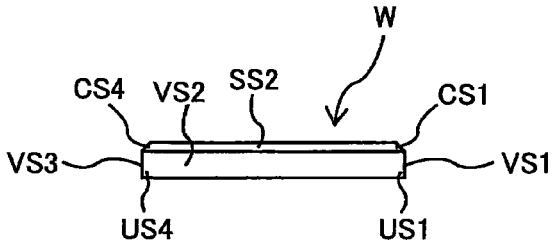
FIG. 13C is a view of the workpiece as viewed from a direction indicated by arrow D in FIG. 13A.

FIG. 12 is a perspective view showing another example of the workpiece W, FIG. 13A is a bottom view of the workpiece W depicted in FIG. 12, FIG. 13B is a view of the workpiece W as viewed from a direction indicated by arrow C in FIG. 13A, and FIG. 13C is a view of the workpiece W as viewed from a direction indicated by arrow D in FIG. 13A.

The workpiece W shown in FIG. 12 and FIGS. 13A through 13C has a bottom surface F, a first side surface VS1, a second side surface VS2, a third side surface VS3, a fourth side surface VS4, a first curved corner surface US1 connecting the first side surface VS1 and the second side surface VS2, a second curved corner surface US2 connecting the third side surface VS3 and the fourth side surface VS4, a third curved corner surface US3 connecting the first side surface VS1 and the fourth side surface VS4, a fourth curved corner surface US4 connecting the second side surface VS2 and the third side surface VS3, a first slope SS1, a second slope SS2, a third slope SS3, a fourth slope SS4, a first curved slope CS1 connecting the first slope SS1 and the second slope SS2, a second curved slope CS2 connecting the third slope SS3 and the fourth slope SS4, a third curved slope CS3 connecting the first slope SS1 and the fourth slope SS4, and a fourth curved slope CS4 connecting the second slope SS2 and the third slope SS3.

The first slope SS1 is a slope that connects the first side surface VS1 and the long side of the bottom surface F, the second slope SS2 is a slope that connects the second side surface VS2 and the short side of the bottom surface F, the third slope SS3 is a slope that connects the third side surface VS3 and the long side of the bottom surface F, and the fourth slope SS4 is a slope that connects the fourth side surface VS4 and the short side of the bottom surface F. These slopes are inclined at an angle of 45 degrees. The first to fourth slopes SS1 to SS4 and the first to fourth curved slopes CS1 to CS4 are bevels (or chamfers) extending in the circumferential direction of the workpiece W.

Figure 14A:
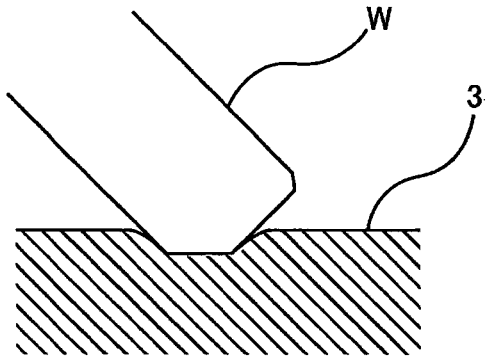
FIG. 14A through FIG. 14C are views illustrating a rounded edge of the workpiece.
Figure 14B:
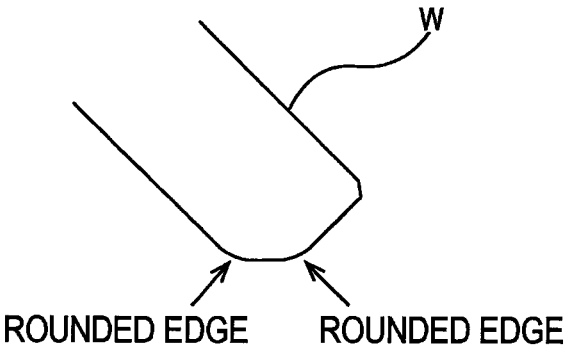

From the viewpoint of design, some types of workpieces may be required to be polished such that a so-called rounded edge does not occur. The rounded edge is a phenomenon in which an edge of a polished surface is rounded. FIG. 14A and FIG. 14B illustrate how the rounded edge occurs. During polishing of the workpiece W, the workpiece W is pressed against the polishing pad 3 while the workpiece W and the polishing pad 3 are moved relative to each other. However, since the polishing pad 3 is soft, the surface of the workpiece W sinks down on the polishing pad 3 as shown in FIG. 14A. As a result, the edge of the polished surface is rounded as shown in FIG. 14B.

Figure 14C:
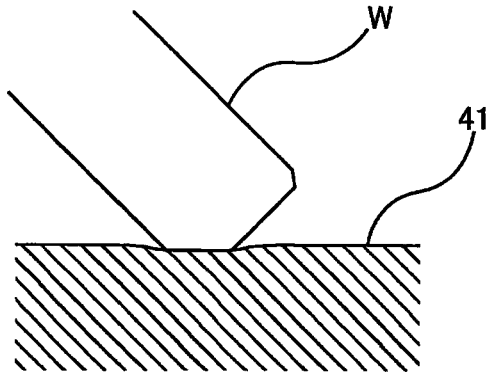

As shown in FIG. 7 and FIG. 8, it is rather preferable to use the soft polishing pad 3 as shown in FIG. 6 when polishing a round surface. However, when polishing the workpiece W as shown in FIG. 12, it is not preferable to cause the rounded edge. Thus, when polishing the workpiece W as shown in FIG. 12, a hard polishing pad 41 shown in FIG. 14C is used.

Figure 15:
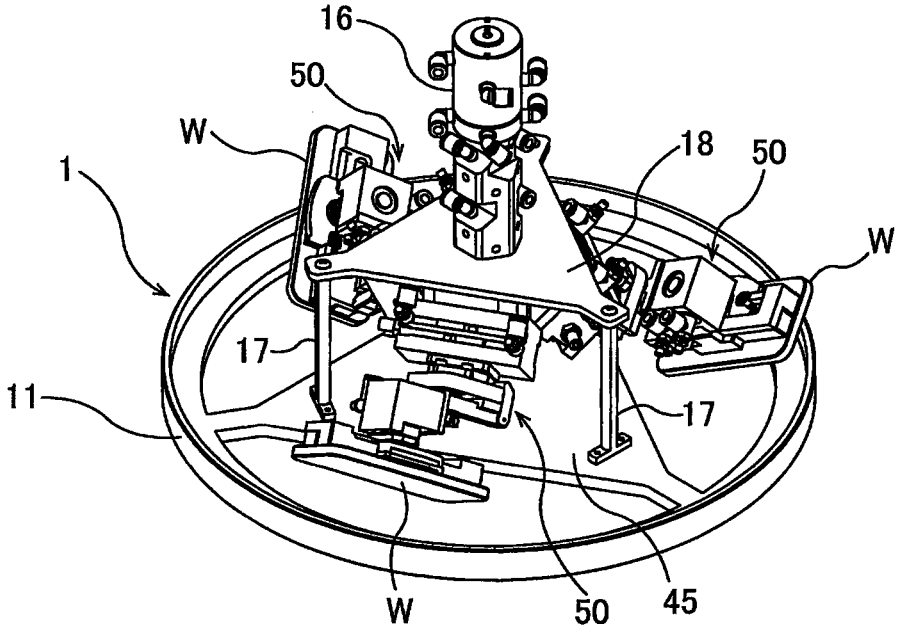
FIG. 15 is a perspective view of the carrier suitable for use in polishing of the workpiece shown in FIG. 12 and FIG. 13A through FIG. 13C.
Figure 16:
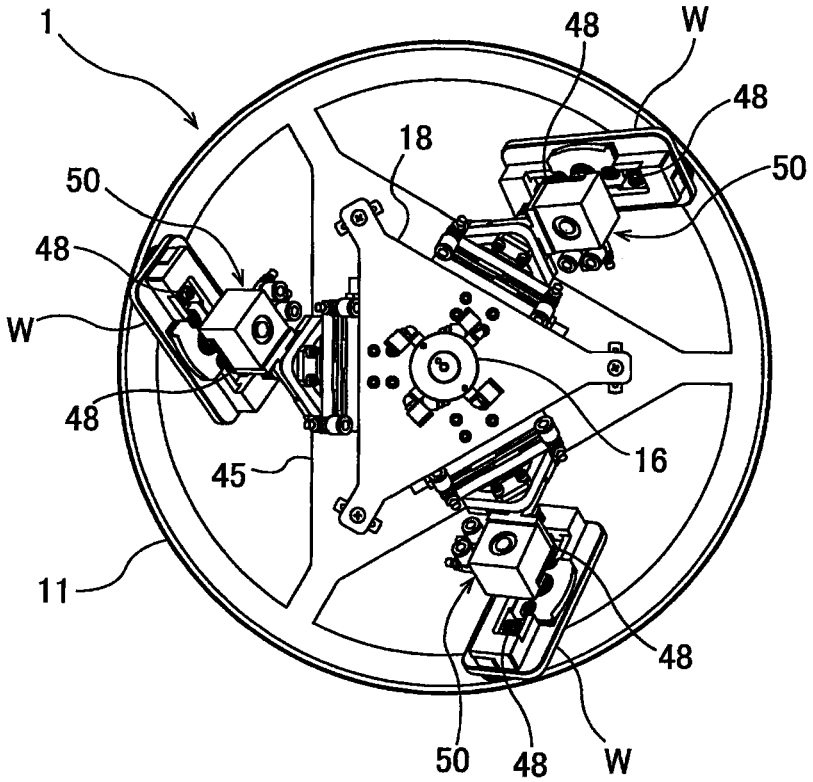
FIG. 16 is a plan view of the carrier shown in FIG. 15.

FIG. 15 is a perspective view of the carrier 1 suitable for use in polishing of the workpiece W shown in FIG. 12 and FIG. 13A through FIG. 13C. FIG. 16 is a plan view of the carrier 1 shown in FIG. 15. Structures of the carrier 1, which will not be particularly discussed, are identical to those of the above-discussed carrier. Identical elements are denoted by the same reference numerals and their duplicative explanations are omitted. The structures of the CMP apparatus, other than the polishing pad and the carrier, are the same as the structures shown in FIG. 1 or FIG. 2.

A triangular bottom plate 45 is connected to the ring 11. This bottom plate 45 is located radially inwardly of the ring 11 and formed integrally with the ring 11. A bottom surface of the ring 11 and a bottom surface of the bottom plate 45 lie in the same plane. A plurality of (three in this embodiment) pillars 17 are secured to an upper surface of the bottom plate 45, and the installation plate 18 are supported horizontally by these pillars 17. The carrier 1 has pivot mechanisms 50 each configured to rotate the workpiece W in the clockwise direction and the counterclockwise direction alternately (i.e., cause the workpiece W to pivot). In the drawings, the carrier 1 has three pivot mechanisms 50. It is noted that one pivot mechanism 50 may be provided or four or more pivot mechanisms 50 may be provided.

Figure 17:
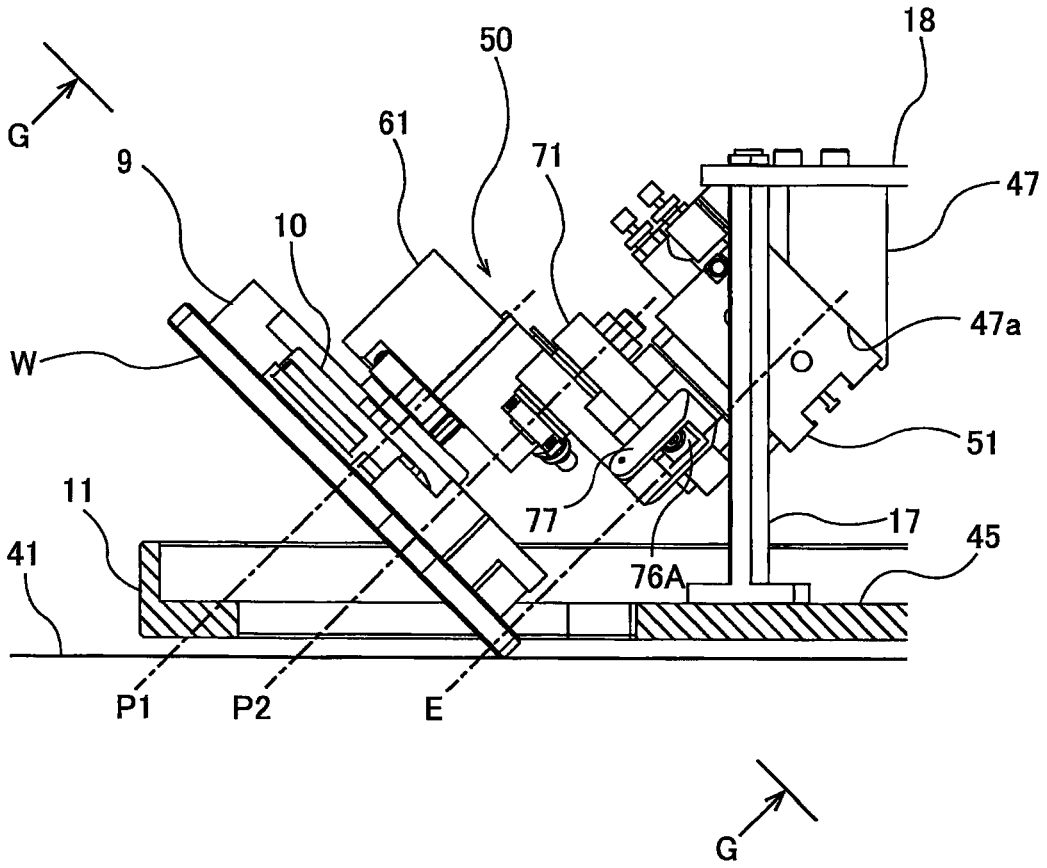
FIG. 17 is a side view of a pivot mechanism.

FIG. 17 is a side view of the pivot mechanism 50. As shown in FIG. 17, the pivot mechanism 50 includes workpiece holder 9 configured to hold the workpiece W, a rotary actuator 51 configured to cause the workpiece holder 9 to pivot about a predetermined pivot axis through a predetermined angle with the workpiece W in contact with the polishing pad 41, and a first rotary coupling 61 and a second rotary coupling 71 configured to couple the workpiece holder 9 and the rotary actuator 51. The pivot mechanism 50 is removably secured to an attachment 47 which is fixed to a lower surface of the installation plate 18.

The pivot mechanism 50 is inclined at a predetermined angle with respect to the vertical direction (i.e., a direction perpendicular to the polishing surface of the polishing pad 41) when viewed from the lateral direction of the pivot mechanism 50. This predetermined angle is set in accordance with an inclination angle of the surface, to be polished, of the workpiece W. For example, in the case where the surface, to be polished, of the workpiece W is the slopes SS1 to SS4 and the curved slopes CS1 to CS4, the inclination angle of the pivot mechanism 50 is set to 45 degrees. If the slopes SS1 to SS4 and the curved slopes CS1 to CS4, to be polished, are inclined at an angle of 30 degrees, the inclination angle of the pivot mechanism 50 is set to 30 degrees. Further, when the side surfaces VS1 to VS4 and the curved corner surfaces US1 to US4 are polished, the inclination angle of the pivot mechanism 50 is set to 90 degrees. The inclination angle of the pivot mechanism 50 depends on an angle of an installation surface 47*a* of the attachment 47. Therefore, the angle of the pivot mechanism 50 in its entirety can be changed by replacing the attachment 47 to another one that has an installation surface inclined at a different angle.

The rotary actuator 51, the second rotary coupling 71, the first rotary coupling 61, and the workpiece holder 9 are coupled in series in this order. The workpiece holder 9 has clamp 10 configured to hold a plurality of screws 48 (see FIG. 16) which are secured to the workpiece W. This clamp 10 is able to hold and release the workpiece W through the screws 48.

The rotary actuator 51 is removably secured to the attachment 47 by fasteners, such as screws (not shown). This rotary actuator 51 is a pneumatic cylinder that is operated by a gas (e.g., air). The rotary actuator 51 is coupled to the gas supply unit (not shown) via the rotary joint 16. The rotary actuator 51 is configured to rotate the second rotary coupling 71, the first rotary coupling 61, the workpiece holder 9, and the workpiece W in unison about a predetermined pivot axis E in the clockwise direction and the counterclockwise direction alternately through a predetermined angle (i.e., cause these elements to pivot). The pivot axis E is a virtual rotation axis extending through a center of curvature of the first curved slope CS1 of the workpiece W. The pivot axis E may not necessarily extend through the center of curvature of the first curved slope CS1 of the workpiece W, and may extend near the center of curvature of the first curved slope CS1.

When polishing the first curved slope CS1, the rotary actuator 51 causes the workpiece W to pivot through the predetermined angle with the first curved slope CS1 in contact with the polishing pad 41. This pivoting motion can bring the first curved slope CS1 in its entirety into sliding contact with the surface (i.e., the polishing surface) of the polishing pad 41. The pivoting angle (or the rotation angle) of the workpiece W is 90 degrees which is an angle between the first slope SS1 and the second slope SS2 of the workpiece. This pivoting angle is determined in accordance with the configuration of the workpiece W.

Figure 18:
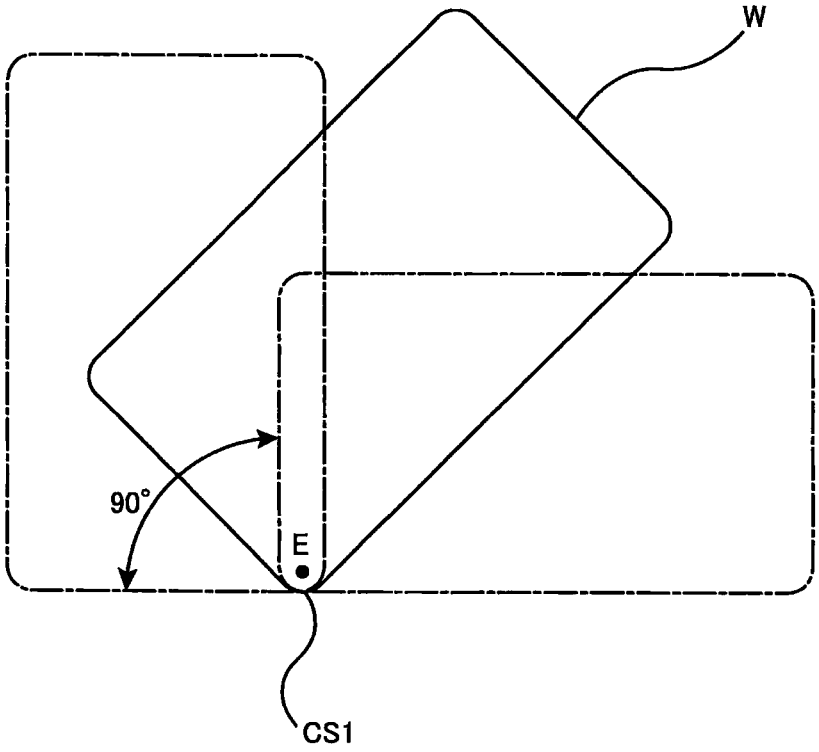
FIG. 18 is a view of the workpiece as viewed from a pivot axis of a rotary actuator when a first curved slope is being polished.

FIG. 18 is a view of the workpiece W as viewed from the pivot axis of the rotary actuator 51 when the first curved slope CS1 is being polished. As shown in FIG. 18, the workpiece W pivots about the pivot axis E by 90 degrees. As shown in FIG. 1, while the workpiece W pivots, the carrier 1 and the polishing pad 41 (the soft polishing pad 3 shown in FIG. 1 is replaced with the hard polishing pad 41) are rotated, so that the first curved slope CS1 is polished by the sliding contact with the polishing pad 41 in the presence of the polishing liquid.

Next, the first rotary coupling 61 will be described. This first rotary coupling 61 is a device for changing (switching) an angle of the workpiece holder 9 relative to the rotary actuator 51, and is provided for the purpose of switching the surface, to be polished, of the workpiece W to another surface. The first rotary coupling 61 is configured to rotate the workpiece holder 9 about the center of the workpiece W by 180 degrees. More specifically, the first rotary coupling 61 is configured to rotate the workpiece holder 9, together with the workpiece W, about the center of the workpiece W by 180 degrees and to hold the relative angle of the rotated workpiece holder 9 with respect to the first rotary coupling 61. Therefore, the first rotary coupling 61 can switch the relative angle of the workpiece holder 9 with respect to the rotary actuator 51 and the second rotary coupling 71.

The first rotary coupling 61 is a rotary actuator which may be constituted by a pneumatic cylinder operated by a gas (e.g., air). The first rotary coupling 61 is coupled to the gas supply unit (not shown) via the rotary joint 16. A rotation axis P1 of the first rotary coupling 61 (which will be referred to as a first rotation axis P1) is parallel to the pivot axis E and extends through the center of the workpiece W held by the workpiece holder 9. After the first curved slope CS1 of the workpiece W is polished, the first rotary coupling 61 rotates the workpiece W about its center by 180 degrees, so that the second curved slope CS2, which is located at a symmetric position of the first curved slope CS1, can be polished with the polishing pad 41.

The second rotary coupling 71 is also a device for changing (switching) a relative angle of the workpiece holder 9 with respect to the rotary actuator 51, and is provided for the purpose of switching the surface, to be polished, of the workpiece W to another surface. As can be seen from FIG. 18, since the pivot axis E of the rotary actuator 51 extends near the first curved slope CS1, it is not possible to polish the fourth curved slope CS4 adjacent to the first curved slope CS1. Thus, the second rotary coupling 71 permits the angle of the workpiece holder 9 to change relative to the rotary actuator 51, so that the fourth curved slope CS4 can contact the polishing pad 41.

Figure 19:
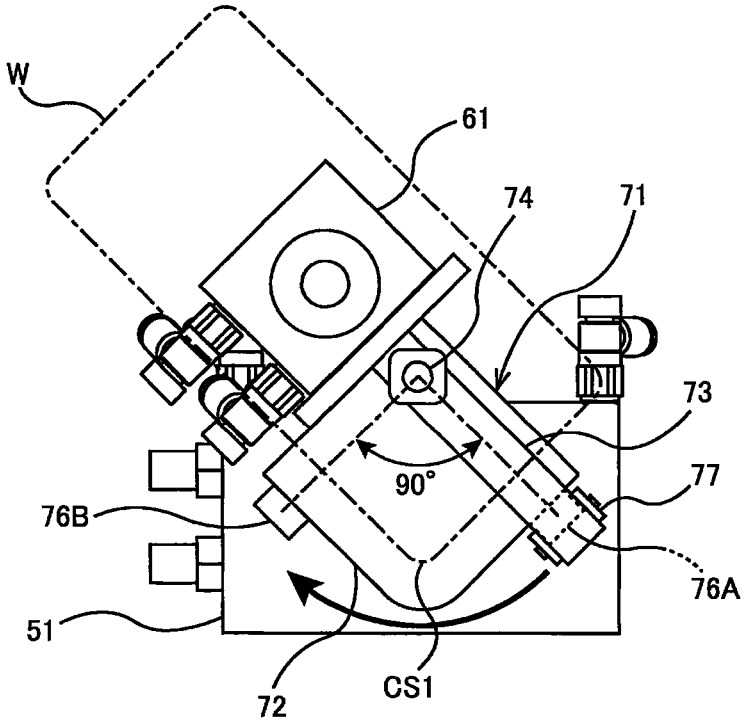
FIG. 19 is a schematic view of a second rotary coupling as viewed from line G-G shown in FIG. 17.

FIG. 19 is a schematic view of the second rotary coupling 71 as viewed from line G-G shown in FIG. 17. The second rotary coupling 71 includes a stationary base 72 secured to the rotary actuator 51, a rotary member 73 to which the first rotary coupling 61 is secured, and a support shaft 74 secured to the stationary base 72 and rotatably supporting the rotary member 73. The rotary member 73 and the first rotary coupling 61 are rotatable in unison about the support shaft 74.

Two stoppers 76A and 76B are secured to the stationary base 72. An angle between a line connecting a center of the support shaft 74 and one of the two stoppers 76A and 76B and a line connecting the center of the support shaft 74 and the other one of the two stoppers 76A and 76B is 90 degrees. A lever 77, which is an engagement member that engages the stoppers 76A and 76B, is attached to the rotary member 73. This lever 77 is configured to engage one of the two stoppers 76A and 76B to thereby fix a relative angle (or a relative position) of the rotary member 73 with respect to the stationary base 72.

Figure 20:
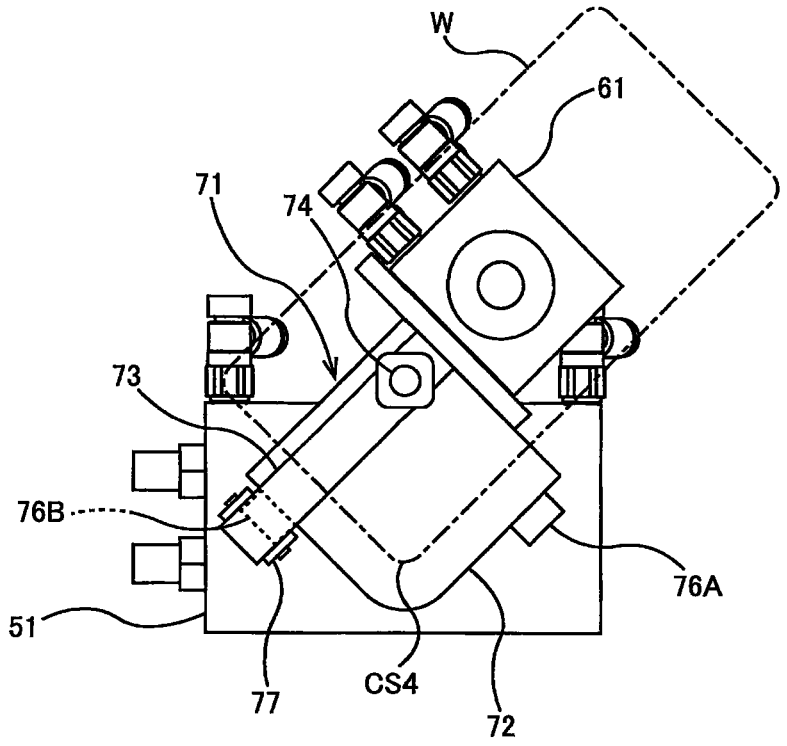
FIG. 20 is a view showing the second rotary coupling when a rotary member and a first rotary coupling shown in FIG. 19 are rotated by 90 degrees.

FIG. 20 is a view showing the second rotary coupling 71 when the rotary member 73 and the first rotary coupling 61 shown in FIG. 19 are rotated by 90 degrees. When the lever 77 is disengaged from the stopper 76A, the rotary member 73 is in a freely-rotatable state around the support shaft 74. In this state, the rotary member 73 is rotated, and the lever 77 is engaged with the other stopper 76B to fix the relative angle of the rotary member 73 with respect to the stationary base 72. Since the first rotary coupling 61 is secured to the rotary member 73 and the workpiece holder 9 is coupled to the first rotary coupling 61, the workpiece holder 9 and the first rotary coupling 61 are rotated together with the rotary member 73. In this manner, the second rotary coupling 71 can switch the relative angle of the first rotary coupling 61 and the workpiece holder 9 with respect to the rotary actuator 51. This operation of the second rotary coupling 71 is performed manually. Instead, switching of the relative angle may be performed automatically using a pneumatic cylinder as the second rotary coupling 71, like the first rotary coupling 61.

The second rotary coupling 71 is configured to allow the first rotary coupling 61 and the workpiece holder 9 to rotate about the support shaft 74 by 90 degrees and is capable of holding the relative angle of the rotated first rotary coupling 61 and the rotated workpiece holder 9 with respect to the rotary actuator 51. A central axis of the support shaft 74

(which will be referred to as a second rotation axis P2) is parallel to the pivot axis E and the first rotation axis P1 and extends through the interior of the workpiece W held by the workpiece holder 9. The second rotation axis P2 in the workpiece W is located at the same distance from the first side surface VS1, the second side surface VS2, and the third side surface VS3 of the workpiece W. Therefore, by rotating the workpiece W about the second rotation axis P2 by 90 degrees, the fourth curved slope CS4 faces the polishing pad 41, as shown in FIG. 20. As a result, the fourth curved slope CS4 can be polished with the polishing pad 41.

Figure 21A:
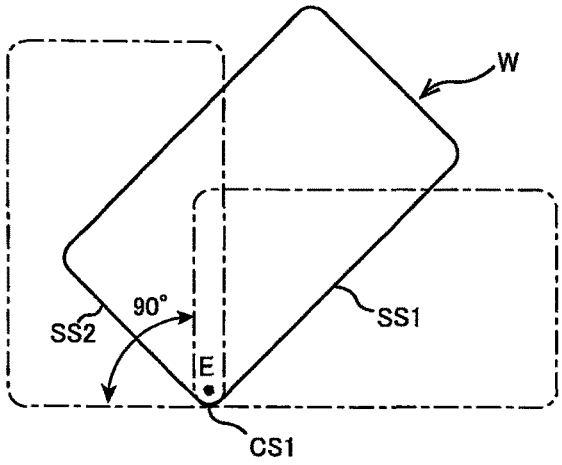
FIG. 21A through FIG. 21C are views illustrating a process of polishing the workpiece.
Figure 21B:
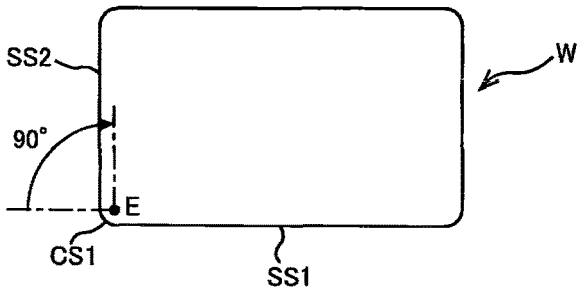
Figure 21C:
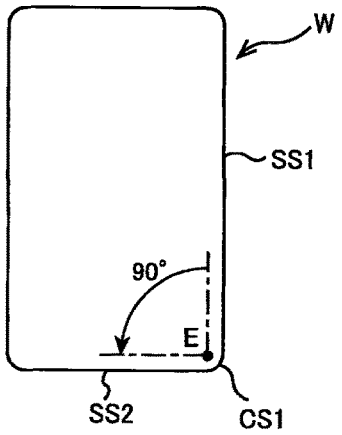

Next, a process of polishing the workpiece W shown in FIG. 12 and FIGS. 13A through 13C will be described with reference to FIG. 21A through FIG. 24D, each of which schematically shows the workpiece W as viewed from the pivot axis E of the rotary actuator 51. At step 1, as shown in FIG. 21A, the rotary actuator 51 causes the workpiece W to pivot, with the first curved slope CS1 in contact with the polishing pad 41, to thereby bring the first curved slope CS1 in its entirety into contact with the polishing pad 41. This pivoting motion of the workpiece W is the rotation of the workpiece W about the pivot axis E in the clockwise direction and the counterclockwise direction alternately through 90 degrees. As a result of such pivoting motion of the workpiece W, the first curved slope CS1 in its entirety can be polished to a mirror finish. At step 2, as shown in FIG. 21B, the rotary actuator 51 rotates the workpiece W to bring the first slope SS1 into contact with the polishing pad 41. In this state, the first slope SS1 is polished with the polishing pad 41. In step 3, as shown in FIG. 21C, the rotary actuator 51 rotates the workpiece W to bring the second slope SS2 into contact with the polishing pad 41. In this state, the second slope SS2 is polished with the polishing pad 41.

Figure 22A:
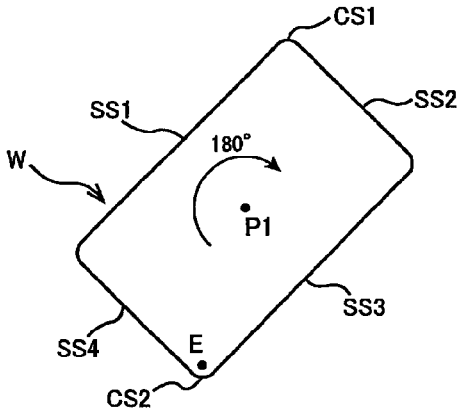
FIG. 22A through FIG. 22D are views illustrating a process of polishing the workpiece.
Figure 22B:
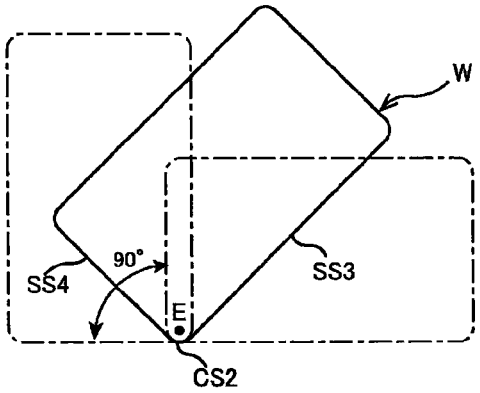
Figure 22C:
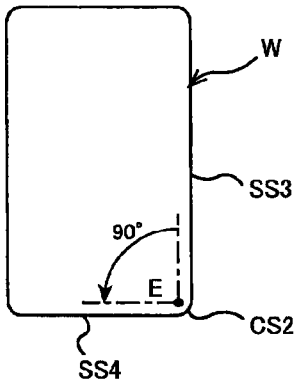
Figure 22D:
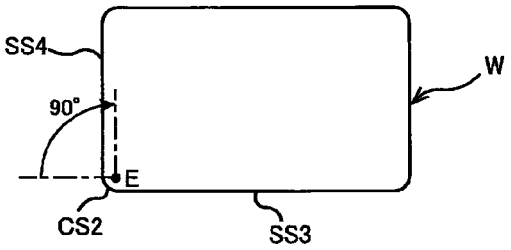

In step 4, as shown in FIG. 22A, the first rotary coupling 61 rotates the workpiece W about the first rotation axis P1 by 180 degrees to bring the second curved slope CS2 into contact with the polishing pad 41. In step 5, as shown in FIG. 22B, the rotary actuator 51 causes the workpiece W to pivot, with the second curved slope CS2 in contact with the polishing pad 41, to polish the second curved slope CS2. In step 6, as shown in FIG. 22C, the rotary actuator 51 rotates the workpiece W to bring the fourth slope SS4 into contact with the polishing pad 41. In this state, the fourth slope SS4 is polished with the polishing pad 41. In step 7, as shown in FIG. 22D, the rotary actuator 51 rotates the workpiece W to bring the third slope SS3 into contact with the polishing pad 41. In this state, the third slope SS3 is polished with the polishing pad 41.

Figure 23A:
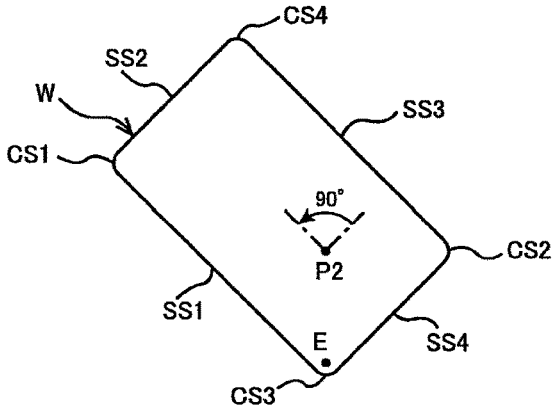
FIG. 23A through FIG. 23D are views illustrating a process of polishing the workpiece.
Figure 23B:
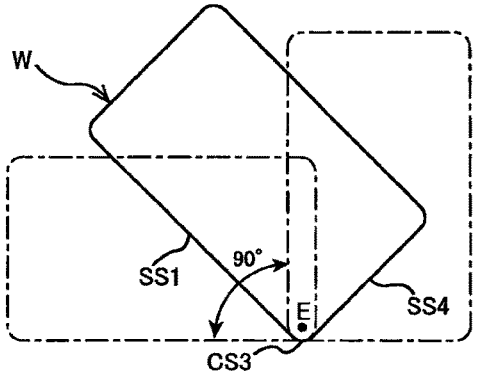
Figure 23C:
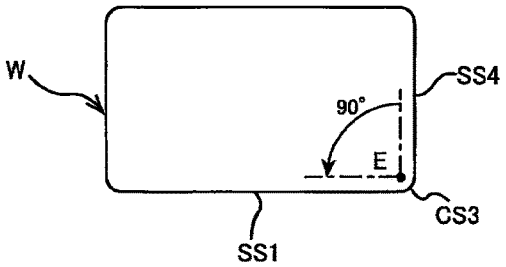
Figure 23D:
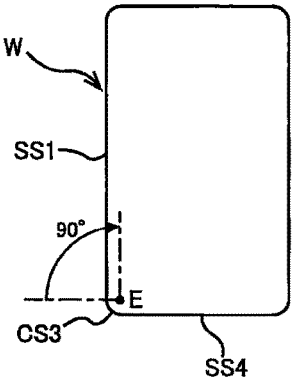

In step 8, as shown in FIG. 23A, the second rotary coupling 71 is operated until the workpiece W rotates about the second rotation axis P2 by 90 degrees to bring the third curved slope CS3 into contact with the polishing pad 41. In step 9, as shown in FIG. 23B, the rotary actuator 51 causes the workpiece W to pivot, with the third curved slope CS3 in contact with the polishing pad 41, to thereby polish the third curved slope CS3. In step 10, as shown in FIG. 23C, the rotary actuator 51 rotates the workpiece W to bring the first slope SS1 into contact with the polishing pad 41. In this state, the first slope SS1 is polished with the polishing pad 41. In step 11, as shown in FIG. 23D, the rotary actuator 51 rotates the workpiece W to bring the fourth slope SS4 into contact with the polishing pad 41. In this state, the fourth slope SS4 is polished with the polishing pad 41.

Figure 24A:
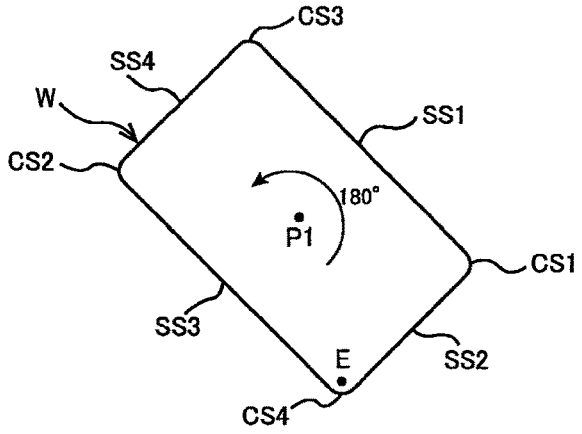
FIG. 24A through FIG. 24D are views illustrating a process of polishing the workpiece.
Figure 24B:
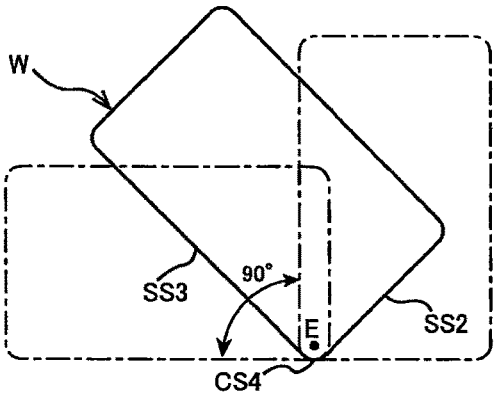
Figure 24C:
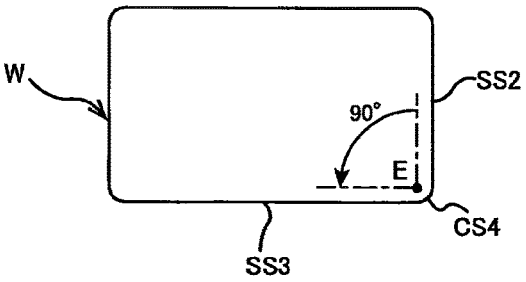
Figure 24D:
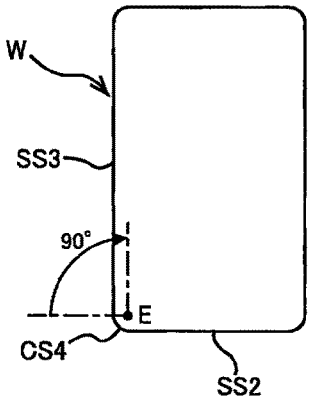

In step 12, as shown in FIG. 24A, the first rotary coupling 61 rotates the workpiece W about the first rotation axis P1 by 180 degrees to bring the fourth curved slope CS4 into contact with the polishing pad 41. In step 13, as shown in FIG. 24B, the rotary actuator 51 causes the workpiece W to pivot, with the fourth curved slope CS4 in contact with the polishing pad 41, to polish the fourth curved slope CS4. In step 14, as shown in FIG. 24C, the rotary actuator 51 rotates the workpiece W to bring the third slope SS3 into contact with the polishing pad 41. In this state, the third slope SS3 is polished with the polishing pad 41. In step 15, as shown in FIG. 24D, the rotary actuator 51 rotates the workpiece W to bring the second slope SS2 into contact with the polishing pad 41. In this state, the second slope SS2 is polished with the polishing pad 41. In this manner, all of the first slope SS1 through the fourth slope SS4 and the first curved slope CS1 through the fourth curved slope CS4 are mirror-polished successively.

Because the carrier 1 shown in FIG. 15 has three pivot mechanisms 50, three workpieces W can be polished simultaneously. The three pivot mechanisms 50 are preferably synchronized to perform the operation sequence discussed with reference to FIG. 21A to FIG. 24D. This is for the reason of polishing the three workpieces W uniformly.

Since the workpiece W shown in FIG. 12 and FIGS. 13A through 13C has a rectangular shape, it is necessary to provide two rotary couplings 61 and 71 for polishing all of the four curved slopes. If the workpiece to be polished has a square shape, one of the two rotary couplings 61 and 71 may be mitted. For example, if the first rotary coupling 61 is configured to rotate the workpiece holder 9 in an increment of 90 degrees and to hold the relative angle of the rotated workpiece holder 9 with respect to the first rotary coupling 61, then the second rotary coupling 71 may be omitted.

In order to avoid the rounded edge of the polished surface of the workpiece W, it is preferable to cover the workpiece W with a cover member along the edge of the surface to be polished. The cover member is arranged adjacent to the surface, to be polished, of the workpiece W and is brought into sliding contact with the polishing pad 41 together with the surface of the workpiece W.

Figure 25:
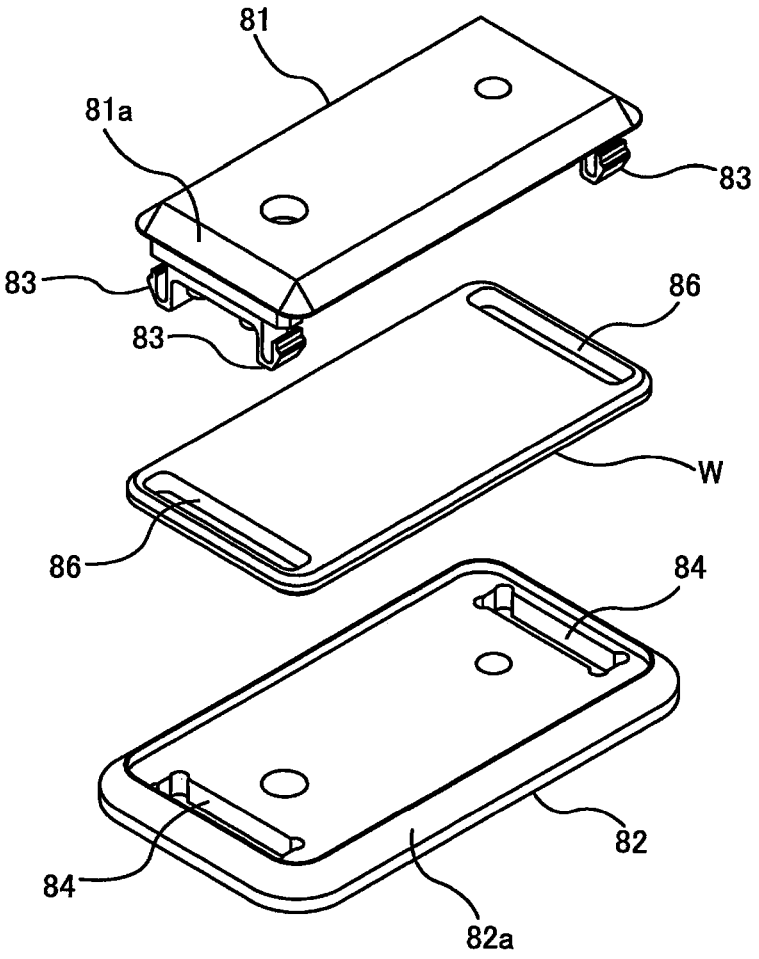
FIG. 25 is an exploded perspective view showing an example of a cover member for covering the workpiece.

FIG. 25 is an exploded perspective view showing an example of the cover member. The cover member in this example is constituted by a first cover member 81 and a second cover member 82 which are arranged so as to sandwich the workpiece W from its both sides. The workpiece W shown in FIG. 25 has basically the same shape as the workpiece shown in FIG. 12, but is different in that through-holes 86 are formed along the second slope SS2 and the fourth slope SS4 (see FIG. 13A through FIG. 13C). The first cover member 81 has hooks 83 which are inserted into these through-holes 86, and the second cover member 82 has engagement openings 84 with which the hooks 83 engage.

Figure 26:
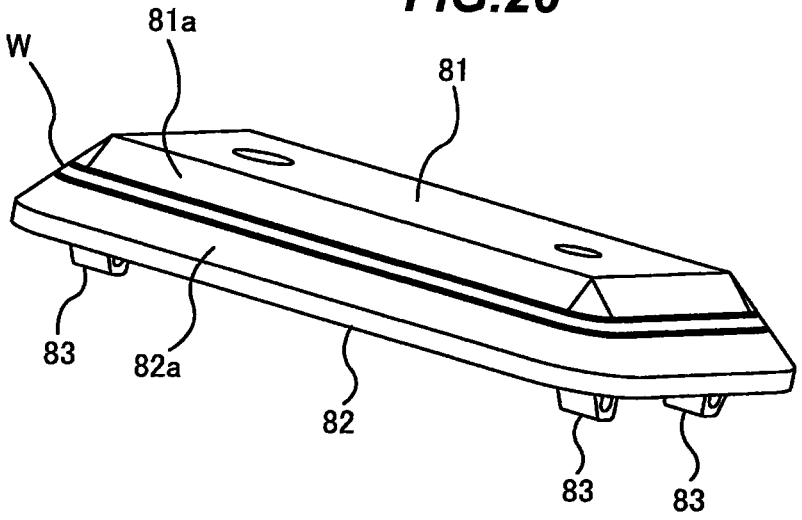
FIG. 26 is a perspective view showing a first cover member, the workpiece, and a second cover member which are assembled.
Figure 27:
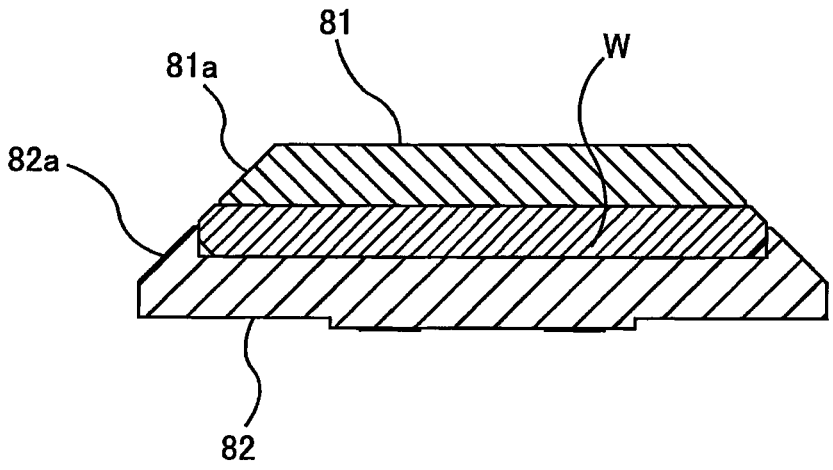
FIG. 27 is a cross-sectional view of the first cover member, the workpiece, and the second cover member shown in FIG. 26.

The hooks 83 are inserted into the through-holes 86 of the workpiece W until the hooks 83 engage with the engagement openings 84, so that the first cover member 81, the workpiece W, and the second cover member 82 are assembled integrally. FIG. 26 is a perspective view showing the first cover member 81, the workpiece W, and the second cover member 82 which are assembled, and FIG. 27 is a cross-sectional view of the first cover member 81, the workpiece W, and the second cover member 82 shown in FIG. 26. As can be seen from FIG. 26 and FIG. 27, almost entirely of the workpiece W is covered with the first cover member 81 and the second cover member 82 such that only the surface to be polished is exposed through a gap between the first cover member 81 and the second cover member 82.

As shown in FIG. 27, the first cover member 81 and the second cover member 82 have circumferential surfaces 81*a* and 82*a* which are parallel with the exposed surface (i.e., the surface to be polished) of the workpiece W. These circumferential surfaces 81*a* and 82*a* and the exposed surface of the workpiece W lie substantially in the same plane. It is preferable that the exposed surface of the workpiece W protrudes slightly (e.g., by several μm) from the circumferential surfaces 81*a* and 82*a* of the first cover member 81 and the second cover member 82. These cover members 81 and 82, which surround the workpiece W, are removably held by the above-discussed workpiece holder 9. The exposed surface of the workpiece W is mirror-polished by the sliding contact with the polishing pad 41 in the same manner as discussed above.

Figure 28:
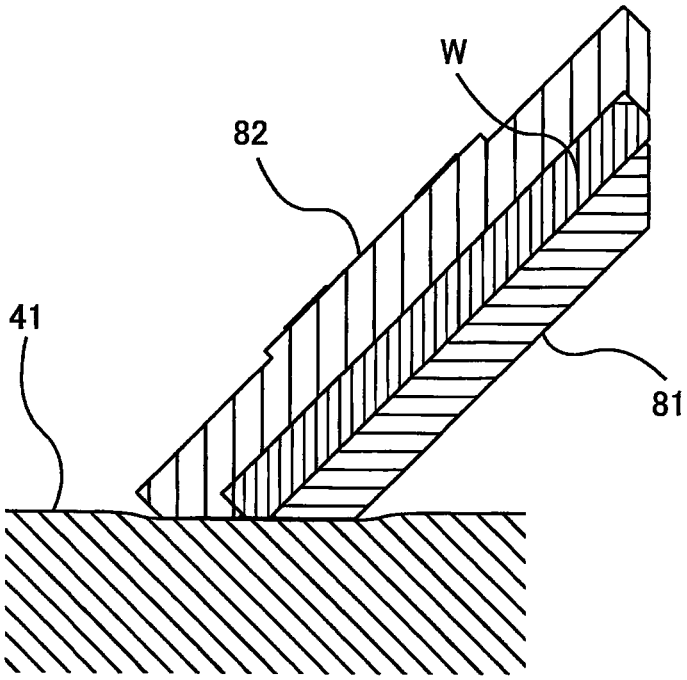
FIG. 28 is a view showing a state in which the workpiece, together with the first cover member and the second cover member, is pressed against the polishing pad.

FIG. 28 is a view showing a state in which the workpiece W, together with the first cover member 81 and the second cover member 82, is pressed against the polishing pad 41. As can be seen from FIG. 28, the first cover member 81 and the second cover member 82 press regions of the polishing pad 41 lying adjacent to the surface, to be polished, of the workpiece W to thereby make the polishing surface of the polishing pad 41 flat. Therefore, it is possible to prevent the rounded edge of the polished surface of the workpiece W.

Figure 29:
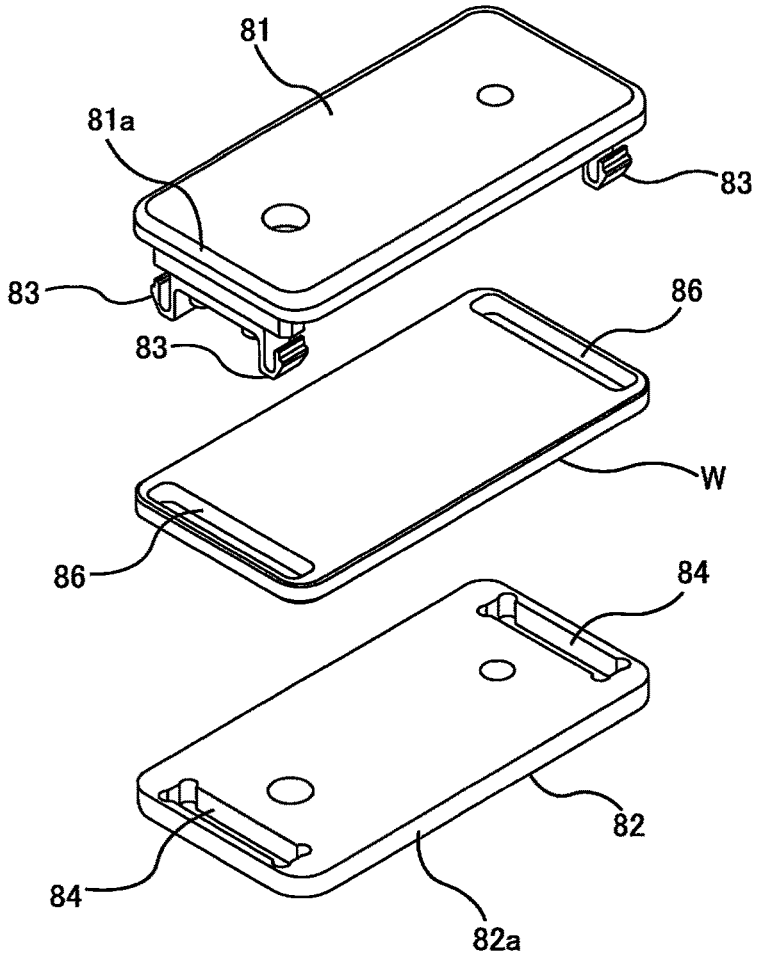
FIG. 29 is a view showing another example of the cover member.

FIG. 29 is a view showing another example of the cover member. More specifically, FIG. 29 shows an exploded perspective view of the cover member used for polishing the side surfaces VS1 to VS4 and the curved corner surfaces US1 to US4 (see FIG. 13A through FIG. 13C) of the workpiece W. The cover member in this example is also constituted by first cover member 81 and second cover member 82 which are arranged so as to sandwich the workpiece W, but is different from the example shown in FIG. 25 in that the side surfaces VS1 to VS4 and the curved corner surfaces US1 to US4 of the workpiece W are exposed through the gap between the first cover member 81 and the second cover member 82.

Figure 30:
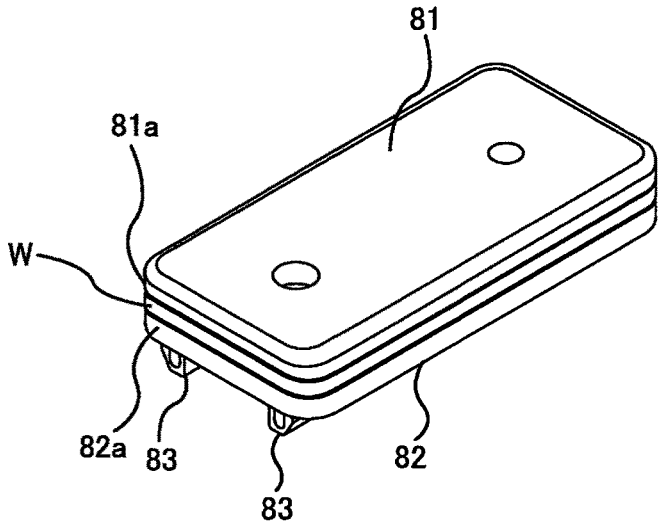
FIG. 30 is a perspective view showing the first cover member, the workpiece, and the second cover member which are assembled.
Figure 31:
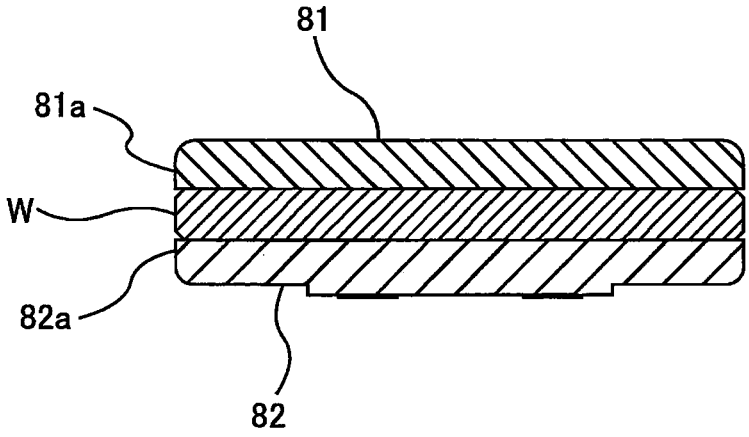
FIG. 31 is a cross-sectional view showing the first cover member, the workpiece, and the second cover member shown in FIG. 30.

FIG. 30 is a perspective view showing the first cover member 81, the workpiece W, and the second cover member 82 which are assembled, and FIG. 31 is a cross-sectional view showing the first cover member 81, the workpiece W, and the second cover member 82 shown in FIG. 30. As can be seen from FIG. 30 and FIG. 31, the side surfaces VS1 to VS4 and the curved corner surfaces US1 to US4 of the workpiece W are exposed through the gap between the first cover member 81 and the second cover member 82. In this case also, the circumferential surfaces 81*a* and 82*a* of the first cover member 81 and the second cover member 82 are parallel with the exposed surface (i.e., the side surfaces and the curved corner surfaces) of the workpiece W, and these circumferential surfaces 81*a* and 82*a* and the exposed surface of the workpiece W lie substantially in the same plane. It is preferable that the exposed surface of the workpiece W protrudes slightly (e.g., by several μm) from the circumferential surfaces 81*a* and 82*a* of the first cover member 81 and the second cover member 82.

Figure 32:
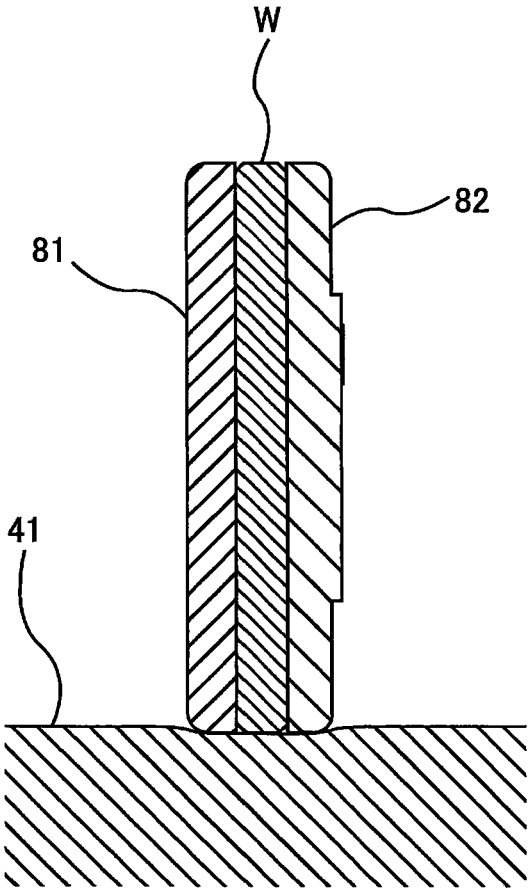
FIG. 32 is a view showing a state in which the workpiece, together with the first cover member and the second cover member, is pressed against the polishing pad.

FIG. 32 is a view showing a state in which the workpiece W, together with the first cover member 81 and the second cover member 82, is pressed against the polishing pad 41. As shown in FIG. 32, the side surface (and the curved corner surface) of the workpiece W, together with the circumferential surfaces 81*a* and 82*a* of the first cover member 81 and the second cover member 82, is pressed against the polishing pad 41. Because the regions of the polishing pad 41 on both sides of the surface, to be polished, of the workpiece W are pressed by the cover members 81 and 82, the upper surface (i.e., the polishing surface) of the polishing pad 41 is flattened. Therefore, it is possible to prevent the rounded edge of the polished surface of the workpiece W.

While the cover members 81 and 82 are configured to sandwich the workpiece W from the both sides thereof in the examples shown in the figures, other type of cover member may be used in accordance with the shape of the workpiece W. For example, a cover member having an opening surrounding the surface, to be polished, of the workpiece W may be used.

Figure 33:
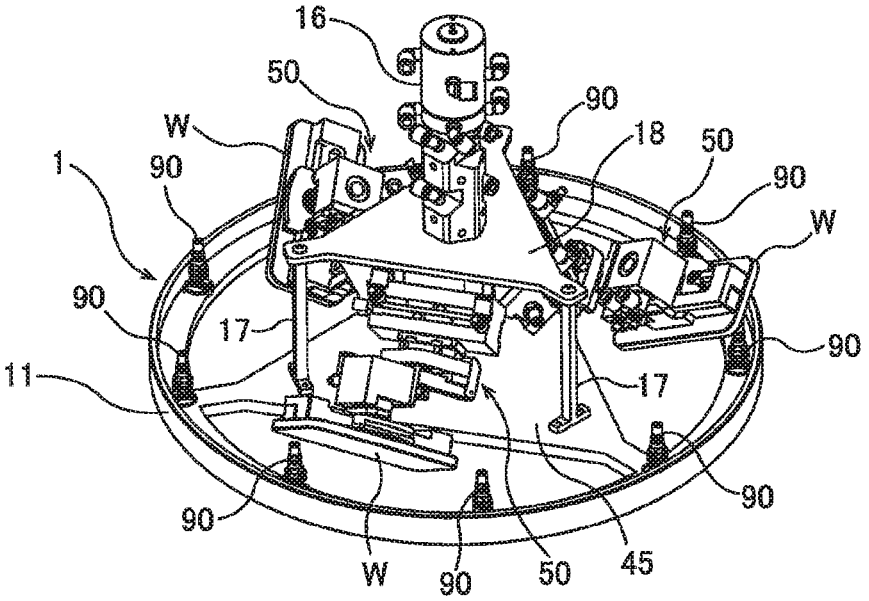
FIG. 33 is a perspective view showing another embodiment of the carrier.
Figure 34:
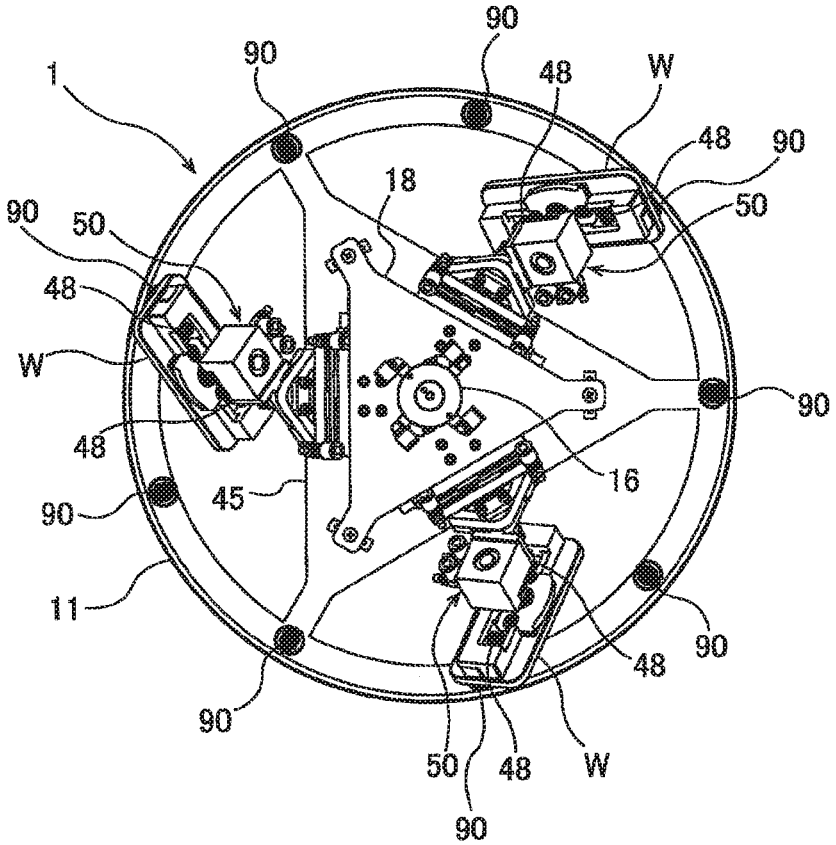
FIG. 34 is a plan view of the carrier shown in FIG. 33.
Figure 35A:
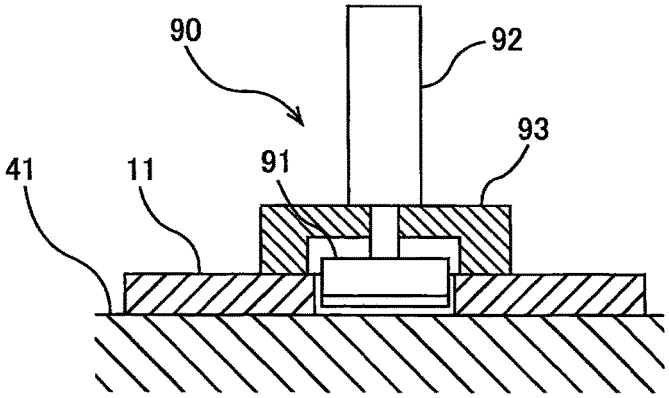
FIG. 35A and FIG. 35B are cross-sectional views each showing a structure of a dresser.
Figure 35B:
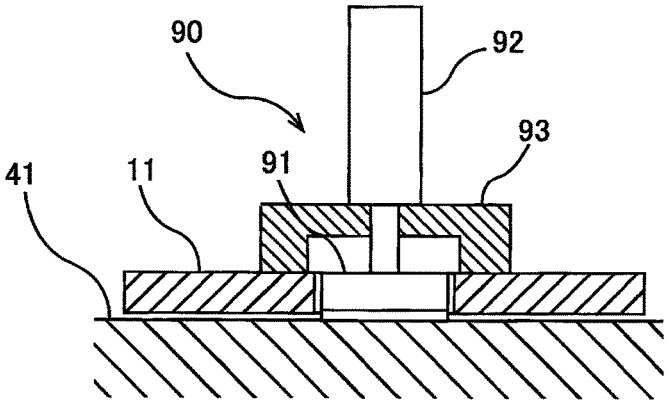

FIG. 33 and FIG. 34 are views showing another embodiment of the carrier 1. This carrier 1 has a plurality of dressers 90 for dressing (or conditioning) the polishing pad 41. The dressers 90 are mounted to the ring 11 and arranged along a circumferential direction of the ring 11 at equal intervals. FIG. 35A and FIG. 35B are cross-sectional views showing structure of the dresser 90. More specifically, FIG. 35A shows the dresser 90 when the workpiece is being polished, and FIG. 35B shows the dresser 90 when dressing the polishing pad 41.

As shown in FIG. 35A and FIG. 35B, each dresser 90 has a circular dressing disk 91, and a pneumatic cylinder 92 as an actuator for pressing the dressing disk 91 against the polishing pad 41. The pneumatic cylinder 92 is secured to a bridge 93 which is secured to the upper surface of the ring 11. The dressing disk 91 has its lower surface on which abrasive grains, such as diamond particles, are fixed. This lower surface of the dressing disk 91 serves as a dressing surface for dressing the polishing pad 41.

As shown in FIG. 35A, in order not to affect the polishing pressure on the workpiece W, the dressing disk 91 is preferably away from the polishing pad 41 when the workpiece W is being polished. Therefore, dressing of the polishing pad 41 is preferably performed before and/or after polishing of the workpiece W. The lower surface (i.e., the dressing surface) of the dressing disk 91 is pressed against the polishing pad 41 as shown in FIG. 35B, while the carrier 1 in its entirety is rotated by the rollers 20 and 20 (see FIG. 1), to thereby dress the surface (i.e., the polishing surface) of the polishing pad 41. Positions of the dressers 90 are not limited to the arrangement shown in FIG. 33 and FIG. 34, so long as the dressers 90 are located outwardly of the contact position between the workpiece W and the polishing pad 41 with respect to the radial direction of the carrier 1. For example, the dressers 90 may be arranged on connections located between the ring 11 and the bottom plate 45.

In the above-discussed embodiment, the pneumatic cylinders are used as the rotary actuator 51 and the first rotary coupling 61. Further, the pneumatic cylinder is used as the actuator of the dresser 90. Since the gas (typically air) is needed to operate the pneumatic cylinders, multiple tubes (not shown) are coupled to the rotary joint 16. Further, although not shown, each of the pivot mechanisms 50 is provided with various sensors, including a sensor for detecting a stroke edge of the pivoting motion of the rotary actuator 51, a sensor for detecting a position of a rotation edge of the lever 77, a sensor for detecting a position of a rotation edge of the first rotary coupling 61. These sensors are coupled to wires that extend through a rotary connector (not shown) to the exterior of the carrier 1.

As the number of pivot mechanisms 50 and dressers 90 increases, the number of tubes also increases. As a result, it is necessary to use a larger rotary joint. Similarly, a larger rotary connector is needed in accordance with the increase in the number of sensors. When operating many carriers 1 for polishing a large number of workpieces simultaneously, it is difficult for an operator to manage the operations of these carriers 1 simultaneously.

Figure 36:
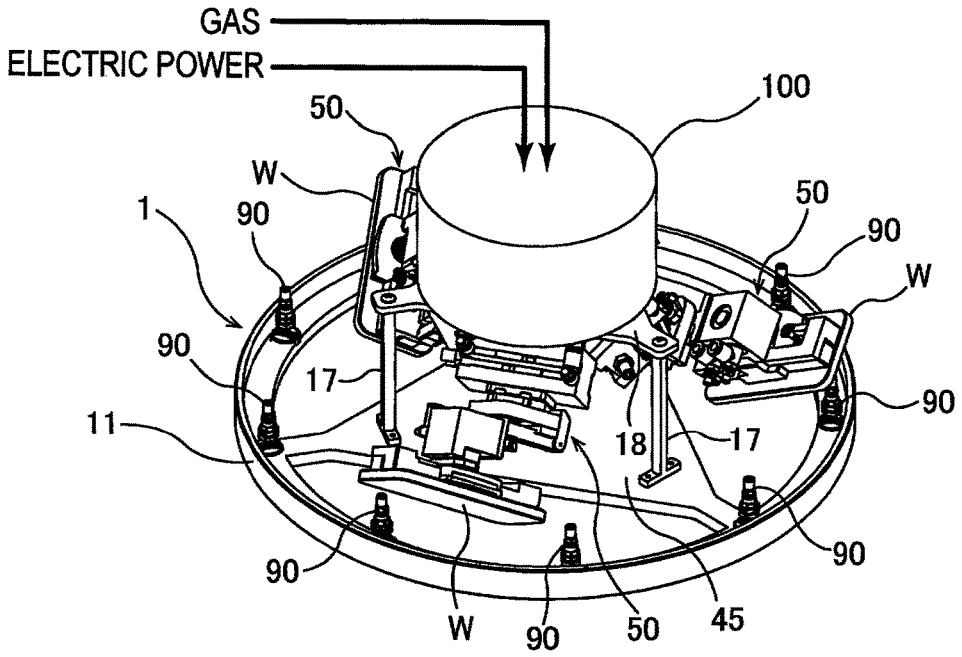
FIG. 36 is a view showing still another embodiment of the carrier.

Thus, another embodiment, which will be discussed below, provides a carrier capable of omitting such multiple-path rotary joint and multiple-path rotary connector and capable of being controlled by a central controller which is provided in another site. FIG. 36 is a view showing still another embodiment of the carrier 1. This carrier 1 has a control box 100 for controlling the operations of the pivot mechanisms 50. This control box 100 is secured to the installation plate 18.

Figure 37:
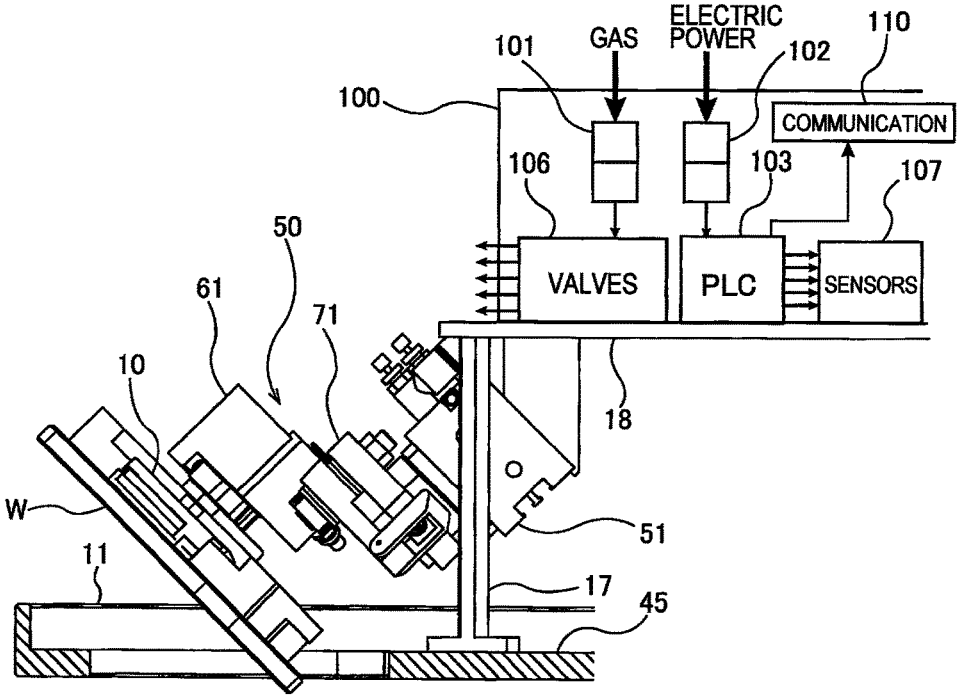
FIG. 37 is a view of a control box shown in FIG. 36.

FIG. 37 is a view of the control box 100 shown in FIG. 36. This control box 100 includes a single-path rotary joint 101 coupled to the gas supply unit (not shown), a single-path rotary connector 102 coupled to a power source (not shown), a programmable controller (PLC) 103 coupled to the rotary connector 102, a plurality of solenoid valves 106 coupled to the rotary joint 101, a plurality of sensors 107, and a communication device 110. In FIG. 37, the solenoid valves 106 and the sensors 107 are schematically depicted.

Electric power is supplied from the power source to the programmable controller 103 via the rotary connector 102. The programmable controller 103 is coupled to the solenoid valves 106. The pivot mechanisms 50 are coupled to the rotary joint 101 via the solenoid valves 106. The gas from the gas supply unit is supplied to the pneumatic cylinders (i.e., the rotary actuators 51 and the first rotary couplings 61) of the pivot mechanisms 50 and the pneumatic cylinders 92 of the dressers 90 through the rotary joint 101 and the solenoid valves 106. The sensors 107 include a sensor for sensing the workpiece W and a sensor for detecting the pivoting motion of the rotary actuator 51. These sensors 107 are coupled to the programmable controller 103 and are configured to work by receiving the supply of the electric power from the programmable controller 103.

The number of solenoid valves 106 corresponds to the number of pneumatic cylinders installed in the carrier 1. According to this embodiment, controlling of gas distribution can be achieved by the solenoid valves 106 provided in the carrier 1. Therefore, it is not necessary to provide the multiple-path rotary joint. Similarly, since the electric power is distributed to the sensors 107 by the programmable controller 103, it is not necessary to provide the multiple-path rotary connector.

The programmable controller 103 is configured to control the operations of the solenoid valves 106 to thereby control the operations of the pivot mechanisms 50 (e.g., the operation start and the operation stop of each rotary actuator 51) and the operations of the dressers 90 (e.g., the dressing start and the dressing stop of the polishing pad 41). The programmable controller 103 is coupled to the communication device 110, which can perform a radio communication with an external central controller.

Figure 38:
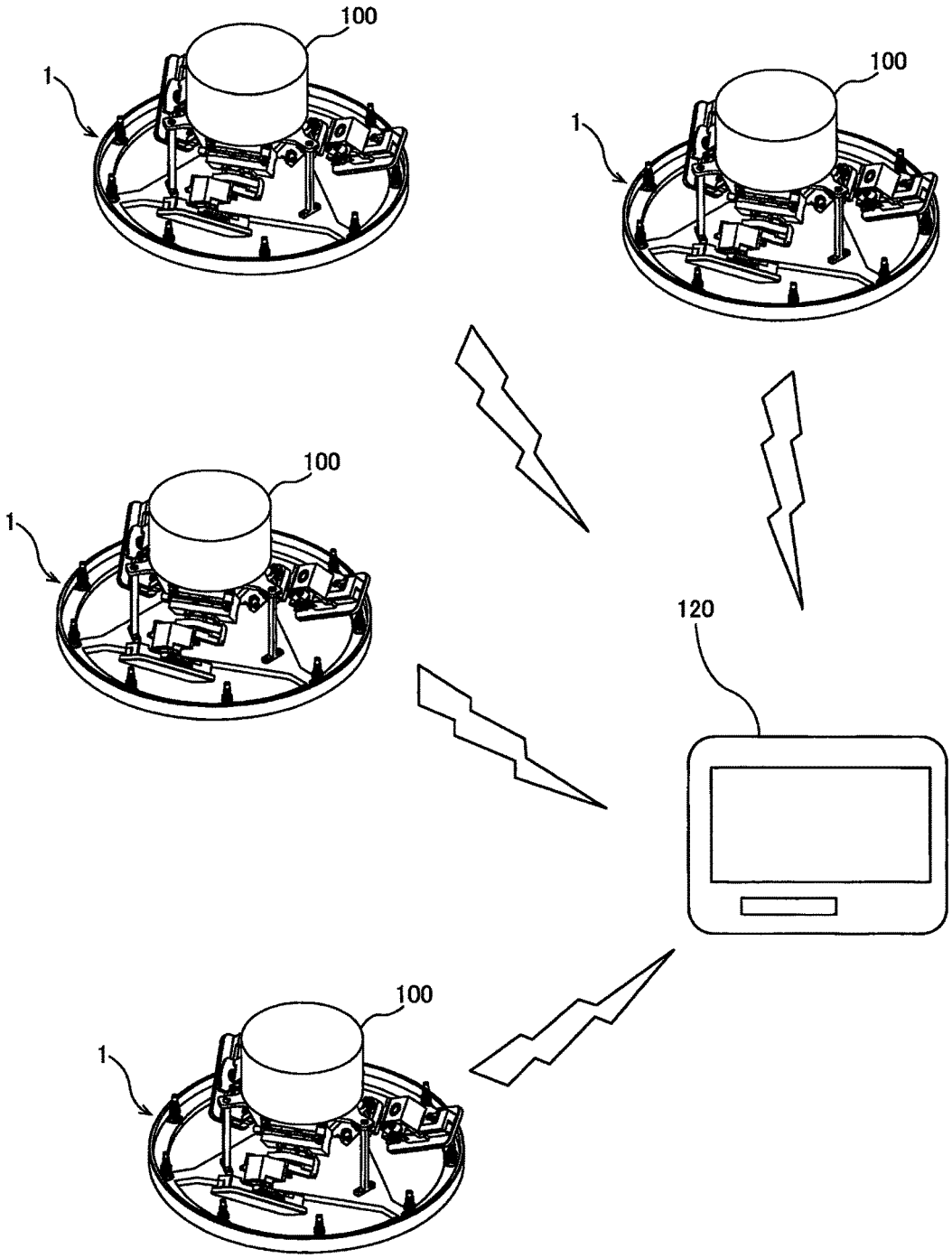
FIG. 38 is a schematic view illustrating multiple carriers remotely controlled by a central controller.

FIG. 38 is a schematic view illustrating multiple carriers 1 remotely controlled by the central controller. The central controller 120 and the programmable controller 103 of each of the carriers 1 transmit information mutually through the communication device 110. The central controller 120 monitors the operations of the carriers 1, detects an operation failure of the carrier 1, and controls the polishing start and the polishing stop of the workpiece in each carrier 1. Further, the central controller 120 is configured to send update program to the programmable controllers 103 of the multiple carriers 1 by means of the communication to rewrite programs of the programmable controllers 103 to thereby modify or change polishing conditions (i.e., a workpiece polishing recipe) in the multiple carriers 1 simultaneously. For example, the central controller 120 is able to change the operation sequence of the carrier 1 previously discussed with reference to FIG. 21A through FIG. 24D. Further, the central controller 120 is able to predict an amount of production of the workpieces from the information, such as the polishing conditions in each of the carriers 1.

Figure 39:
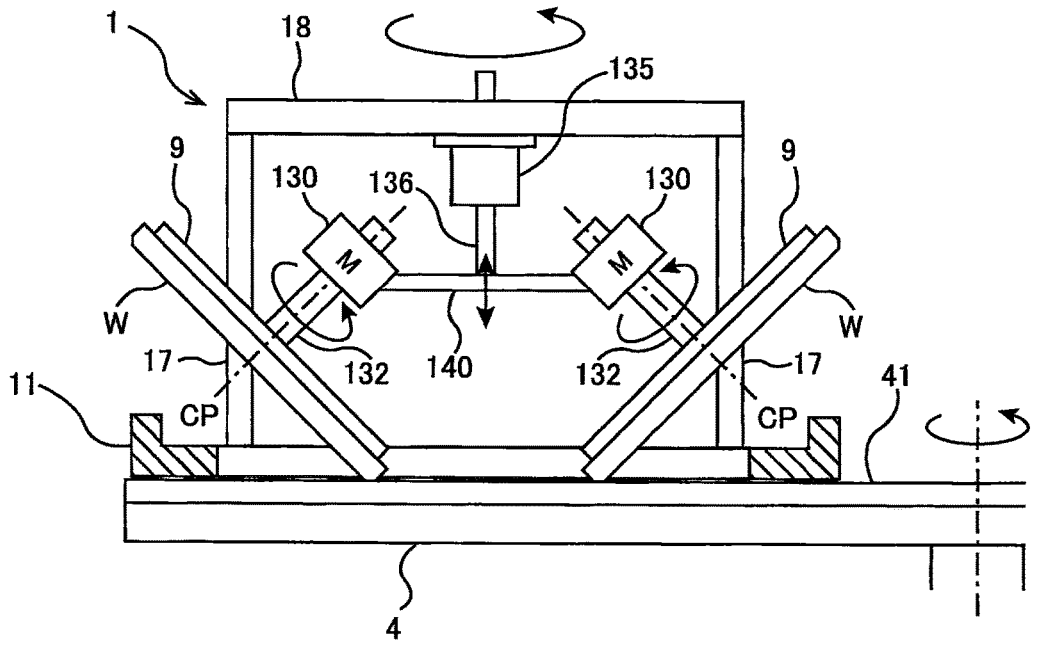
FIG. 39 is a schematic view showing still another embodiment of the carrier.

FIG. 39 is a schematic view showing still another embodiment of the carrier 1. The carrier 1 according to this embodiment includes workpiece holders 9 each configured to hold the workpiece W, servomotors 130 as rotary actuators (i.e., rotating devices) coupled to the workpiece holder 9, and a shaft motor 135 as a vertically moving device configured to vertically move the workpiece holders 9 and the servomotors 130. Each workpiece holder 9 has a function to removably hold the workpiece W thereon. The structure of the workpiece holder 9 is the same as the structure of the workpiece holder 9 in the above-discussed embodiment, and its repetitive explanations are omitted.

The servomotors 130 are secured to a support member 140. The workpiece holders 9 are coupled to the servomotors 130 through connection shafts 132, respectively, so that the workpiece holders 9 and the workpieces W held thereon are rotated by the servomotors 130. Each servomotor 130 is configured to rotate the workpiece W in the clockwise direction or the counterclockwise direction at a preset speed. A rotation axis CP of the servomotor 130 extends through the center of the workpiece W held by the workpiece holder 9. Therefore, the workpiece W is rotated about its own axis by the servomotor 130. This axis of the workpiece W coincides with the rotation axis CP of the servomotor 130.

As shown in FIG. 1, while the workpiece W is rotated, the carrier 1 and the polishing pad 41 (the soft polishing pad 3 shown in FIG. 1 is replaced with the hard polishing pad 41) rotate, so that the workpiece W is polished by the sliding contact with the polishing pad 41 in the presence of the polishing liquid. During polishing of the workpiece W, the workpiece W may be rotated continuously or intermittently. For example, the workpiece W may be rotated when the curved slopes CS1 to CS4 (see FIG. 13A through FIG. 13C) is polished, or the rotation of the workpiece W may be stopped once and then the slopes SS1 to SS4 may be polished.

The rotation axis CP of the servomotor 130 is inclined at a predetermined angle with respect to the vertical direction. Therefore, the bottom surface F (see FIG. 13A) of the workpiece W does not contact the polishing surface 41, and the circumferential surface of the workpiece W contacts the polishing pad 41. In the example shown in FIG. 39, the rotation axis CP of the workpiece W is inclined at 45 degrees. Accordingly, the slopes SS1 to SS4 and the curved slopes CS1 to CS4 shown in FIG. 13A through 13C contact the polishing pad 41.

As shown in FIG. 13A, the workpiece W has a rectangular shape. Therefore, while the workpiece W makes one rotation around its central axis, a distance from the center of the workpiece W to the surface to be polished varies. Accordingly, if the vertical position of the rotation axis CP is fixed, the surface, to be polished, of the workpiece W does not project from the lower surface of the ring 11 at a certain angle, and as a result the workpiece W is separated from the polishing pad 41. Thus, in order to allow the target surface (i.e., the circumferential surface) of the workpiece W to project from the lower surface of the ring 11 at all times regardless of the rotation angle of the workpiece W (i.e., in order to keep the circumferential surface of the workpiece W in contact with the polishing pad 41 at all times during the rotation of the workpiece W), the shaft motor 135 moves the servomotors 130, the workpiece holders 9, and the workpieces W vertically in unison in synchronization with the rotation of the workpieces W. A distance and a speed of the vertical movement of the workpieces W in synchronization with the rotation of the workpieces W are predetermined based on the shape of the workpieces W.

The shaft motor 135 is secured to the installation plate 18. The support member 140 is coupled to a vertical movement shaft 136 of the shaft motor 135, so that the support member 140 is elevated and lowered in the vertical direction (i.e., in the direction perpendicular to the polishing surface of the polishing pad 41) by the shaft motor 135. Therefore, the servomotors 130 on the support member 140 are moved in the vertical direction by the shaft motor 135. Although three or more sets of the servomotors 130 and the workpiece holders 9 are provided in this embodiment, only two sets of the servomotors 130 and the workpiece holders 9 are depicted for easier illustration.

Figure 40:
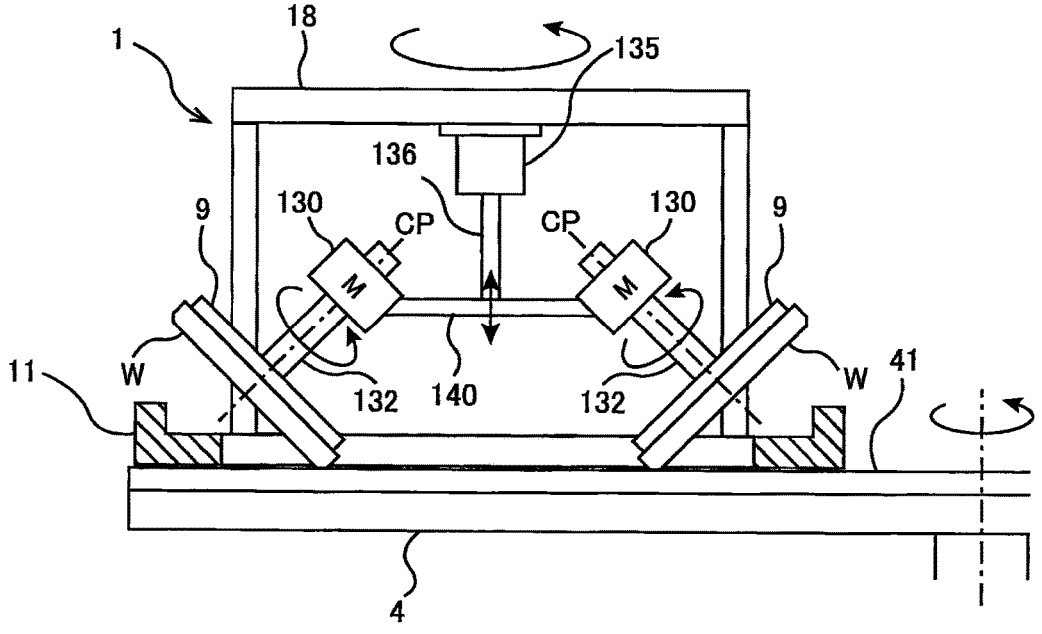
FIG. 40 is a view of the carrier when polishing a first slope connected to a long side of the bottom surface of the workpiece.

FIG. 39 shows the view of the carrier 1 when polishing the second slope SS2 (see FIG. 13A) connected to the short side of the bottom surface F of the workpiece W, and FIG. 40 shows the view of the carrier 1 when polishing the first slope SS1 connected to the long side of the bottom surface F of the workpiece W. While the workpiece W is rotated about its own axis, the workpiece W and the servomotor 130 are vertically moved by the shaft motor 135. Although a distance from the center of the workpiece W to the first slope SS1 differs from a distance from the center of the workpiece W to the second slope SS2, the surface, to be polished, of the workpiece W projects downward from the lower surface of the ring 11 at all times as shown in FIG. 39 and FIG. 40, because the shaft motor 135 moves the workpiece W in the vertical direction in synchronization with the rotation of the workpiece W in accordance with a contour of the workpiece W. Therefore, the surface, to be polished, of the workpiece W is kept in contact with the polishing pad 41.

In order to keep the polishing pressure of the workpiece W on the polishing pad 41 constant when the workpiece W is moved vertically, an elastic element (e.g., an air bag or a spring) is preferably provided between the workpiece W and the workpiece holder 9. It is preferable to provide such an elastic element from the viewpoint of removing a fluctuation of the polishing pressure that could occur with the vertically movement of the workpiece W. The elastic element may support the workpiece W in its entirety or may support only four corners of the workpiece W.

A contact area of the workpiece W on the polishing pad 41 varies in accordance with the rotation angle of the workpiece W. Therefore, the servomotor 130 preferably changes the rotation speed of the workpiece W in accordance with the contact area between the workpiece W and the polishing pad 41 (i.e., the rotation angle of the workpiece W). For example, when the slopes SS1 and SS3 of the workpiece W are polished, the rotation speed of the workpiece W may be lowered, and when the curved slopes CS1 to CS4 of the workpiece W are polished, the rotation speed of the workpiece W may be increased. Further, the rotation of the workpiece W may be stopped temporarily.

As can be seen from FIG. 39 and FIG. 40, as the workpiece W is moved in the vertical direction, a region of the polishing pad 41 contacting the workpiece W varies along the radial direction of the polishing pad 41. Therefore, a wider region of the polishing pad 41 is used to polish the workpiece W. In view of this, the service life of the polishing pad 41 is expected to increase.

If the same region of the polishing pad 41 is used when polishing the workpiece W, polishing debris may be deposited on the polishing pad 41, causing scratches on the workpiece W. In this embodiment, the region of the polishing pad 41 contacting the workpiece W moves in the radial direction of the polishing pad 41 as the workpiece W moves in the vertical direction. Therefore, an amount of the local deposition of the polishing debris can be reduced. As a result, the scratches on the workpiece W can be reduced. Moreover, because a wider region of the polishing pad 41 can be used for polishing the workpiece W, the polishing liquid (slurry) retained on the polishing pad 41 can be effectively used.

The servomotor 130 and the shaft motor 135 shown in FIG. 39 correspond to the pivot mechanism 50 shown in FIG. 17. The pivot mechanism 50 is constituted by mainly three elements: the rotary actuator 51; the first rotary coupling 61; and the second rotary coupling 71, while the carrier 1 shown in FIG. 39 has two elements: the servomotor 130 and the shaft motor 135. Therefore, the distance from the shaft motor 135 to the workpiece W becomes short, as compared with the carrier 1 shown in FIG. 17. As a result, more stable polishing of the workpiece W can be achieved.

When the shaft motor 135 elevates the workpiece W to a position above the ring 11, the workpiece W in its entirety is separated away from the polishing pad 41. Therefore, the polishing start point and the polishing end point of the workpiece W can be controlled by the shaft motor 135. It is also possible to clean the polished workpiece W with a cleaning liquid (or a rinsing liquid) when the workpiece W is away from the polishing pad 41. Further, it is possible to adjust the polishing pressure on the workpiece W by adjusting the relative position in the vertical direction between the workpiece W and the ring 11 when polishing the workpiece W. The polishing pressure is preferably changed based on an area of the surface to be polished.

During polishing of the workpiece W, the servomotor 130 may cause the workpiece W to pivot in the clockwise direction and the counterclockwise direction alternately. In this case, when the rotational direction of the workpiece W is switched, a polishing stripe may remain on the polished surface. In order to avoid this, it is preferable that the servomotor 130 in this embodiment rotate the workpiece W only in a predetermined direction, i.e., either the clockwise direction or the counterclockwise direction. By polishing the workpiece W while rotating it in one direction in this manner, a smooth mirror-finished surface can be achieved.

During polishing of the workpiece W, the workpiece W may be rotated in one direction continuously or intermittently. In order to form a smooth mirror-finished surface with no polishing stripe, it is preferable to rotate the workpiece W in one direction continuously. Further, in order to uniformly polish the surface of the workpiece W symmetrically, the workpiece W may be rotated in one direction predetermined times and then the workpiece W may be further rotated in the opposite direction predetermined times.

Figure 41:
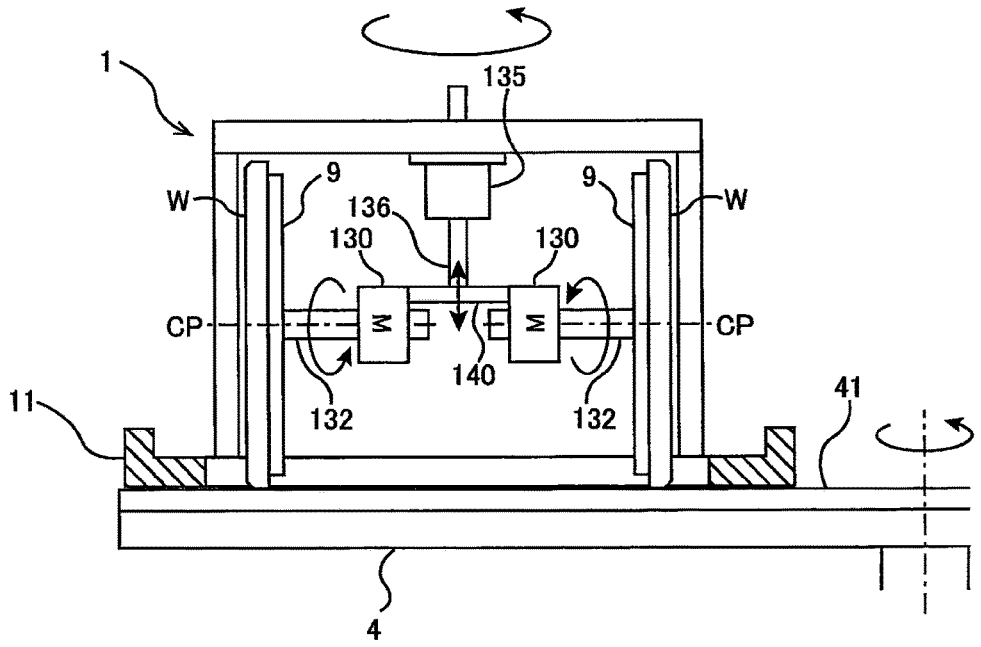
FIG. 41 is a schematic view of the carrier when polishing the workpiece with its central axis inclined at 90 degrees with respect to a vertical direction.

The inclination angle of the rotation axis CP of the servomotor 130 can be changed in accordance with a change in an attachment angle of the servomotor 130 on the support shaft 140. FIG. 41 shows an example in which the rotation axis CP of the servomotor 130 is inclined at 90 degrees with respect to the vertical direction. The carrier 1 shown in FIG. 41 can polish the side surfaces VS1 to VS4 and the curved corner surfaces US1 to US4 of the workpiece W.

Figure 42:
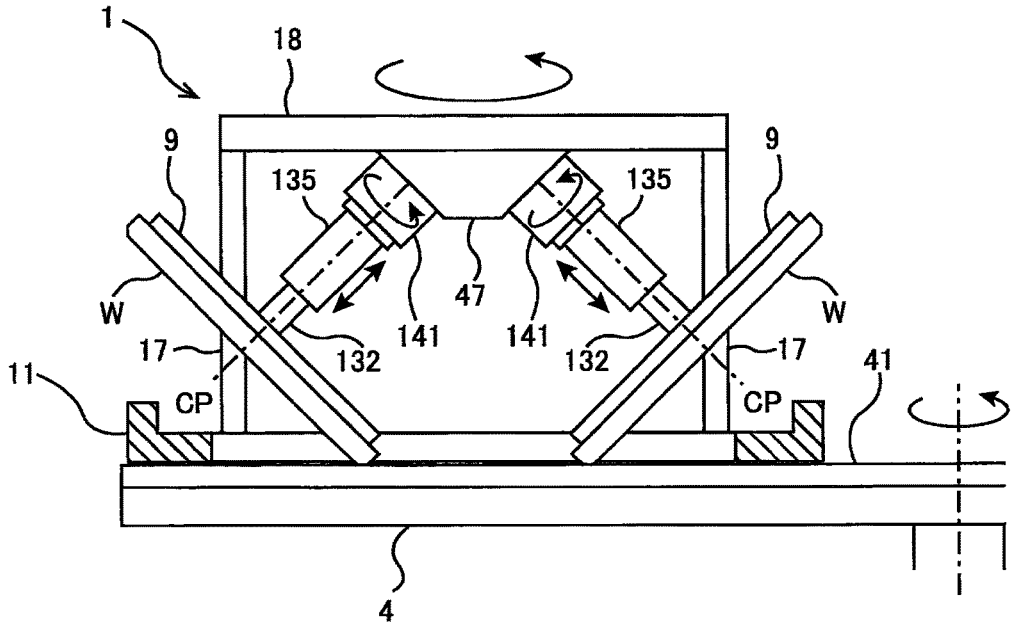
FIG. 42 is a view showing still another embodiment of the carrier.

FIG. 42 is a view showing a still another embodiment of the carrier 1. Structures and motions of the carrier 1 in this embodiment, which will not be described particularly, are identical to those of the carrier shown in FIG. 39, and are not described repetitively. The carrier 1 shown in FIG. 42 includes hollow servomotors 141, shaft motors 135 coupled to the hollow servomotors 141, respectively, and connection shafts 132 supported by the shaft motors 135, respectively.

The workpiece holders 9 are secured to the connection shafts 132. The hollow servomotors 141 are secured to the attachment 47, which is secured to the installation plate 18. The hollow servomotor 141, the shaft motor 135, the connection shaft 132, the workpiece holder 9, and the workpiece W held by the workpiece holder 9 are aligned on the same axis in this order.

Figure 43:
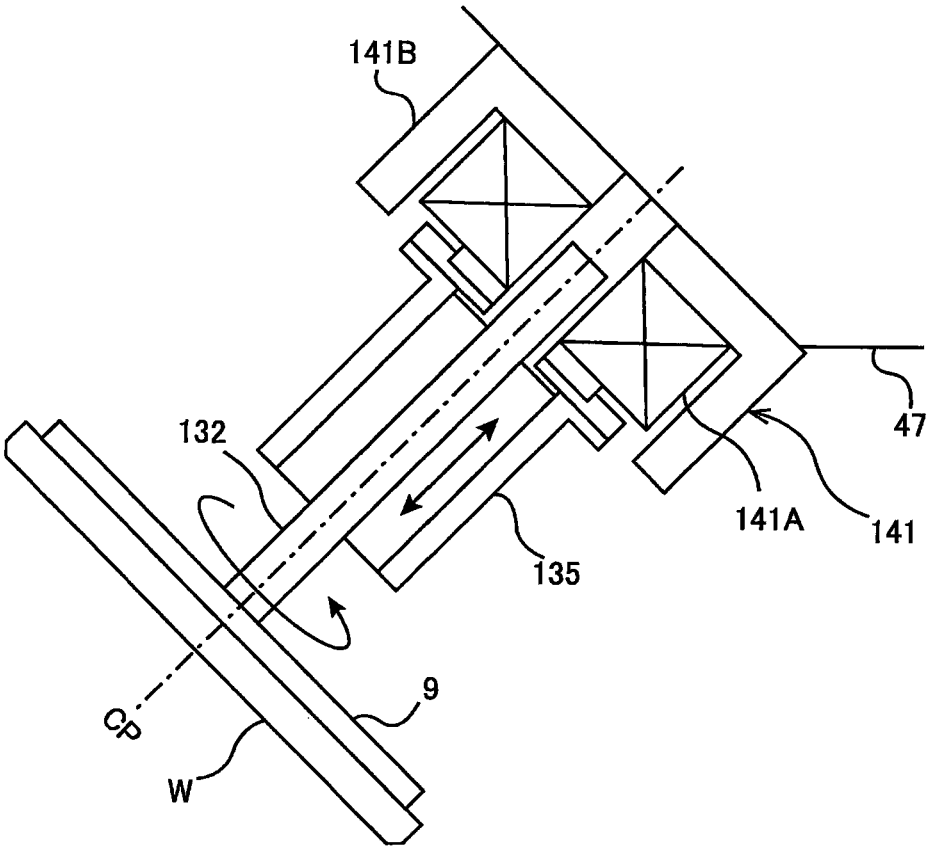
FIG. 43 is a cross-sectional view showing a hollow servomotor and a shaft motor shown in FIG. 42.

FIG. 43 is a cross-sectional view showing the hollow servomotor 141 and the shaft motor 135 shown in FIG. 42. As shown in FIG. 43, the hollow servomotor 141 has a stator 141B which is secured to the attachment 47. The shaft motor 135 is secured to a rotor 141A of the hollow servomotor 141, so that the shaft motor 135 is rotated by the hollow servomotor 141. The shaft motor 135 is configured to move the connection shaft 132 in its longitudinal direction and not to permit the connection shaft 132 to rotate relative to the shaft motor 135. One end of the connection shaft 132 lies within a hollow formed in a central portion of the hollow servomotor 141, and the other end is coupled to the workpiece holder 9. The connection shaft 132 may extend through the hollow servomotor 141. This hollow servomotor 141 rotates the shaft motor 135, the connection shaft 132, the workpiece holder 9, and the workpiece W in unison.

The rotation axis CP of the hollow servomotor 141 extends through the center of the workpiece W held by the workpiece holder 9. Therefore, the workpiece W is rotated about its own central axis. The shaft motor 135 is configured to move the connection shaft 132 in its axial direction (i.e., along the rotation axis CP). Therefore, the workpiece W is rotated about its own central axis by the hollow servomotor 141 and is moved in its central axis of the workpiece W. The rotation axis CP (i.e., the central axis of the workpiece W) is inclined with respect to the horizontal direction. Accordingly, when the workpiece W is moved along the rotation axis CP, the workpiece W in its entirety is elevated and lowered. Therefore, the shaft motor 135 serves as a vertically moving mechanism for moving the workpiece W up and down.

Figure 44:
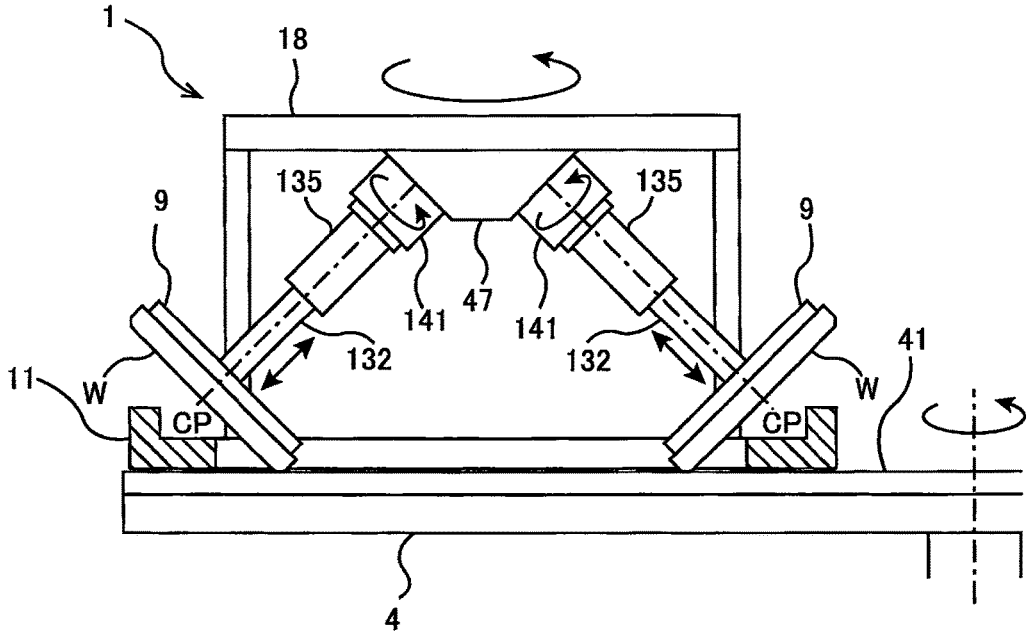
FIG. 44 is a view of the carrier when polishing the first slope connected to a long side of the bottom surface of the workpiece.

The motions of the workpiece W shown in FIG. 42 during polishing thereof are the same as those of the workpiece W shown in FIG. 39. Specifically, the workpiece W is rotated by the hollow servomotor 141 with the circumferential surface of the workpiece W in contact with the polishing pad 41, while the workpiece W is elevated and lowered by the shaft motor 135 in synchronization with the rotation of the workpiece W. The above-mentioned FIG. 42 shows a view of the carrier when polishing the second slope SS2 (see FIG. 13A) connected to the short side of the bottom surface F of the workpiece W, and FIG. 44 shows a view of the carrier when polishing the first slope SS1 connected to the long side of the bottom surface F of the workpiece W. As shown in FIG. 42 and FIG. 44, because the shaft motor 135 moves the workpiece W up and down in synchronization with the rotation of the workpiece W, the circumferential surface of the workpiece W projects downwardly from the ring 11 at all times. Accordingly, the workpiece W can contact the polishing pad 41 at all times, regardless of the rotation angle of the workpiece W.

Figure 45:
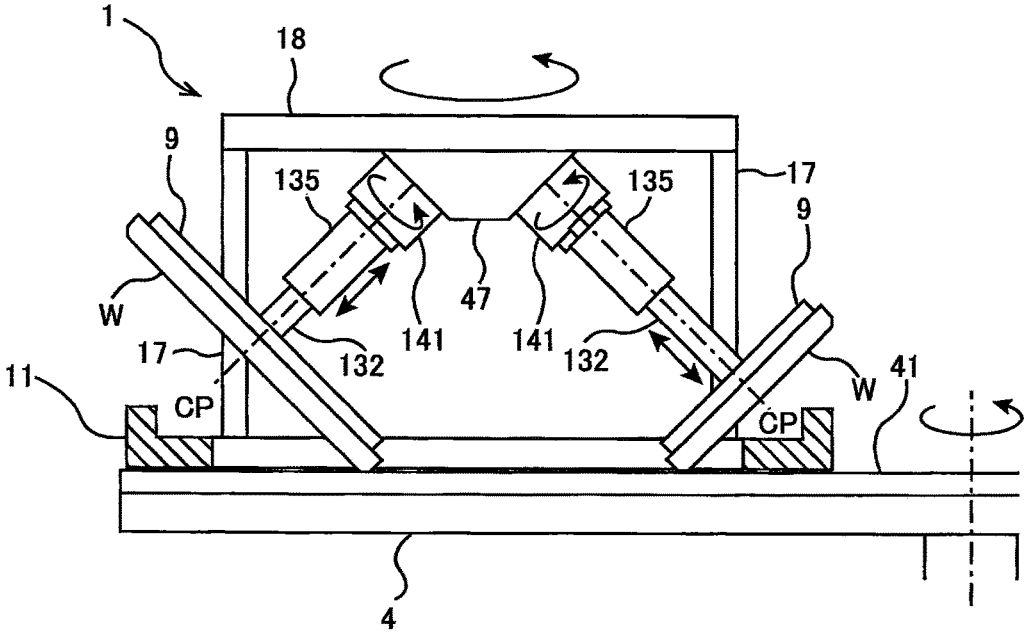
FIG. 45 is a view showing an example of an operation of the carrier shown in FIG. 42.

The carrier 1 according to this embodiment can rotate and vertically move the plurality of workpieces W independently. As shown in FIG. 45, during polishing, one of the multiple workpieces W may be rotated at a certain speed, while the other may be rotated at a different speed. Such operations can adjust an amount of polishing of each of the surfaces of the workpiece W. In this case also, the workpiece W is elevated and lowered such that the circumferential surface of the workpiece W projects downwardly from the ring 11 at all times.

Figure 46:
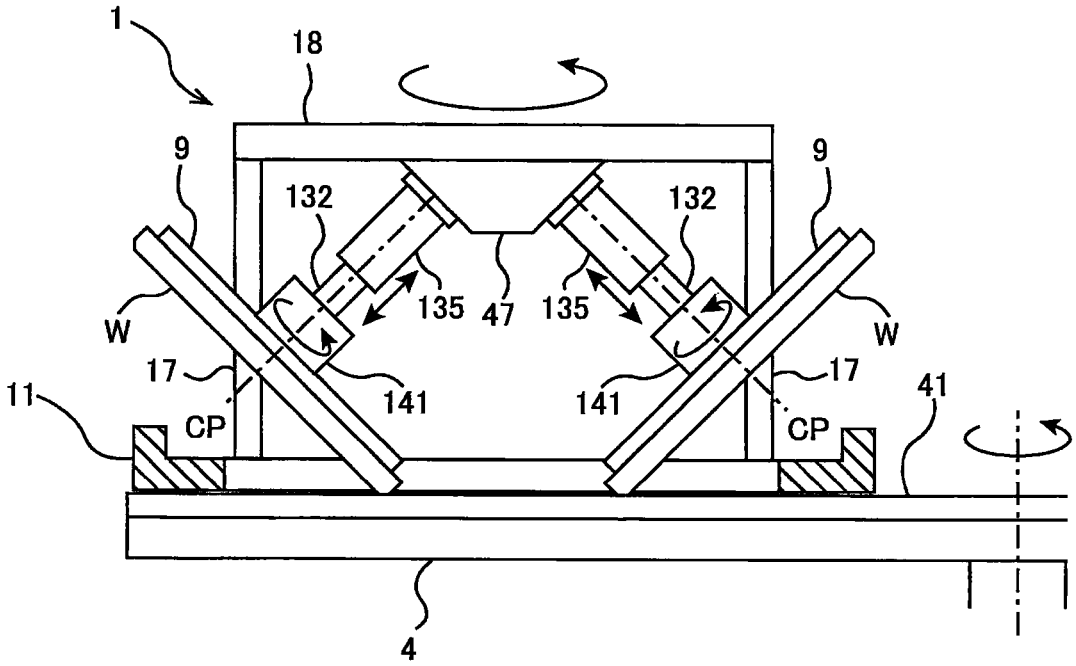
FIG. 46 is a view showing a modified example of the carrier shown in FIG. 42.

FIG. 46 is a view showing a modified example of the carrier shown in FIG. 42. Structures and motions of the carrier in this example, which will not be described particularly, are identical to those of the carrier shown in FIG. 42, and are not described repetitively. In this example shown in FIG. 46, the shaft motors 135 are secured to the attachment 47. The stators 141B of the hollow servomotors 141 are secured to the workpiece holders 9, and the rotors 141A of the hollow servomotors 141 are secured to the connection shafts 132. The connection shafts 132 are supported by the shaft motors 135. In this example, the shaft motor 135, the connection shaft 132, the hollow servomotor 141, the workpiece holder 9, and the workpiece W held by the workpiece holder 9 are aligned on the same axis in this order.

The workpiece holder 9 and the workpiece W held by the workpiece holder 9 are rotated by the hollow servomotor 141. Further, the workpiece W, the workpiece holder 9, and the hollow servomotor 141 are moved by the shaft motor 135 along the central axis CP (i.e., the central axis of the workpiece). The motions of the workpiece W when being polished are the same as those in the embodiment shown in FIG. 42, so that the circumferential surface of the workpiece W can be mirror-polished as well. In this example shown in FIG. 46, instead of the hollow servomotor 141, a normal-type servomotor may be used.

Figure 47:
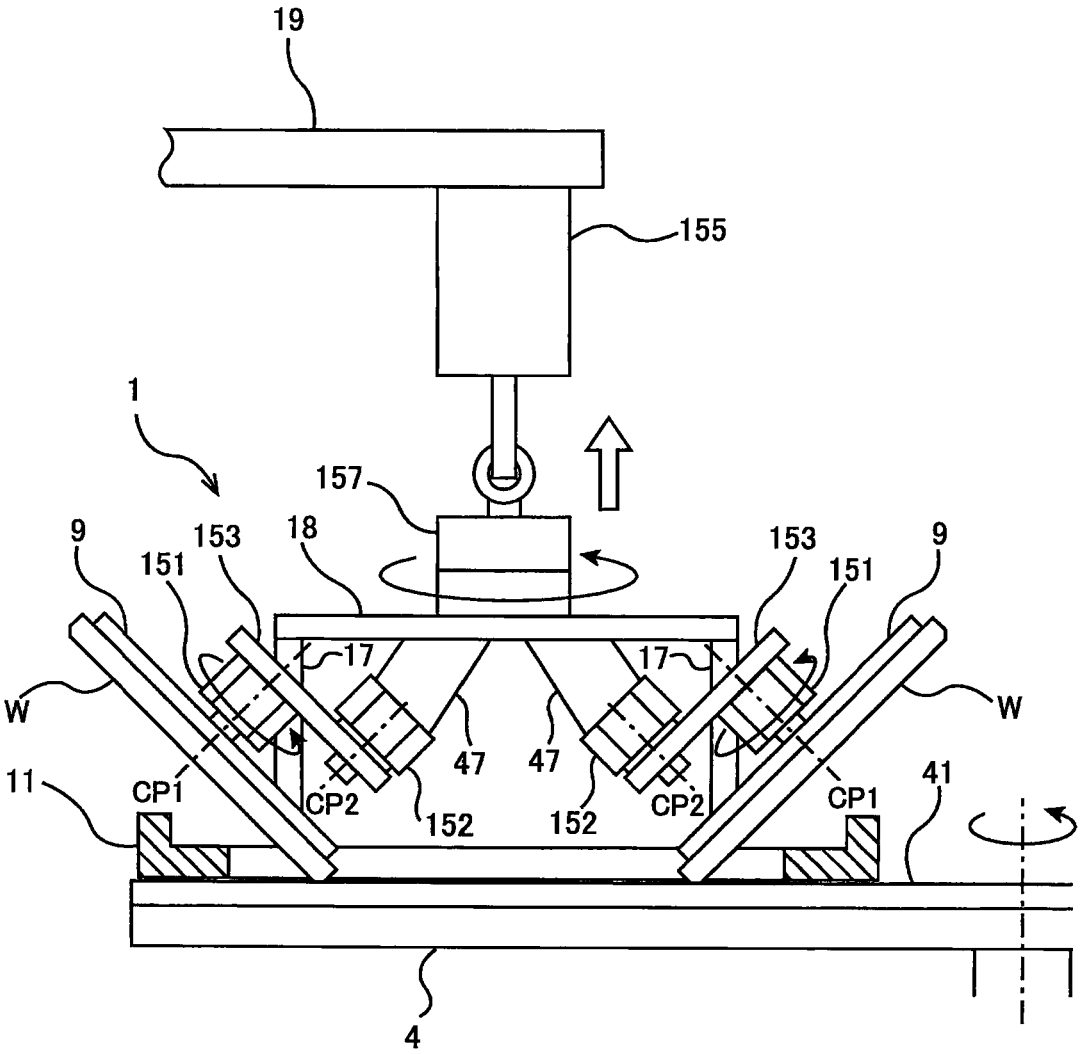
FIG. 47 is a view showing still another embodiment of the present invention.

FIG. 47 is a view showing still another embodiment of the present invention. Structures and motions of the carrier in this embodiment, which will not be described particularly, are identical to those of the carrier shown in FIG. 42, and are not described repetitively. The carrier 1 includes first servomotors (first rotating devices) 151 coupled to the workpiece holders 9, swing arms 153 to which the first servomotors 151 are secured, and second servomotors (second rotating devices) 152 coupled to the first servomotors 151 through the swing arms 153. A rotation axis CP1 of each first servomotor 151 extends through the center of the workpiece W held on the workpiece holder 9. Therefore, the workpiece W is rotated about its own axis at a predetermined speed by the first servomotor 151.

Each second servomotor 152 is secured to the attachment 47, which is secured to the installation plate 18. The first servomotor 151 is secured to one end of the swing arm 153, and the second servomotor 152 is secured to the other end of the swing arm 153. When the second servomotor 152 rotates the swing arm 153, the first servomotor 151 and the workpiece holder 9 are rotated about a rotation axis CP2 of the second servomotor 152. This rotation axis CP2 is inclined with respect to a direction perpendicular to the polishing pad 41 (at 45 degrees in FIG. 47). Therefore, the workpiece holder 9 and the workpiece W are elevated and lowered by the second servomotor 152. The second servomotor 152 and the swing arm 153 serve as a vertically moving mechanism for moving the workpiece W up and down.

In order to allow the target surface (i.e., the circumferential surface) of the workpiece W to project from the lower surface of the ring 11 at all times regardless of the rotation angle of the workpiece W (i.e., in order to keep the circumferential surface of the workpiece W in contact with the polishing pad 41 at all times during the rotation of the workpiece W), the second servomotor 152 moves the workpiece holder 9 and the workpiece W up and down together in synchronization with the rotation of the workpiece W about its own central axis. A distance and a speed of the upward and downward movements of the workpiece W in synchronization with the rotation of the workpiece W are predetermined based on the shape of the workpiece W.

Although three or more sets of the servomotors 151, 152 and the workpiece holders 9 are provided in this embodiment, only two sets of the servomotors 151, 152 and the workpiece holders 9 are depicted for easier illustration.

In this embodiment, a lifting device 155 for exerting an upward force on the carrier 1 is coupled to the carrier 1. More specifically, a rotary joint 157 is secured to an upper portion of the carrier 1, and the rotary joint 157 is coupled to the lifting device 155. This lifting device 155 is secured to the static arm 19 which is located above the polishing pad 41. The rotary joint 157 is configured to permit the rotation of the carrier 1 while transmitting the upward force from the lifting device 155 to the carrier 1.

The lifting device 155 exerts the upward force on the central portion of the carrier 1 through the rotary joint 157 to thereby regulate the pressure (i.e., the polishing pressure) of the workpiece W acting on the polishing pad 41. The polishing pressure is determined by the self-weight of the carrier 1 and the workpiece W and the upward force produced by the lifting device 155.

The lifting device 155 may change the upward force during polishing of the workpiece W. More specifically, the lifting device 155 preferably changes the upward force in synchronization with the rotation of the workpiece W. For example, when a large surface is polished, the upward force is reduced so that the polishing pressure is increased. When a small surface is polished, the upward force is increased so that the polishing pressure is reduced. In this manner, the lifting device 155 can adjust the polishing pressure to an optimum value in synchronization with the rotation of the workpiece W. Therefore, all surfaces of the workpiece W can be polished with the optimized polishing pressures.

Specific examples of the lifting device 155 include a pneumatic cylinder, and a combination of a servomotor and a ball screw. In the case of using the pneumatic cylinder, the polishing pressure can be controlled by regulating pressure of a gas supplied to the pneumatic cylinder. Although the rotary joint 157 is secured to the installation plate 18 in this example shown in FIG. 47, the arrangement of the rotary joint 157 is not limited to this example.

The lifting device 155 is applicable to the above-discussed other embodiments. For example, the lifting device 155 may be coupled to the carrier 1 shown in FIG. 3A, FIG. 11A, FIG. 15, FIG. 33, FIG. 39, FIG. 42, and FIG. 46.

Figure 48:
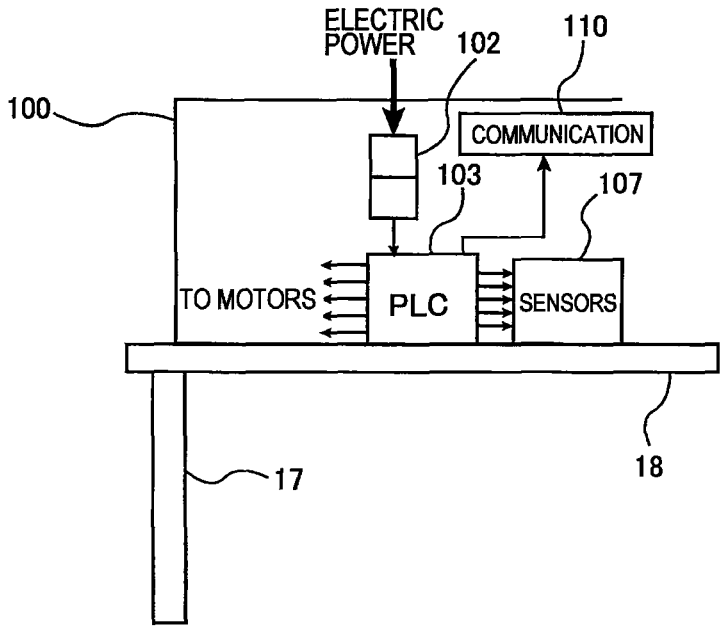
FIG. 48 is a schematic view of the control box provided on the carrier shown in FIG. 42, FIG. 46, and FIG. 47.

The control box 100 shown in FIG. 37 may be provided on the carrier 1 shown in FIG. 42, FIG. 46, and FIG. 47. FIG. 48 is a schematic view of the control box 100 provided on the carrier 1 shown in FIG. 42, FIG. 46, and FIG. 47. The control box 100 of this example is basically the same as the control box shown in FIG. 37, but is different in that the rotary joint and the solenoid valves are not provided. Specifically, the control box 100 includes the single-path rotary connector 102 coupled to the power source (not shown), the programmable controller (PLC) 103 coupled to the rotary connector 102, the sensors 107, and the communication device 110. The servomotors 130, 141, 151, 152 and the shaft motors 135 are operated by receiving the electric power supplied from the programmable controller 103. The operations of the servomotors 130, 141, 151, 152 and the shaft motors 135 are controlled by the programmable controller 103.

Figure 49:
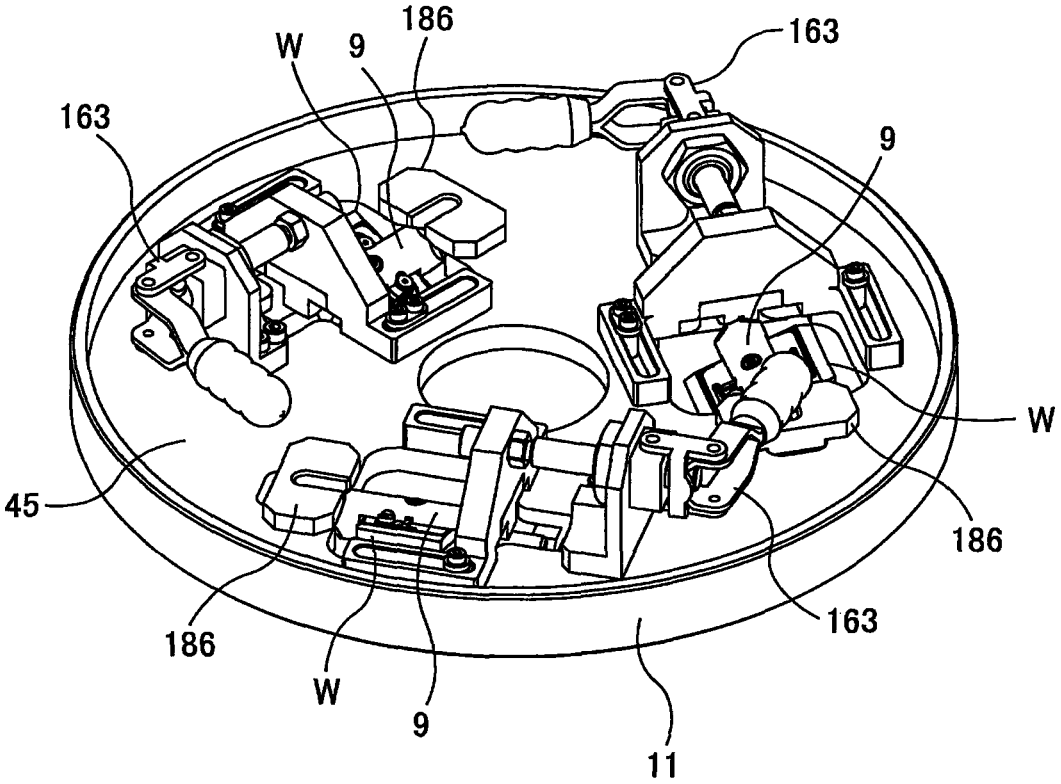
FIG. 49 is a view showing still another embodiment of the carrier.
Figure 50A:
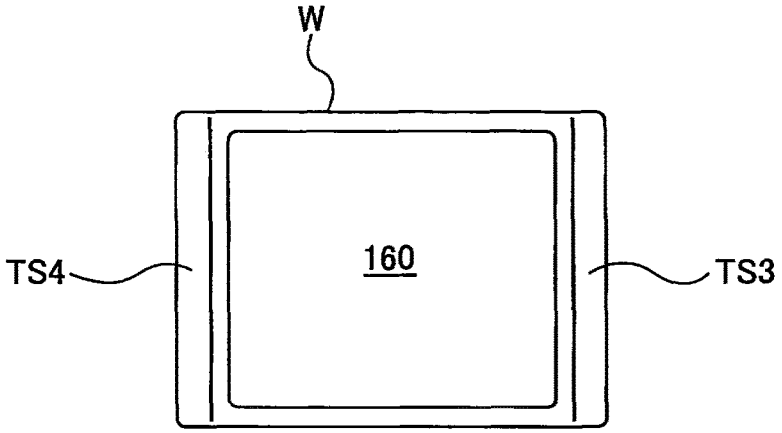
FIG. 50A is a plan view of a workpiece.
Figure 50B:
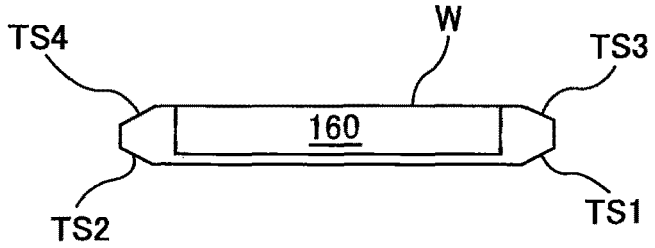
FIG. 50B is a cross-sectional view of the workpiece.

FIG. 49 is a view showing still another embodiment of the carrier 1. This carrier 1 according to the embodiment is suitably used for polishing four slopes TS1, TS2, TS3, and TS4 of a workpiece W shown in FIG. 50A and FIG. 50B. FIG. 50A is a plan view of the workpiece W, and FIG. 50B is a cross-sectional view of the workpiece W. This rectangular workpiece W has the slopes TS1 and TS2 on both sides of its lower surface, and the slopes TS3 and TS4 on both sides of its upper surface. These slopes TS1, TS2, TS3, and TS4 are surfaces to be polished. The upper surface of the workpiece W has a recess (or a space) 160 in a rectangular shape. Structures of the carrier 1, which will not be described particularly, are identical to those of the carrier 1 discussed above. Identical elements are denoted by the same reference numerals and their repetitive explanations are omitted. Structures of the CMP apparatus, other than the polishing pad 3 and the carrier 1, are also identical to the structures shown in FIG. 1 or FIG. 2.

As shown in FIG. 49, a circular bottom plate 45 is connected to the ring 11. This bottom plate 45 is located radially inwardly of the ring 11 and is formed integrally with the ring 11. The bottom surface of the ring 11 and a bottom surface of the bottom plate 45 lie in the same horizontal plane. The carrier 1 has three workpiece holders 9 for holding a plurality of (three in the example shown in the figures) workpieces W, and toggle mechanisms 163 configured to fix the positions of the workpiece holders 9.

Figure 51:
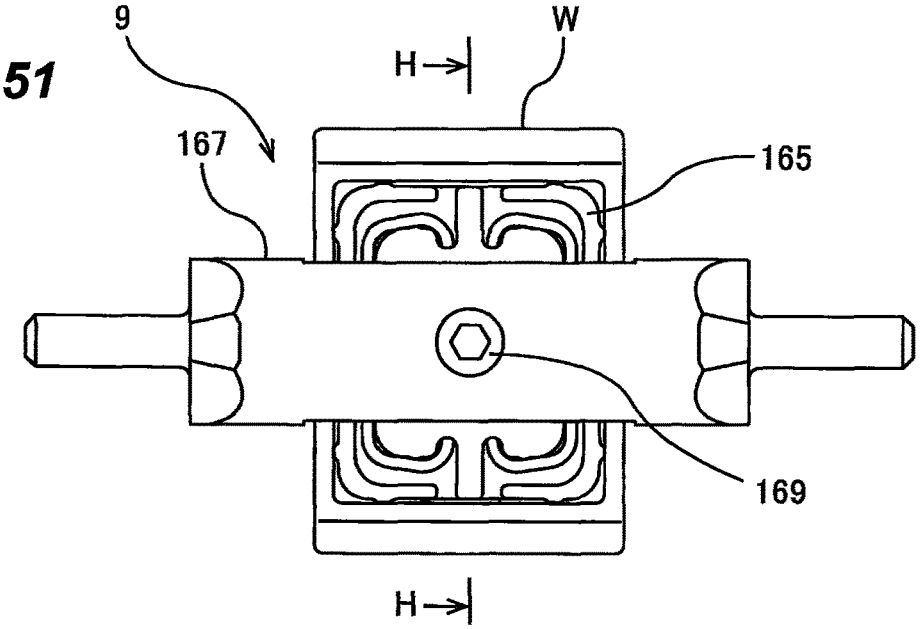
FIG. 51 is a plan view showing a workpiece holder.

FIG. 51 is a plan view of the workpiece holder 9. As shown in FIG. 51, the workpiece holder 9 includes a clamp 165 configured to hold the workpiece W, and a holding shaft 167 to which the clamp 165 is secured. The clamp 165 is removably secured to the holding shaft 167 by a screw 169. The clamp 165 is located in the recess 160 of the workpiece W, and presses an inner surface, which forms the recess 160, outwardly to thereby hold the workpiece W.

Figure 52:
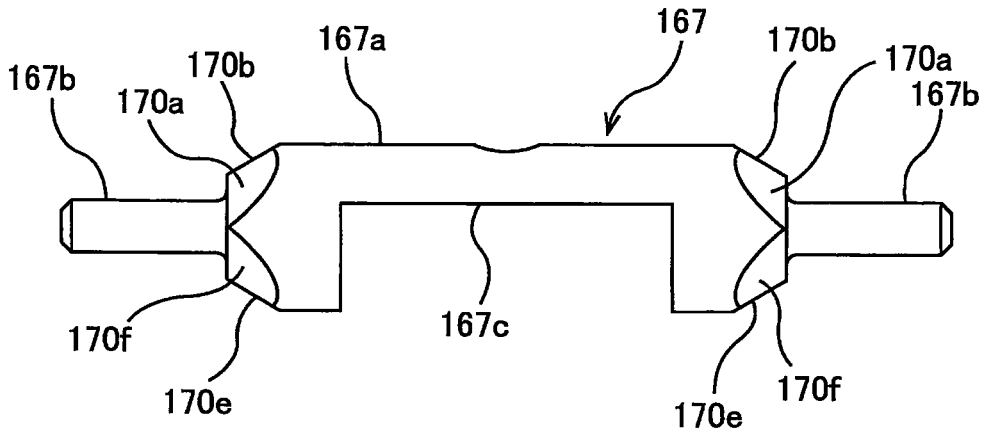
FIG. 52 is a side view showing a holding shaft of the workpiece holder shown in FIG. 51.
Figure 53:
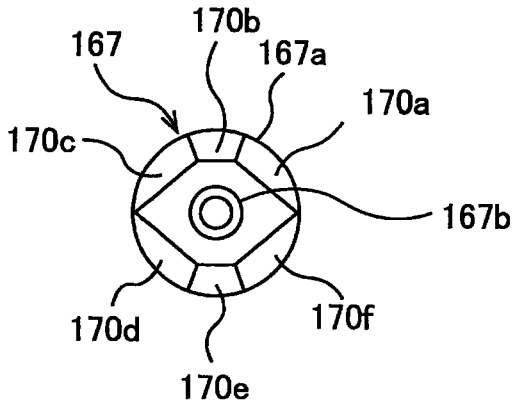
FIG. 53 is a view of the holding shaft as viewed from its axial direction.

FIG. 52 is a side view showing the holding shaft 167 of the workpiece holder 9 shown in FIG. 51, and FIG. 53 is a view of the holding shaft 167 as viewed from its axial direction. The holding shaft 167 has a main shaft portion 167*a* having a large diameter and support shaft portions 167*b* having a small diameter and extending axially outwardly from both ends of the main shaft portion 167*a*. The main shaft portion 167*a* has a flat surface 167*c* to which the clamp 165 is secured. The clamp 165 is removably secured to the flat surface 167*c* of the main shaft portion 167*a* by the above-described screw 169.

As shown in FIG. 52 and FIG. 53, six tapered surfaces 170*a*, 170*b*, 170*c*, 170*d*, 170*e*, and 170*f* (which may be simply represented by 170) are formed on both sides of the main shaft portion 167*a* along a circumferential direction of the holding shaft 167. Each tapered surface 170 is inclined from a circumferential surface of the main shaft portion 167*a* toward a central axis of the holding shaft 167. The adjacent tapered surfaces 170 intersect at a predetermined angle. These tapered surfaces 170 are used to fix the angle of the workpiece W with respect to the polishing surface of the polishing pad 3 (see FIG. 1), as will be discussed later.

Figure 54:
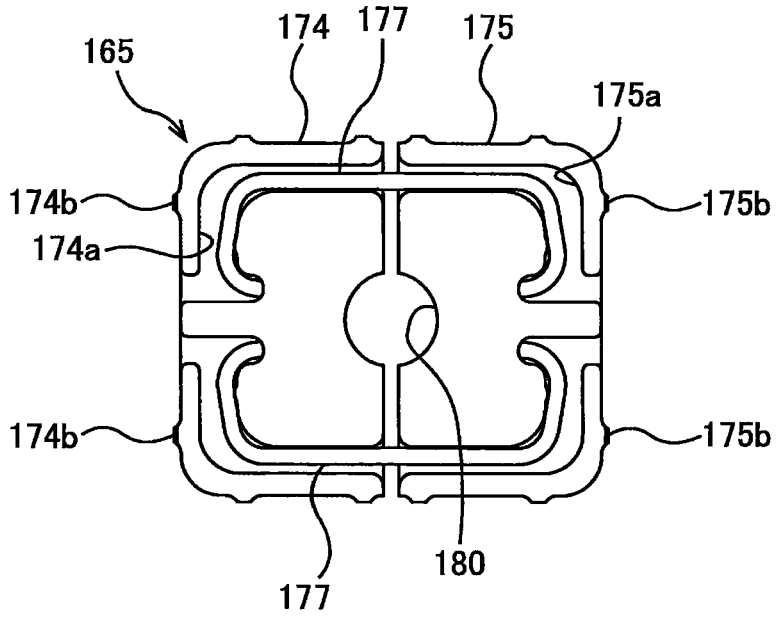
FIG. 54 is a plan view showing a clamp shown in FIG. 51.

FIG. 54 is a plan view of the clamp 165 shown in FIG. 51. This clamp 165 is suitably used for holding the workpiece W as shown in FIG. 50A and FIG. 50B. As shown in FIG. 54, the clamp 165 includes two holding blocks 174 and 175 arranged in series, and two coupling pins 177 for coupling the holding blocks 174 and 175 to each other. Each coupling pin 177 is a C-shaped ring pin. Upper surfaces of the holding blocks 174 and 175 have grooves 174*a* and 175*a* in which the coupling pins 177 are disposed, whereby the two holding blocks 174 and 175 are coupled to each other. Circumferential surfaces of the holding blocks 174 and 175 have protrusions 174*b* and 175*b* which are brought into contact with the inner surface that forms the recess 160 of the workpiece W.

Figure 55:
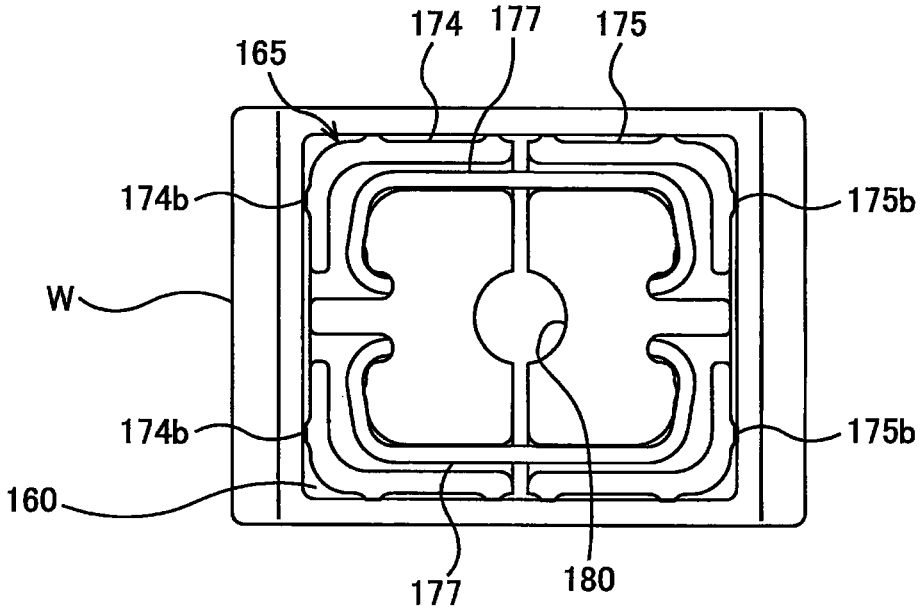
FIG. 55 is a plan view showing a state in which the clamp is located in a recess of the workpiece.
Figure 56:
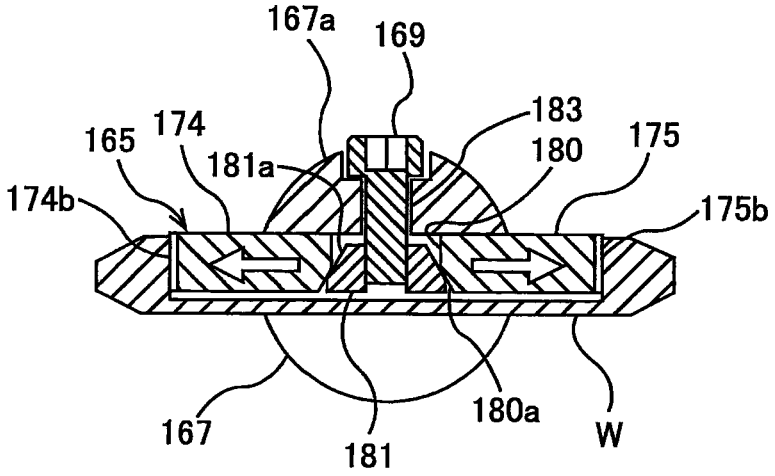
FIG. 56 is a cross-sectional view taken along line H-H shown in FIG. 51.

FIG. 55 is a plan view showing a state in which the clamp 165 is located in the recess 160 of the workpiece W, and FIG. 56 is a cross-sectional view taken along line H-H shown in FIG. 51. As shown in FIG. 55, the clamp 165 is configured to hold the workpiece W when the clamp 165 is located in the recess 160 of the workpiece W. A circular through-hole 180 is formed in the central portion of the clamp 165. This through-hole 180 has its lower portion formed by a truncated cone surface 180*a* whose diameter increases gradually. An anchor 181 having a truncated-cone-shaped circumferential surface 181*a* is inserted in the through-hole 180, so that the circumferential surface 181*a* of the anchor 181 contacts the truncated cone surface 180*a* of the through-hole 180.

The main shaft portion 167*a* of the holding shaft 167 has a through-hole 183 in which the screw 169 is inserted. The screw 169 extends through the through-hole 183 and is screwed into a threaded hole formed in the anchor 181. As the screw 169 is tightened up, the circumferential surface 181*a* of the anchor 181 is pressed against the truncated cone surface 180*a* to thereby move the two holding blocks 174 and 175 in directions away from each other (indicated by arrows in FIG. 56) to press the protrusions 174*b* and 175*b* against the inner surface of the recess 160. In this manner, the workpiece W is held by the plurality of protrusions 174*b* and 175*b* of the clamp 165.

Figure 57:
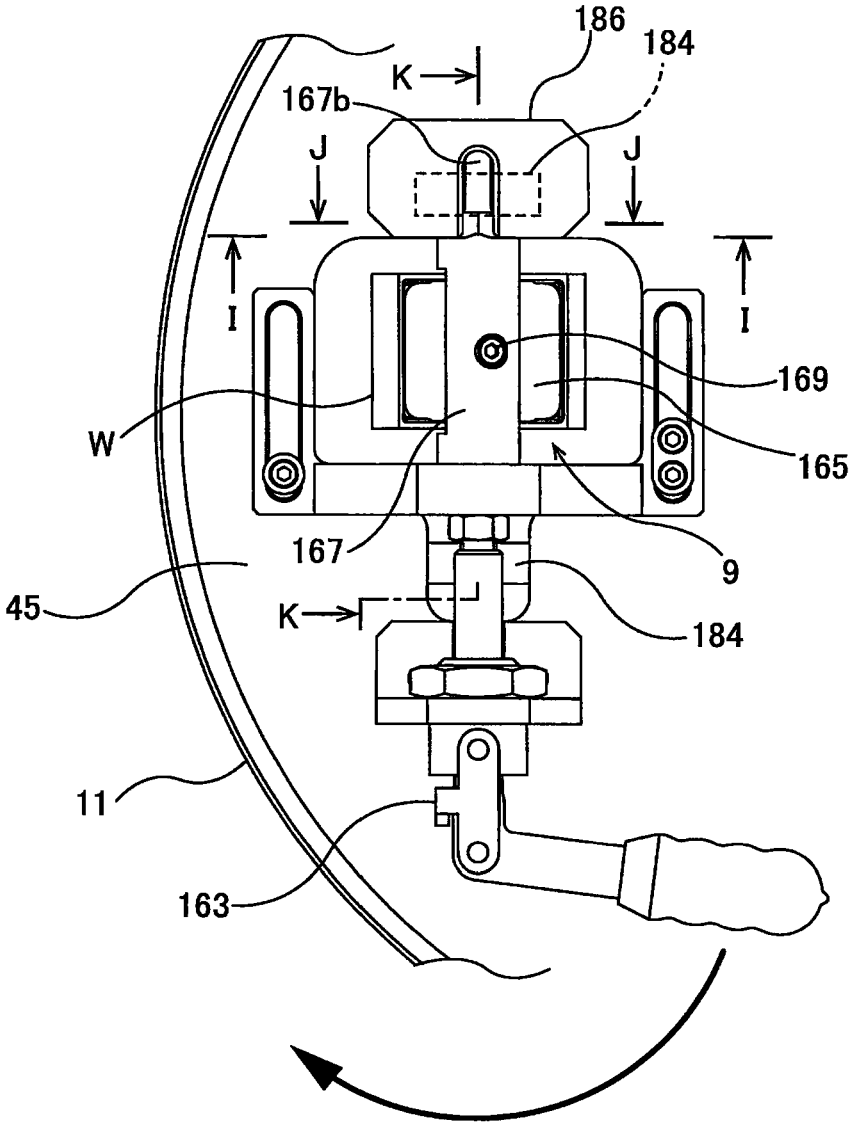
FIG. 57 is a plan view of a part of the carrier shown in FIG. 49.
Figure 58:
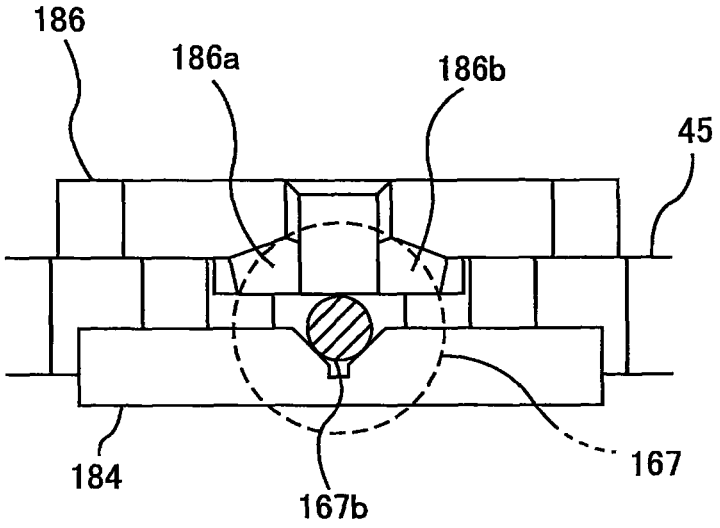
FIG. 58 is a cross-sectional view taken along line I-I shown in FIG. 57.
Figure 59:
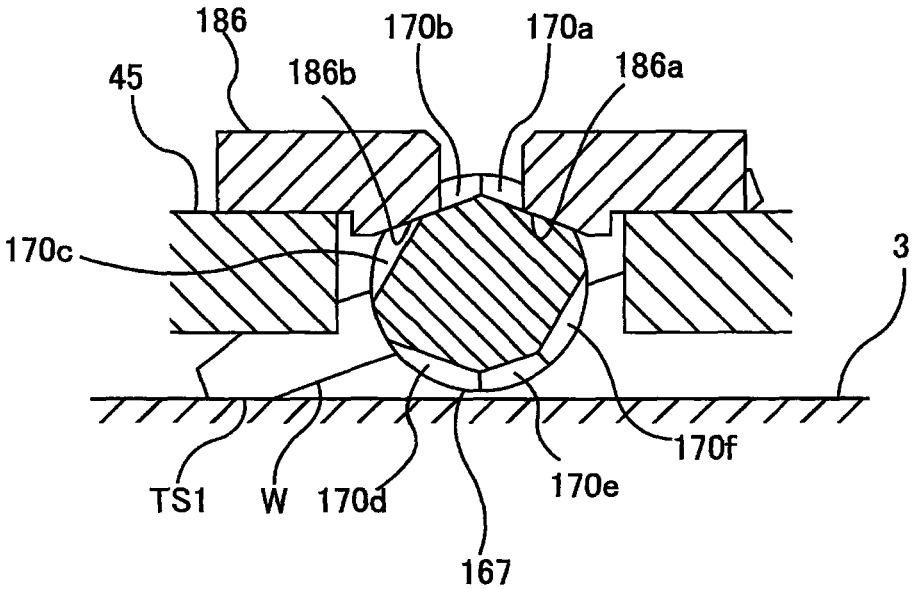
FIG. 59 is a cross-sectional view taken along line J-J shown in FIG. 57.
Figure 60:
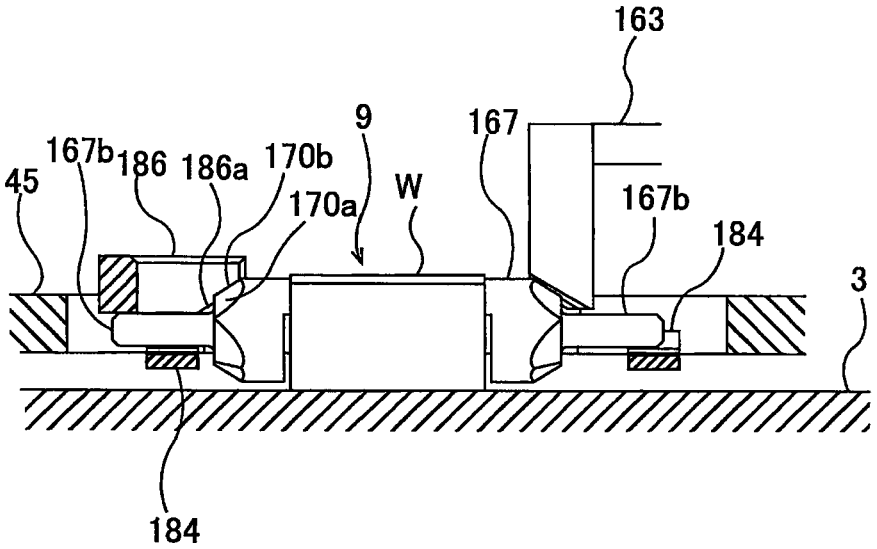
FIG. 60 is a cross-sectional view taken along line K-K shown in FIG. 57.

FIG. 57 is a plan view of a part of the carrier 1 shown in FIG. 49, FIG. 58 is a cross-sectional view taken along line I-I shown in FIG. 57, FIG. 59 is a cross-sectional view taken along line J-J shown in FIG. 57, and FIG. 60 is a cross-sectional view taken along line K-K shown in FIG. 57. Two shaft supporting pedestals 184, which have supporting surfaces, are secured to the bottom plate 45. Each supporting surface has a V-shaped cross section. These shaft supporting pedestals 184 rotatably support the two support shaft portions 167*b* of the holding shaft 167. A positioning member 186, which has two receiving surfaces 186*a* and 186*b* facing downward, is disposed above one of the two shaft supporting pedestals 184. These receiving surfaces 186*a* and 186*b* are formed in parallel with adjacent two of the six tapered surfaces 170*a* to 170*f* of the holding shaft 167. The shaft supporting pedestals 184 are secured to the lower surface of the bottom plate 45, and the positioning member 186 are secured to the upper surface of the bottom plate 45.

The toggle mechanism 163 is configured to press the adjacent two of the six tapered surfaces 170*a* to 170*f* of the holding shaft 167 against the receiving surfaces 186*a* and 186*b* of the positioning member 186 when its lever is rotated, and to release the tapered surfaces 170 from the receiving surfaces 186*a* and 186*b* when the lever is rotated in the opposite direction. FIG. 57, FIG. 59, and FIG. 60 show the state in which the tapered surfaces 170*a* and 170*b* of the holding shaft 167 are pressed against the receiving surfaces 186*a* and 186*b* of the positioning member 186, respectively. In this state, the receiving surfaces 186*a* and 186*b* hold the position and the angle of the holding shaft 167 to thereby fix the position of the surface, to be polished, of the workpiece W and the angle of the workpiece W relative to the polishing surface of the polishing pad 3. When the lever is rotated in the direction indicated by arrow shown in FIG. 57, the tapered surfaces 170*a* and 170*b* of the holding shaft 167 are allowed to be separated from the receiving surfaces 186*a* and 186*b* of the positioning member 186. Therefore, the workpiece W can be rotated, and further the workpiece holder 9 with the workpiece W attached thereto can be removed from the carrier 1.

Figure 61:
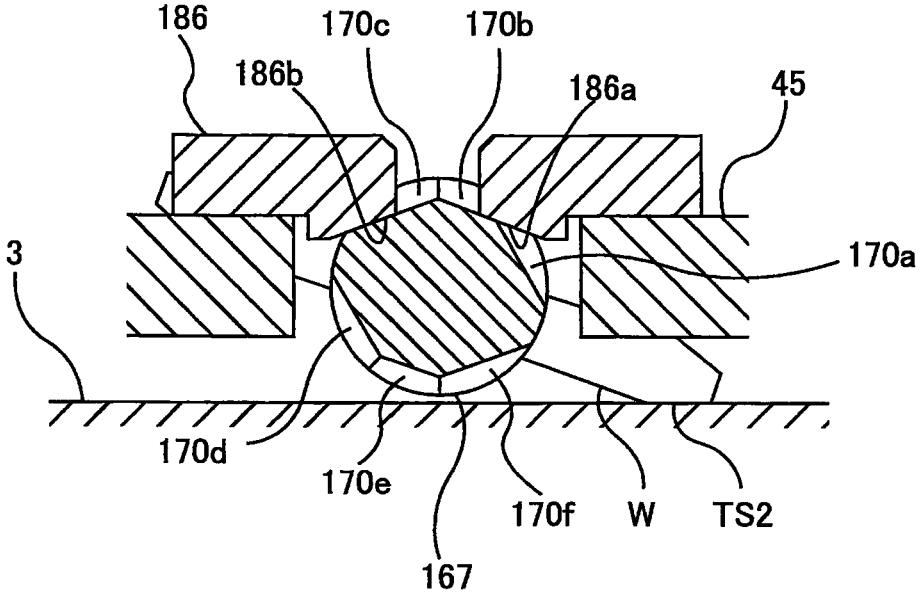
FIG. 61 is a cross-sectional view showing a state in which an angle of the workpiece with respect to the polishing pad is changed.

As shown in FIG. 59, the two receiving surfaces 186*a* and 186*b* are inclined at a predetermined angle with respect to each other. This angle between the receiving surfaces 186*a* and 186*b* is equal to the angle between the adjacent two tapered surfaces 170 of the holding shaft 167. As shown in FIG. 59, when two of the six tapered surfaces 170 of the holding shaft 167 are pressed against the two receiving surfaces 186*a* and 186*b*, respectively, the angle of the workpiece W relative to the polishing pad 3 is fixed. FIG. 59 is a view showing a state in which the slope TS1 of the workpiece W is in contact with the polishing pad 3. As shown in FIG. 61, when other two of the six tapered surfaces 170*a* to 170*f* of the holding shaft 167 are pressed against the two receiving surfaces 186*a* and 186*b*, the workpiece W is inclined at a different angle with respect to the polishing pad 3. FIG. 61 is a view showing a state in which two tapered surfaces 170*b* and 170*c* are pressed against the receiving surfaces 186*a* and 186*b*, respectively. In this manner, all of the four slopes TS1 to TS4, which are formed on the edges of the upper and lower surfaces of the workpiece W, can be polished.

Figure 62:
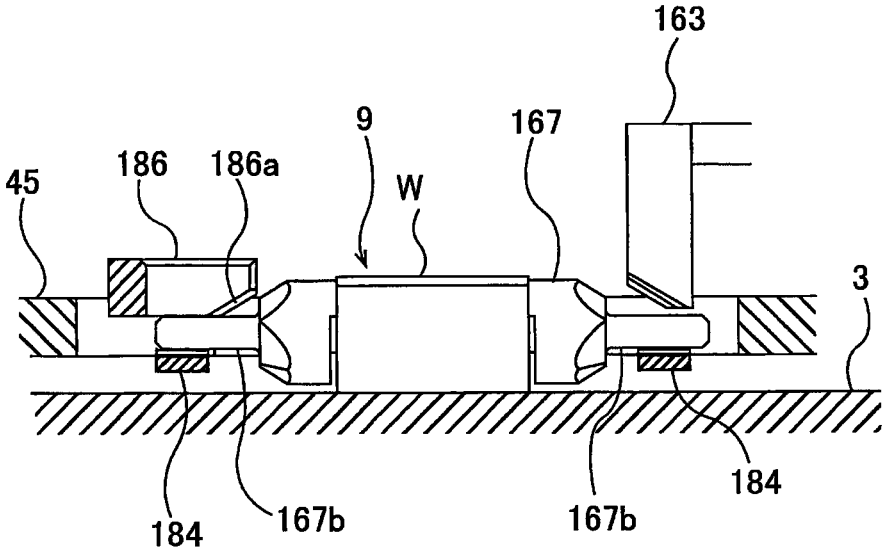
FIG. 62 is a cross-sectional view showing a state in which the holding shaft is released from a positioning member by an operation of a toggle mechanism.
Figure 63:
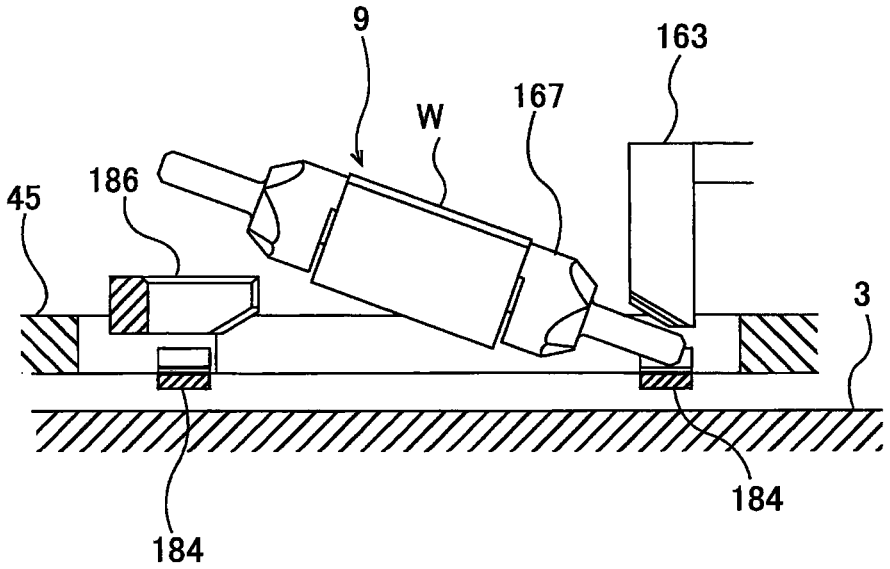
FIG. 63 is a view showing a state in which the workpiece holder, together with the workpiece, is removed from the carrier.

FIG. 62 is a cross-sectional view showing a state in which the holding shaft 167 is released from the positioning member 186 by the operation of the toggle mechanism 163. In this state, the two supporting shaft portions 167*b* of the holding shaft 167 are merely rotatably supported on the two shaft supporting pedestals 184. Therefore, the workpiece W in its entirety can be rotated about the holding shaft 167, so that other slopes of the workpiece W can be polished. FIG. 63 is a view showing a state in which the workpiece holder 9, together with the workpiece W, is removed from the carrier 1. Since the workpiece holder 9 can be removed from the carrier 1 in this manner, it is possible to replace the workpiece W without removing the carrier 1 itself from the polishing pad 3.

Figure 64:
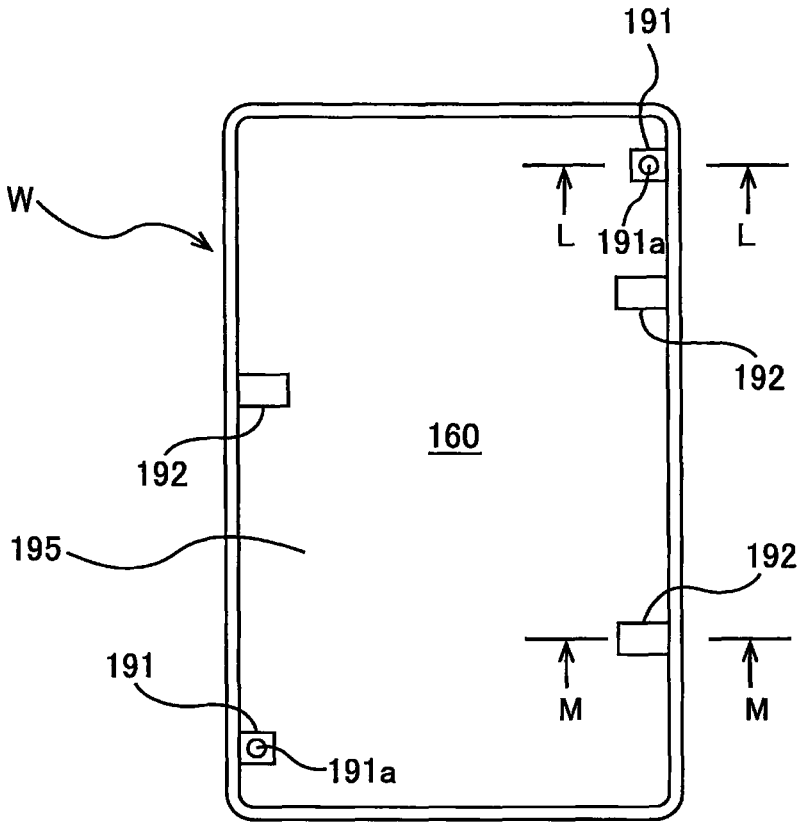
FIG. 64 is a plan view showing another example of the workpiece.

FIG. 64 is a plan view showing another example of the workpiece W. This workpiece W has a rectangular shape and has recess 160 formed therein is as well as the workpiece W shown in FIG. 50A and FIG. 50B, but is different in that two first positioning members 191 and three second positioning members 192 are provided in the recess 160.

Figure 65:
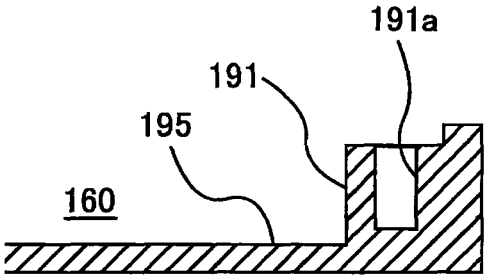
FIG. 65 is a cross-sectional view taken along line L-L shown in FIG. 64.
Figure 66:
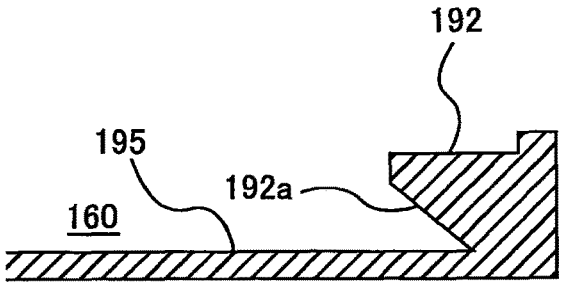
FIG. 66 is a cross-sectional view taken along line M-M shown in FIG. 64.

FIG. 65 is a cross-sectional view taken along line L-L shown in FIG. 64. The first positioning members 191 are used for positioning of the workpiece W in a direction parallel to a bottom surface 195 of the workpiece W (this direction will be hereinafter referred to as XY direction). Each first positioning member 191 has a vertical hole 191*a* extending in a direction perpendicular to the bottom surface 195 of the workpiece W. The first positioning members 191 are located on diagonally opposite corners of the rectangular workpiece W. FIG. 66 is a cross-sectional view taken along line M-M shown in FIG. 64. The second positioning members 192 are used for positioning of the workpiece W in a direction perpendicular to the bottom surface 195 of the workpiece W (this direction will be hereinafter referred to as Z direction). Each second positioning member 192 has an engagement slope 192*a* extending upwardly toward an inward direction of the workpiece W. The first positioning members 191 and the second positioning members 192 are arranged along an inner surface that forms the recess 160 of the workpiece W.

Figure 67:
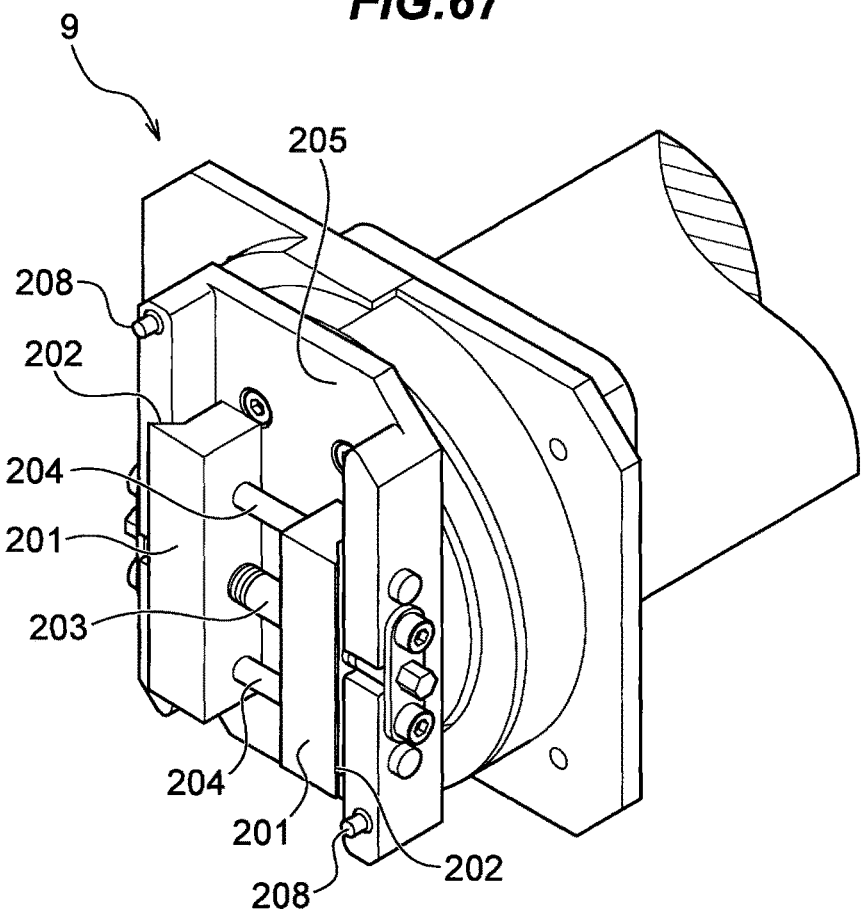
FIG. 67 is a perspective view of a workpiece holder adapted to hold the workpiece shown in FIG. 64.

FIG. 67 is a perspective view of the workpiece holder 9 adapted to hold the workpiece W shown in FIG. 64. This workpiece holder 9 includes a pair of clamps 201 for holding the workpiece W, a screw rod 203 for moving the clamps 201 closer to and away from each other, guide members 204 for guiding the movement of the workpiece W, a clamp base 205 for supporting the screw rod 203 and the guide members 204, and two positioning pins 208 secured to the clamp base 205. The screw rod 203 extends through the clamps 201 and rotatably held by the clamp base 205. The screw rod 203 and the guide members 204 are arranged in parallel with each other.

Figure 68:
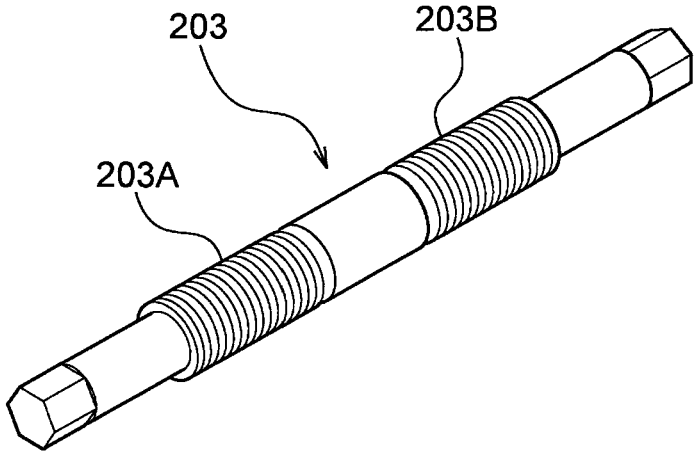
FIG. 68 is a perspective view of a screw rod.

FIG. 68 is a perspective view of the screw rod 203. This screw rod 203 has a right-hand screw thread 203A and a left-hand screw thread 203B formed on its circumferential surface. The right-hand screw thread 203A and the left-hand screw thread 203B are engaged with threaded holes (not shown), respectively, which are formed in the clamps 201. When the screw rod 203 is rotated in one direction, the pair of clamps 201 are moved away from each other. When the screw rod 203 is rotated in the opposite direction, the pair of clamps 201 are moved closer to each other. This movement of the clamps 201 is guided by the guide members 204 extending parallel to the screw rod 203. The positioning pins 208 are arranged at positions corresponding to the positions of the vertical holes 191*a* of the first positioning members 191 of the workpiece W. The workpiece W is attached to the workpiece holder 9 with the two positioning pins 208 inserted into the two vertical holes 191*a*, respectively.

Figure 69:
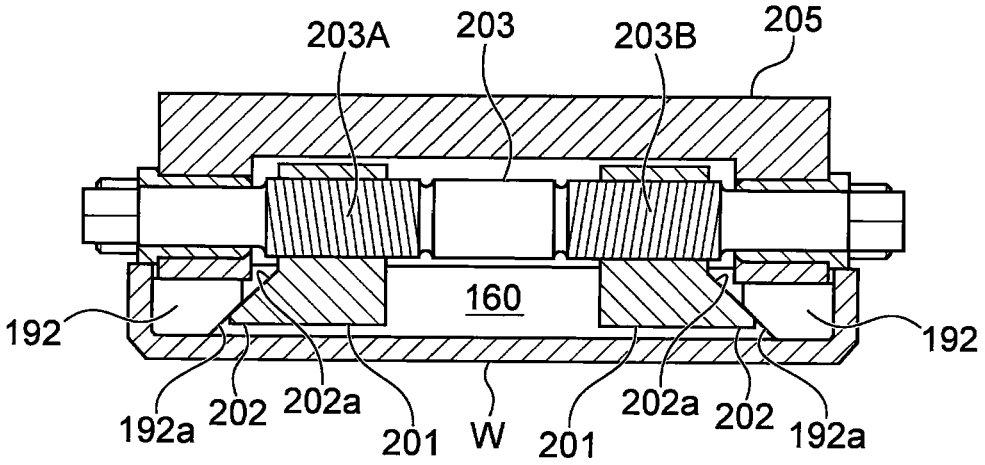
FIG. 69 is a cross-sectional view of the workpiece holder shown in FIG. 64.

FIG. 69 is a cross-sectional view of the workpiece holder 9 shown in FIG. 64. When the workpiece W is attached to the workpiece holder 9, the clamps 201 are located inwardly of the second positioning members 192. The clamps 201 have claws 202 having upper surfaces 202*a* inclined upwardly along the engagement slopes 192*a* of the second positioning members 192. When the screw rod 203 is rotated in one direction, the clamps 201 are moved away from each other to press the upper surfaces 202*a* against the engagement slopes 192*a*. As the claws 202 are moved toward the outside of the workpiece W, the workpiece W is forced to move upward (i.e., toward the clamp base 205) due to the engagement between the upper surfaces 202*a* of the claws 202 and the engagement slopes 192*a*, until upper surfaces of the first positioning members 191 are brought into contact with a lower surface of the clamp base 205. The workpiece W is interposed between the claws 202 and the clamp base 205 with the positioning pins 208 inserted into the vertical holes 191*a* of the first positioning members 191. The position of the workpiece W in the XY direction is fixed by the first positioning members 191 and the positioning pins 208, and the position of the workpiece W in the Z direction is fixed by the second positioning members 192 and the claws 202 of the clamps 201.

In the above-discussed embodiments, a polishing end point of the workpiece W may be determined based on a polishing time. More specifically, when the polishing time reaches a predetermined target time, polishing of the workpiece W may be terminated.

Examples of the workpiece W include a metal body made of aluminum, stainless steel, or the like, and a resin body. The body may be used in, for example, a cellular phone, a smart phone, a multifunction mobile terminal, a portable game device, a camera, a watch, a music media player, a personal computer, car parts, ornaments, medical equipment, or the like. According to the present invention, it is possible to polish such workpiece to a mirror finish.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A chemical mechanical polishing method of polishing workpieces using a chemical mechanical polishing apparatus, the method comprising:
- mounting workpieces on a carrier of the chemical mechanical polishing apparatus comprising:
  - a rotatable polishing table having a surface for supporting a polishing pad;
  - the carrier configured to press workpieces against the polishing pad, the carrier including:
    - (i) a ring-shaped mounting disk with an outermost circumferential surface
    - (ii) workpiece holders secured to the ring-shaped mounting disk, each workpiece holder configured to simultaneously hold the respective workpiece at an oblique angle orientation relative to the surface of the polishing table, and
    - (iii) rotary actuators coupled to the workpiece holders, respectively, the rotary actuators being configured to pivot the workpiece holders about predetermined pivot axes through a predetermined range of angles while simultaneously maintaining the workpiece in the oblique angle orientation and in contact with the polishing pad;
  - a rotating device configured to rotate the carrier about an axis of the carrier through tangential contact with the ring-shaped mounting disk, the axis being substantially perpendicular to the surface of the polishing table; and
  - a polishing liquid supply mechanism configured to supply a polishing liquid onto the polishing pad
- rotating the polishing pad including an elastic pad having a polishing surface, a deformable base layer that supports the elastic pad, and an adhesive layer that joins the elastic pad to the base layer, the adhesive layer having a higher elasticity than that of the elastic pad;
- supplying the polishing liquid onto the polishing pad; and
- polishing the workpieces simultaneously by rotating the carrier, which is holding the workpieces, on the polishing pad about the axis of the carrier.

2. The chemical mechanical polishing method according to claim 1, further comprising:
- causing the workpieces to pivot about different pivot axes extending near curved surfaces, to be polished, of the workpieces, while rotating the carrier about the axis thereof.

3. The chemical mechanical polishing method according to claim 1, further comprising:
- causing lower portions of the workpieces to sink into the polishing pad, while rotating the carrier about the axis thereof.

4. The chemical mechanical polishing method according to claim 1, further comprising:
- deforming the polishing pad into a shape of curved surfaces of the workpieces where the workpieces are in contact with the polishing pad, while rotating the carrier about the axis thereof.

5. The chemical mechanical polishing method according to claim 1, further comprising:
- exerting an upward force on the carrier so as to regulate polishing pressure of the workpieces, while rotating the carrier about the axis thereof.

6. The chemical mechanical polishing method according to claim 1, wherein the base layer has a thickness at least sixteen times that of the elastic pad.

7. The chemical mechanical polishing method according to claim 1, wherein the base layer is made of polyurethane sponge.

8. The chemical mechanical polishing method according to claim 1, wherein the polishing pad has an elasticity such that, when a curved surface of each workpiece is pressed against the polishing pad at a polishing pressure of 380 $gf/cm^2$, the workpiece sinks into the polishing pad by 5 mm or more.

9. The chemical mechanical polishing method according to claim 1, wherein the pivot axes are inclined from both the polishing surface and the axis of the carrier.

10. The chemical mechanical polishing method according to claim 1, wherein the step polishing the workpieces includes mounting a weight to the ring-shaped mounting disk for applying additional polishing pressure.

11. The chemical mechanical polishing method according to claim 1, wherein the workpieces include a curved surface and the polishing pad includes a deformable base layer and during said step of polishing the workpieces the deformable base layer conforms to shape of the curved surface of the workpieces when the workpieces are pressed against the polishing pad.

12. A chemical mechanical polishing apparatus for polishing workpieces, the workpieces having a three-dimensional surface comprising a combination of a planar surface and a curved surface, the apparatus comprising:

a rotatable polishing table having a surface for supporting a polishing pad;

a carrier configured to press workpieces against the polishing pad, the carrier including:

(i) a ring-shaped mounting disk with an outermost circumferential surface (ii) workpiece holders secured to the ring-shaped mounting disk, each workpiece holder configured to simultaneously hold the respective workpiece at an oblique angle orientation relative to the surface of the polishing table, and (iii) rotary actuators coupled to the workpiece holders, respectively, the rotary actuators being configured to pivot the workpiece holders about predetermined pivot axes through a predetermined range of angles while simultaneously maintaining the workpieces in the oblique angle orientation and in contact with the polishing pad;

a rotating device configured to rotate the carrier about an axis of the carrier through tangential contact with the ring-shaped mounting disk, the axis being substantially perpendicular to the surface of the polishing table; and a polishing liquid supply mechanism configured to supply a polishing liquid onto the polishing pad.

13. The chemical mechanical polishing apparatus according to claim 12, wherein:

the carrier further includes rotary couplings which couple the workpiece holders to the rotary actuators, respectively; and each of the rotary actuators is configured to allow an angle of one of the workpiece holders to change relative to one of the rotary actuators.

14. The chemical mechanical polishing apparatus according to claim 13, wherein the rotary couplings are configured to support the workpiece holders such that the workpiece holders are rotatable about rotation axes, respectively, the rotation axes extending in parallel with the pivot axes, respectively.

15. The chemical mechanical polishing apparatus according to claim 13, wherein:

each of the rotary couplings comprises a first rotary coupling and a second rotary coupling;

the first rotary coupling is configured to couple one of the workpiece holders to the second rotary coupling and support the one of the workpiece holders rotatably about a first rotation axis extending in parallel with one of the pivot axes; and the second rotary coupling is configured to couple the first rotary coupling to one of the rotary actuators and support the first rotary coupling rotatably about a second rotation axis extending in parallel with the one of the pivot axes and the first rotation axis.

16. The chemical mechanical polishing apparatus according to claim 12, wherein:

each of the workpieces has surfaces, to be polished, including a first surface, a second surface, and a curved surface connecting the first surface to the second surface; and an angle between the first surface and the second surface defines the predetermined range of angles.

17. The chemical mechanical polishing apparatus according to claim 12, wherein the carrier further includes a cover member that covers one of the workpieces along an edge of a surface, to be polished, of the one of the workpieces.

18. The chemical mechanical polishing apparatus according to claim 12, wherein the carrier further includes a programmable controller configured to control operations of the rotary actuators, and a communication device configured to communicate with an external central controller, and wherein the programmable controller is configured to transmit and receive information to and from the central controller through the communication device.

19. The chemical mechanical polishing apparatus according to claim 12, further comprising:

a lifting device configured to exert an upward force on the carrier so as to control polishing pressure of the workpieces.

20. The chemical mechanical polishing apparatus according to claim 12, further comprising:

a weight configured to mounted to the ring-shaped mounting disk for applying additional polishing pressure.

21. The chemical mechanical polishing apparatus according to claim 20, wherein the weight is a ring-shaped component configured to mount on the ring-shaped mounting disk.

22. A chemical mechanical polishing apparatus for polishing workpieces, the workpieces having a three dimensional surface comprising by a combination of a planar surface and a curved surface, the apparatus comprising:

a rotatable polishing table having a surface for supporting a polishing pad;

a carrier configured to press workpieces against the polishing pad, wherein the carrier includes:

a ring-shaped mounting disk with an outermost circumferential surface, workpiece holders secured to the ring-shaped mounting disk, each workpiece holder configured to simultaneously hold the respective workpiece at an oblique angle orientation relative to the surface of the polishing table, rotary actuators coupled to the workpiece holders, respectively, the rotary actuators being configured to provide rotation of the workpiece holders about central axes of the workpieces through a predetermined range of angles at a preset speed while simultaneously maintaining the workpieces in the oblique angle orientation and in contact with the polishing pad; and a vertically moving mechanism configured to move the workpieces up and down in synchronization with the rotation of the workpiece holders;

a rotating device configured to rotate the carrier about an axis of the carrier through tangential contact with the ring-shaped mounting disk, the axis being substantially perpendicular to the surface of the polishing table; and a polishing liquid supply mechanism configured to supply a polishing liquid onto the polishing pad.

23. The chemical mechanical polishing apparatus according to claim 22, wherein each of the rotary actuators comprises a servomotor.

24. The chemical mechanical polishing apparatus according to claim 22, wherein a rotation axis of each of the rotary actuators is inclined with respect to a direction perpendicular to the polishing pad.

25. The chemical mechanical polishing apparatus according to claim 22, wherein the carrier further includes a cover member that covers one of the workpieces along an edge of a surface, to be polished, of the one of the workpieces.

26. The chemical mechanical polishing apparatus according to claim 22, wherein the carrier further includes a programmable controller configured to control operations of the rotary actuator and the vertically moving mechanism, and a communication device configured to communicate with an external central controller, and wherein the programmable controller is configured to transmit and receive information to and from the central controller through the communication device.

27. The chemical mechanical polishing apparatus according to claim 22, further comprising:

a lifting device configured to exert an upward force on the carrier so as to regulate polishing pressure of the workpieces.

28. A chemical mechanical polishing method of polishing workpieces using a chemical mechanical polishing apparatus, the method comprising:

mounting workpieces on a carrier of the chemical mechanical polishing apparatus comprising:

a rotatable polishing table having a surface for supporting a polishing pad;

the carrier configured to press workpieces against the polishing pad, the carrier including:

(i) a ring-shaped mounting disk with an outermost circumferential surface (ii) workpiece holders secured to the ring-shaped mounting disk, each workpiece holder configured to simultaneously hold the respective workpiece at an oblique angle orientation relative to the surface of the polishing table, and (iii) rotary actuators coupled to the workpiece holders, respectively, the rotary actuators being configured to pivot the workpiece holders about predetermined pivot axes through a predetermined range of angles while simultaneously maintaining the workpieces in the oblique angle orientation and in contact with the polishing pad;

a rotating device configured to rotate the carrier about an axis of the carrier through tangential contact with the ring-shaped mounting disk, the axis being substantially perpendicular to the surface of the polishing table; and a polishing liquid supply mechanism configured to supply a polishing liquid onto the polishing pad rotating the polishing pad including an elastic pad having a polishing surface, a deformable base layer that supports the elastic pad, and an adhesive layer that joins the elastic pad to the base layer, the adhesive layer having a higher elasticity than that of the elastic pad;

supplying the polishing liquid onto the polishing pad; and rotating the carrier, which is holding the workpieces, on the polishing pad about the axis of the carrier;

polishing a flat surface of the workpieces by placing the flat surface in sliding contact with the polishing surface of the polishing pad; and polishing an angular portion of the workpiece by placing the angular surface in sliding contact with the polishing surface of the polishing pad.

29. The chemical mechanical polishing method according to claim 28, wherein the base layer has a thickness at least sixteen times that of the elastic pad.

30. The chemical mechanical polishing method according to claim 28, wherein the base layer is made of polyurethane sponge.

31. The chemical mechanical polishing method according to claim 28, wherein the polishing pad has an elasticity such that, when a curved surface of each workpiece is pressed against the polishing pad at a polishing pressure of 380 $gf/cm^2$, the workpiece sinks into the polishing pad by 5 mm or more.

32. A chemical mechanical polishing apparatus for polishing a curved surface of a workpieces, the apparatus comprising:

a polishing pad including an elastic pad having a polishing surface, a deformable base layer that supports the elastic pad, and an adhesive layer that joins the elastic pad to the base layer, the adhesive layer having a higher elasticity than that of the elastic pad;

a rotatable polishing table supporting the polishing pad;

a carrier configured to press workpieces against the polishing pad, the carrier including:

(i) a ring-shaped mounting disk with an outermost circumferential surface, (ii) workpiece holders secured to the ring-shaped mounting disk, each workpiece holder configured to simultaneously hold the workpieces at an oblique angle orientation relative to the surface of the polishing table, and (iii) rotary actuators coupled to the workpiece holders, respectively, the rotary actuators being configured to rotate the workpieces, held by the workpiece holders, about predetermined pivot axes through a predetermined range of angles at a preset speed while simultaneously maintaining the workpieces in the oblique angle orientation; and a rotating device configured to rotate the carrier about an axis of the carrier through tangential contact with the ring-shaped mounting disk, the axis being substantially perpendicular to the surface of the polishing table.

33. The chemical mechanical polishing apparatus according to claim 32, wherein the base layer has a thickness at least sixteen times that of the elastic pad.

34. The chemical mechanical polishing apparatus according to claim 32, wherein the base layer is made of polyurethane sponge.

35. The chemical mechanical polishing apparatus according to claim 32, wherein the polishing pad has an elasticity such that, when the curved surface of each workpiece is pressed against the polishing pad at a polishing pressure of 380 gf/cm$^2$, the workpiece sinks into the polishing pad by 5 mm or more.

36. The chemical mechanical polishing apparatus according to claim 32, wherein the deformable base layer is configured to conform to shape of the curved surface of the workpieces when the workpieces are pressed against the polishing pad.

* * * * *